US009747910B2

(12) United States Patent
Kim et al.

(10) Patent No.: US 9,747,910 B2
(45) Date of Patent: Aug. 29, 2017

(54) SWITCHING BETWEEN PREDICTIVE AND NON-PREDICTIVE QUANTIZATION TECHNIQUES IN A HIGHER ORDER AMBISONICS (HOA) FRAMEWORK

(71) Applicant: QUALCOMM Incorporated, San Diego, CA (US)

(72) Inventors: Moo Young Kim, San Diego, CA (US); Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 63 days.

(21) Appl. No.: 14/858,685

(22) Filed: Sep. 18, 2015

(65) Prior Publication Data

US 2016/0093311 A1 Mar. 31, 2016

Related U.S. Application Data

(60) Provisional application No. 62/056,248, filed on Sep. 26, 2014, provisional application No. 62/056,286, filed on Sep. 26, 2014.

(51) Int. Cl.
*H04R 5/00* (2006.01)
*G10L 19/038* (2013.01)
(Continued)

(52) U.S. Cl.
CPC ..... *G10L 19/038* (2013.01); *G10L 19/008* (2013.01); *H04S 3/008* (2013.01);
(Continued)

(58) Field of Classification Search
CPC ..... G10L 19/008; G10L 19/038; H04R 5/00; H04S 3/008
(Continued)

(56) References Cited

U.S. PATENT DOCUMENTS 4,709,340 A 11/1987 Capizzi et al.
5,012,518 A 4/1991 Liu et al.
(Continued)

FOREIGN PATENT DOCUMENTS

CN 102823277 A 12/2012
CN 104285390 A 1/2015
(Continued)

OTHER PUBLICATIONS

Bosi et al, "ISO/IEC MPEG-2 Advanced Audio Coding," In 101st AES Convention, Los Angeles, Nov. 1996, 43 pp.
(Continued)

*Primary Examiner* — Van D Huynh
(74) *Attorney, Agent, or Firm* — Shumaker & Sieffert, P.A.

(57) ABSTRACT

A device comprising a memory and one or more processors may be configured extract, from the bitstream, a type of quantization mode. The one or more processors may also be configured to switch, based on the type of quantization mode, between non-predictive vector dequantization to reconstruct a first set of one or more weights used to approximate the multi-directional V-Vector in the higher order ambisonics domain, and predictive vector dequantization to reconstruct a second set of one or more weights used to approximate the multi-directional V-Vector in the higher order ambisonics domain. The memory may be configured to store the reconstructed first set of one or more weights used to approximate the multi-directional V-Vector in the higher order ambisonics domain, and the reconstructed second set of one or more weights used to approximate the multi-directional V-Vector in the higher order ambisonics domain.

20 Claims, 29 Drawing Sheets

(51) Int. Cl.
*G10L 19/008* (2013.01)
*H04S 3/00* (2006.01)
*H04S 7/00* (2006.01)

(52) U.S. Cl.
CPC ..... *H04S 7/308* (2013.01); *H04R 2205/021* (2013.01); *H04R 2499/11* (2013.01); *H04R 2499/13* (2013.01); *H04S 2400/15* (2013.01); *H04S 2420/11* (2013.01)

(58) Field of Classification Search
USPC ..... 381/22
See application file for complete search history.

(56) References Cited

U.S. PATENT DOCUMENTS 5,633,981 A 5/1997 Davis
5,757,927 A 5/1998 Gerzon et al.
5,790,759 A 8/1998 Chen
5,819,215 A 10/1998 Dobson et al.
5,821,887 A 10/1998 Zhu
5,970,443 A 10/1999 Fujii
6,167,375 A 12/2000 Miseki et al.
6,263,312 B1 7/2001 Kolesnik et al.
6,370,502 B1 4/2002 Wu et al.
6,493,664 B1 * 12/2002 Udaya Bhaskar ..... G10L 19/02 704/221
7,271,747 B2 9/2007 Baraniuk et al.
7,822,601 B2 10/2010 Mehrotra et al.
7,920,709 B1 4/2011 Hickling
8,160,269 B2 4/2012 Mao et al.
8,374,358 B2 2/2013 Buck et al.
8,379,868 B2 2/2013 Goodwin et al.
8,391,500 B2 3/2013 Hannemann et al.
8,452,587 B2 5/2013 Liu et al.
8,570,291 B2 10/2013 Motomura et al.
8,817,991 B2 8/2014 Jaillet et al.
8,908,873 B2 12/2014 Herre et al.
8,958,582 B2 2/2015 Yoo et al.
9,015,051 B2 4/2015 Pulkki
9,053,697 B2 6/2015 Park et al.
9,084,049 B2 7/2015 Fielder et al.
9,100,768 B2 8/2015 Batke et al.
9,129,597 B2 9/2015 Bayer et al.
9,230,558 B2 1/2016 Disch et al.
9,338,574 B2 5/2016 Jax et al.
9,454,971 B2 9/2016 Kruger et al.
2001/0036286 A1 11/2001 Layton et al.
2002/0044605 A1 4/2002 Nakamura
2002/0049586 A1 4/2002 Nishio et al.
2002/0169735 A1 11/2002 Kil et al.
2003/0147539 A1 8/2003 Elko et al.
2003/0179197 A1 9/2003 Sloan et al.
2004/0131196 A1 7/2004 Malham
2004/0158461 A1 8/2004 Ramabadran et al.
2005/0053130 A1 3/2005 Jabri et al.
2005/0074135 A1 4/2005 Kushibe
2006/0045291 A1 3/2006 Smith
2006/0126852 A1 6/2006 Bruno et al.
2006/0282874 A1 12/2006 Ito et al.
2007/0009115 A1 1/2007 Reining et al.
2007/0094019 A1 4/2007 Nurminen
2007/0172071 A1 7/2007 Mehrotra et al.
2008/0004729 A1 1/2008 Hiipakka
2008/0137870 A1 6/2008 Nicol et al.
2008/0143719 A1 6/2008 Zhou et al.
2008/0205676 A1 8/2008 Merimaa et al.
2008/0306720 A1 12/2008 Nicol et al.
2009/0006103 A1 1/2009 Koishida et al.
2009/0092259 A1 4/2009 Jot et al.
2009/0248425 A1 10/2009 Vetterli et al.
2010/0085247 A1 4/2010 Venkatraman et al.
2010/0092014 A1 4/2010 Strauss et al.
2010/0198585 A1 8/2010 Mouhssine et al.
2010/0329466 A1 12/2010 Berge
2011/0164466 A1 7/2011 Hald et al.
2011/0224995 A1 9/2011 Kovesi et al.
2011/0249738 A1 10/2011 Suzuki et al.
2011/0249821 A1 10/2011 Jaillet et al.
2011/0249822 A1 10/2011 Jaillet et al.
2011/0261973 A1 10/2011 Nelson et al.
2011/0305344 A1 12/2011 Sole et al.
2012/0014527 A1 1/2012 Furse
2012/0093344 A1 4/2012 Sun et al.
2012/0128160 A1 5/2012 Kim et al.
2012/0155653 A1 6/2012 Jax et al.
2012/0163622 A1 6/2012 Karthik et al.
2012/0174737 A1 7/2012 Risan
2012/0177234 A1 7/2012 Rank et al.
2012/0221344 A1 * 8/2012 Yamanashi ..... G10L 19/24 704/500
2012/0243692 A1 9/2012 Ramamoorthy
2012/0257579 A1 10/2012 Li et al.
2012/0259442 A1 10/2012 Jin et al.
2012/0314878 A1 12/2012 Daniel et al.
2013/0028427 A1 1/2013 Yamamoto et al.
2013/0041658 A1 2/2013 Bradley et al.
2013/0064375 A1 3/2013 Atkins et al.
2013/0148812 A1 6/2013 Corteel et al.
2013/0216070 A1 8/2013 Keiler et al.
2013/0223658 A1 8/2013 Betlehem et al.
2013/0320804 A1 12/2013 Symko et al.
2014/0016784 A1 1/2014 Sen et al.
2014/0016786 A1 1/2014 Sen
2014/0016802 A1 1/2014 Sen et al.
2014/0023197 A1 1/2014 Xiang et al.
2014/0025386 A1 1/2014 Xiang et al.
2014/0029758 A1 1/2014 Nakadai et al.
2014/0133660 A1 5/2014 Jax et al.
2014/0219455 A1 8/2014 Peters et al.
2014/0226823 A1 8/2014 Sen et al.
2014/0233762 A1 8/2014 Vilkamo et al.
2014/0233917 A1 8/2014 Xiang
2014/0247946 A1 9/2014 Sen et al.
2014/0270245 A1 9/2014 Elko et al.
2014/0286493 A1 9/2014 Kordon et al.
2014/0307894 A1 10/2014 Kordon et al.
2014/0355766 A1 12/2014 Morrell et al.
2014/0355769 A1 12/2014 Peters et al.
2014/0355770 A1 12/2014 Peters et al.
2014/0355771 A1 12/2014 Peters et al.
2014/0358266 A1 12/2014 Peters et al.
2014/0358557 A1 12/2014 Sen et al.
2014/0358558 A1 12/2014 Sen et al.
2014/0358559 A1 12/2014 Sen et al.
2014/0358560 A1 12/2014 Sen et al.
2014/0358561 A1 12/2014 Sen et al.
2014/0358562 A1 12/2014 Sen et al.
2014/0358563 A1 12/2014 Sen et al.
2014/0358564 A1 12/2014 Sen et al.
2014/0358565 A1 12/2014 Peters et al.
2014/0358567 A1 12/2014 Koppens et al.
2015/0098572 A1 4/2015 Krueger et al.
2015/0127354 A1 5/2015 Peters et al.
2015/0154965 A1 6/2015 Wuebbolt et al.
2015/0154971 A1 6/2015 Boehm et al.
2015/0163615 A1 6/2015 Boehm et al.
2015/0213803 A1 7/2015 Peters et al.
2015/0213805 A1 * 7/2015 Peters ..... G10L 19/002 704/500
2015/0213809 A1 7/2015 Peters et al.
2015/0264483 A1 9/2015 Morrell et al.
2015/0264484 A1 9/2015 Peters et al.
2015/0287418 A1 * 10/2015 Vasilache ..... H03M 7/3082 704/230
2015/0332679 A1 11/2015 Kruger et al.
2015/0332690 A1 11/2015 Kim et al.
2015/0332691 A1 11/2015 Kim et al.
2015/0332692 A1 11/2015 Kim et al.
2015/0341736 A1 11/2015 Peters et al.
2015/0358631 A1 12/2015 Zhang et al.
2015/0371633 A1 12/2015 Chelba
2015/0380002 A1 12/2015 Uhle et al.
2016/0093308 A1 3/2016 Kim

(56) References Cited

U.S. PATENT DOCUMENTS

| | | | |
|---|---|---|---|
| 2016/0155448 | A1 | 6/2016 | Purnhagen et al. |
| 2016/0174008 | A1 | 6/2016 | Boehm |
| 2017/0032798 | A1 | 2/2017 | Peters |

FOREIGN PATENT DOCUMENTS

| | | | |
|---|---|---|---|
| EP | 2234104 | A1 | 9/2010 |
| EP | 2450880 | A1 | 5/2012 |
| EP | 2469741 | A1 | 6/2012 |
| EP | 2665208 | A1 | 11/2013 |
| EP | 2765791 | A1 | 8/2014 |
| EP | 2954700 | A1 | 12/2015 |
| TW | 201514455 | A | 4/2015 |
| WO | WO-2009046223 | A2 | 4/2009 |
| WO | 2009144953 | A1 | 12/2009 |
| WO | WO-2012059385 | A1 | 5/2012 |
| WO | WO-2014013070 | A1 | 1/2014 |
| WO | WO-2014122287 | A1 | 8/2014 |
| WO | WO-2014177455 | A1 | 11/2014 |
| WO | WO-2014194099 | A1 | 12/2014 |
| WO | WO-2015007889 | A1 | 1/2015 |

OTHER PUBLICATIONS

Geiser, et al., "Steganographic Packet Loss Concealment for Wireless VoIP," ITG Conference on Voice Communication (SprachKommunikation), Oct. 8, 2008, 4 pp.

Qinghua et al., "Interpolation of Head-Related Transfer Functions Using Spherical Fourier Expansion," Journal of Electronics (China), Jul. 2009, vol. 26, Issue 4, pp. 571-576.

"Information technology—High Efficiency Coding and Media Delivery in Heterogeneous Environments—Part 3: 3D Audio," ISO/IEC JTC 1/SC 29 N ISO/IEC CD 23008-3, Apr. 4, 2014, XP055206371, 337 pp.

Johnston et al, "AT&T Perceptual Audio Coding (PAC)," In Collected Papers on Digital Audio Bit-Rate Reduction pp. 73-82, Feb. 13, 1996.

Lincoln: "An Experimental High Fidelity Perceptual Audio Coder," In Project in MUS420 Win97, Mar. 1998, 19 pp.

Second Written Opinion from International Application No. PCT/US2015/051217, dated Jul. 8, 2016, 6 pp.

Response to Second Written Opinion dated Jul. 8, 2016, from International Application No. PCT/US2015/051217, filed on Sep. 6, 2016, 5 pp.

"Information technology—High efficiency coding and media delivery in heterogeneous environments—Part 3: 3D Audio," ISO/IEC JTC 1/SC 29 N ISO/IEC DIS 23008-3 , Jul. 25, 2014, 433 pp.

U.S. Appl. No. 15/247,244, filed by Nils Günther Peters, on Aug. 25, 2016.

U.S. Appl. No. 15/247,364, filed by Nils Günther Peters, on Aug. 25, 2016.

U.S. Appl. No. 15/290,181, filed by Nils Günther Peters, on Oct. 11, 2016.

U.S. Appl. No. 15/290,206, filed by Nils Gunther Peters, on Oct. 11, 2016.

U.S. Appl. No. 15/290,214, filed by Nils Günther Peters, on Oct. 11, 2016.

Audio, "Call for Proposals for 3D Audio," International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, 20 pp.

Audio-Subgroup: "WD1-HOA Text of MPEG-H 3D Audio," MPEG Meeting; Jan. 13-17, 2014; San Jose; (Motion Picture Expert Group or ISO/IEC JTC1/SC29/WG11), No. N14264, Feb. 21, 2014; pp. 1-82, XP030021001; 84 pp.

Boehm, et al., "Scalable Decoding Mode for MPEG-H 3D Audio HOA," MPEG Meeting; Mar. 31-Apr. 4, 2014; Valencia; (Motion Picture Expert Group or ISO/IEC JTC1/SC29/WG11),, No. m33195, Mar. 26, 2014; 12 pp.

Boehm, et al., "Detailed Technical Description of 3D Audio Phase 2 Reference Model 0 for HOA Technologies", MPEG Meeting; Oct. 24-28, 2014; Strasbourg; (Motion Picture Expert Group or ISO/IEC JTC1/SC29/WG11), No. m35857, Oct. 19, 2014; XP030063429, 130 pp.

Boehm, et al., "HOA Decoder—changes and proposed modification," Technicolor, MPEG Meeting; Mar. 31-Apr. 4, 2014; Valencia; (Motion Picture Expert Group or ISO/IEC JTC1/SC29/WG11), No. m33196, Mar. 26, 2014; XP030061648, 16 pp.

Conlin, "Interpolation of Data Points on a Sphere: Spherical Harmonics as Basis Functions," Feb. 28, 2012, 6 pp.

Daniel, et al., "Multichannel Audio Coding Based on Minimum Audible Angles", Proceedidngs of 40th International Conference: Spatial Audio: Sense the Sound of Space, Jan. 2010, XP055009518, 10 pp.

Daniel, "Spatial Auditory Blurring and Applications to Multichannel Audio Coding", Jun. 23, 2011; XP055104301, Retrieved from the Internet: URL:http://tel.archives-ouvertes.fr/tel-00623670/en/ Chapter 5. "Multichannel audio coding based on spatial blurring", 167 pp.

Daniel, et al., "Ambisonics Encoding of Other Audio Formats for Multiple Listening Conditons," Audio Engineering Society Convention 105, Sep. 1998, San Francisco, CA, Paper No. 4795, 29 pp.

DVB Organization: "ISO-IEC_23008-3_(E)_(DIS of 3DA).docx", DVB, Digital Video Broadcasting, C/0 EBU-17A Ancienne Route-CH-1218 Grand Saconnex, Geneva-Switzerland, Jul. 25, 2014, XP017845569, 431 pp.

Hellerud, et al., "Lossless Compression of Spherical Microphone Array Recordings," AES Convention 126, May 2009, AES, 60 East 42nd Street, Room 2520 New York 10165-2520, USA, XP040508950, 9 pp.

Gauthier, et al., "Beamforming Regularization Scaling Matrices and Inverse Problems for Sound Field Extrapolation and Characterization: Part I Theory," Oct. 20-23,2011, in Audio Engineering Society 131st Convention, New York, USA, 2011, 32 pp.

Gauthier, et al., "Derivation of Ambisonics Signals and Plane Wave Description of Measured Sound Field Using Irregular Microphone Arrays and Inverse Problem Theory," 2011, In Ambisonics Symposium 2011, Lexington, Jun. 2011, 17 pp.

Gerzon, "Ambisonics in Multichannel Broadcasting and Video", Journal of the Audio Engineering Society, Nov. 1985, vol. 33(11), pp. 859-871.

Hagai, et al., "Acoustic centering of sources measured by surrounding spherical microphone arrays", received Feb. 16, 2011, In The Journal of the Acoustical Society of America, vol. 130, No. 4, pp. 2003-2015.

Hellerud, et al., "Encoding higher order ambisonics with AAC," Audio Engineering Society—124th Audio Engineering Society Convention 2008, XP040508582, May 2008, 8 pp.

Hellerud, et al., "Spatial redundancy in Higher Order Ambisonics and its use for low delay lossless compression", Acoustics, Speech and Signal Processing, ICASSP 2009, IEEE International Conference on, IEEE, Piscataway, NJ, USA, Apr. 19, 2009, pp. 269-272, XP031459218, ISBN: 978-1-4244-2353-8; 4 pp.

Herre, et al., "MPEG-H 3D Audio—The New Standard for Coding of Immersive Spatial Audio," IEEE Journal of Selected Topics in Signal Processing, vol. 9, No. 5, Aug. 2015, 10 pp.

"Information technology—High efficiency coding and media delivery in heterogeneous environments—Part 3: 3D Audio," ISO/IEC JTC 1/SC 29N, Apr. 4, 2014, 337 pp.

"Information technology—High efficiency coding and media delivery in heterogeneous environments—Part 3: 3D Audio," ISO/IEC JTC 1/SC 29N, Jul. 25, 2005, 311 pp.

"Information technology—High efficiency coding and media delivery in heterogeneous environments—Part 3: Part3: 3D Audio, Amendement 3: MPEG-H 3D Audio Phase 2," ISO/IEC JTC 1/SC 29N, Jul. 25, 2015, 208 pp.

Information technology—MPEG audio technologies—Part 3: Unified speech and audio coding, ISO/IEC JTC 1/SC 26/ WG 11, Sep. 20, 2011, 291 pp.

International Search Report and Written Opinion from International Application No. PCT/US2015/051217, dated Nov. 27, 2015, 14 pp.

(56) References Cited

OTHER PUBLICATIONS

Malham, "Higher order ambisonic systems for the specialization of sound", in Proceedings of the International Computer Music Conference, 1999, Beijing, China, pp. 484-487. (Applicant points out, in accordance with MPEP 609.04(a), that the year of publication, 1999, is sufficiently earlier than the effective U.S. filing date, Mar. 31, 2016 so that the particular month of publication is not in issue.).
Masgrau, et al., "Predictive SVD-Transform Coding of Speech with Adaptive Vector Quantization," Apr. 1991, IEEE, pp. 3681-3684.
Mathews, et al., "Multiplication-Free Vector Quantization Using L1 Distortion Measure and IRS Variants", Multidimensional Signal Processing, Audio and Electroacoustics, Glasgow, May 23-26, 1989, [International Conference on Acoustics, Speech & Signal Processing, ICASSP], New York, IEEE, US, May 23, 1989; vol. 3, pp. 1747-1750.
Menzies, "Nearfield synthesis of complex sources with high-order ambisonics, and binaural rendering," Proceedings of the 13th International Conference on Auditory Display, Montr'eal, Canada, Jun. 26-29, 2007, 8 pp.
Moreau, et al., "3D Sound Field Recording with Higher Order Ambisonics—Objective Measurements and Validation of Spherical Microphone", May 20-23, 2006, Audio Engineering Society Convention Paper 6857, 24 pp.
Nelson et al., "Spherical Harmonics, Singular-Value Decomposition and the Head-Related Transfer Function," accepted Aug. 29, 2000, ISVR University of Southampton, pp. 607-637.
Painter, et al., "Perceptual Coding of Digital Audio," Proceedings of the IEEE, vol. 88, No. 4, Apr. 2000, pp. 451-513.
Poletti M., "Three-Dimensional Surround Sound Systems Based on Spherical Harmonics," The Journal of the Audio Engineering Society, Nov. 2005, pp. 1004-1025, vol. 53 (11).
Poletti, "Unified Description of Ambisonics Using Real and Complex Spherical Harmonics," Ambisonics Symposium Jun. 25-27, 2009, 10 pp.
Pulkki, "Spatial Sound Reproduction with Directional Audio Coding," Journal of the Audio Engineering Society, Jun. 2007, vol. 55 (6), pp. 503-516.
Rafaely, "Spatial alignment of acoustic sources based on spherical harmonics radiation analysis," 2010, in Communications, Control and Signal Processing (ISCCSP), 2010 4th International Symposium, Mar. 3-5, 2010; 5 pp.
Robert, et al., "A Simple and Efficient Method for Real-Time Computation and Transformation of Spherical Harmonic-Based Sound Fields", AES Convention 133, AES, 60 East 42nd Street, Room 2520, New York 10165-2520, USA, Oct. 25, 2012; pp. 1-10, XP040574807.
Rockway, et al., "Interpolating Spherical Harmonics for Computing Antenna Patterns," Systems Center Pacific, Technical Report, 1999, Jul. 2011, 40 pp.
Ruffini, et al., "Spherical Harmonics Interpolation, Computation of Laplacians and Gauge Theory," Starlab Research Knowledge, Oct. 25, 2001, 16 pp.
Nishimura., "Audio Information Hiding Based on Spatial Masking", Intelligent Information Hiding ND Multimedia Signal Processing (IIH-MSP), 2010 Sixth International Conference On, IEEE, Piscataway, NJ, USA, Oct. 15, 2010, XP031801765, 4 pp.
Sayood, et al., "Application to Image Compression—JPEG," Introduction to Data Compression, Third Edition, Dec. 15, 2005, Chapter 13.6. pp. 410-416.
Sen, et al., "Differences and Similarities in Formats for Scene Based Audito," ISO/IEC JTC1/SC29/WG11 MPEG2012/M26704, Oct. 2012, Shanghai, China, 7 pp.
Sen, et al., "RM1-HOA Working Draft Text ", MPEG Meeting; Jan. 13-17, 2014; San Jose; (Motion Picture Expert Group or ISO/IEC JTC1/SC29/WG11), No. m31827, Jan. 11, 2014, XP030060280, 83 pp.
Sovang, et al., "Quantization of Higher Order Ambisoncs Wave Fields," In the 124th AES Conv, May 17-20, 2008, 9 pp.
Stohl, et al., "An Intercomparison of Results from Three Trajectory Modesl," Meterorological Applications, Jun. 2001, pp. 127-135.
Wabnitz, et al., "A frequency-domain algorithm to upscale ambisonic sound scenes", 2012 IEEE International Conference on Acoustics, Speech and Signal Processing (ICASSP 2012) : Kyoto, Japan, Mar. 25-30, 2012; [Proceedings], IEEE, Piscataway, NJ, Mar. 25, 2012; pp. 385-388, XP032227141.
Wabnitz, et al., "Time domain reconstruction of spatial sound fields using compressed sensing", Acoustics, Speech and Signal Processing (ICASSP), 2011 IEEE International Conference on, IEEE, May 22, 2011, pp. 465-468.
Wabnitz, et al., "Upscaling Ambisonic sound scenes using compressed sensing techniques", IEEE Workshop on Applications of Signal Processing to Audio and Acoustics (WASPAA), Oct. 16, 2011; XP032011510, 4 pp.
Zotter, et al., "Comparison of energy-preserving and all-round Ambisonic decoders," 2013, 4 pp. (Applicant points out, in accordance with MPEP 609.04(a), that the year of publication, 2013, is sufficiently earlier than the effective U.S. filing date, Mar. 31, 2016 so that the particular month of publication is not in issue.).
Response to Written Opinion dated Nov. 27, 2015 from International Application No. PCT/US2015/051217, filed on Jun. 7, 2016, 6 pp.
Noisternig, et al., "A 3D Real Time Rendering Engine for Binaural Sound Reproduction", Proceedings of the 2003 International Conference on Auditory Display, Boston, MA, USA, Jul. 6-9, 2003, pp. 107-110.
Zotter, et al., "Energy-Preserving Ambisonic Decoding," Acta Acustica United With Acustica, European Acoustics Association, Stuttgart : Hirzel, vol. 98, No. 1, Jan. 2012, pp. 37-47.
International Preliminary Report on Patentability from International Application No. PCT/US2015/051217, dated Oct. 18, 2016, 7 pp.

* cited by examiner

| bits | SNR (dB) | bits | SNR (dB) |
|---|---|---|---|
| 1 | 17.75 | 6 | 22.71 |
| 2 | 18.92 | 7 | 23.63 |
| 3 | 19.86 | 8 | 24.60 |
| 4 | 20.87 | 9 | 25.62 |
| 5 | 21.78 | 10 | 26.80 |

FIG. 18

| bits | SNR (dB) | bits | SNR (dB) |
|---|---|---|---|
| 1 | 17.80 | 6 | 22.77 |
| 2 | 18.97 | 7 | 23.68 |
| 3 | 19.90 | 8 | 24.64 |
| 4 | 20.92 | 9 | 25.69 |
| 5 | 21.82 | 10 | 26.87 |

FIG. 19

| bits | SNR (dB) | bits | SNR (dB) |
|---|---|---|---|
| 1 | 20.26 | 6 | 25.97 |
| 2 | 21.58 | 7 | 27.03 |
| 3 | 22.72 | 8 | 28.08 |
| 4 | 23.84 | 9 | 29.22 |
| 5 | 24.90 | 10 | 30.47 |

FIG. 20A

| bits | SNR (dB) | bits | SNR (dB) |
|---|---|---|---|
| 1 | NA | 6 | 24.90 |
| 2 | 20.26 | 7 | 25.97 |
| 3 | 21.58 | 8 | 27.03 |
| 4 | 22.72 | 9 | 28.08 |
| 5 | 23.84 | 10 | 29.22 |
| | | 11 | 30.47 |

FIG. 20B

SWITCHING BETWEEN PREDICTIVE AND NON-PREDICTIVE QUANTIZATION TECHNIQUES IN A HIGHER ORDER AMBISONICS (HOA) FRAMEWORK

This application is claims the benefit of priority to U.S. Provisional Application No. 62/056,248, filed Sep. 26, 2014, entitled "SWITCHED V-VECTOR QUANTIZATION OF A HIGHER ORDER AMBISONICS (HOA) AUDIO SIGNAL," and U.S. Provisional Application No. 62/056,286, filed Sep. 26, 2014, entitled "PREDICTIVE VECTOR QUANTIZATION OF A DECOMPOSED HIGHER ORDER AMBISONICS (HOA) AUDIO SIGNAL," which are hereby incorporated by reference in their entirety.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for efficiently quantizing vectors used in with higher order ambisonic (HOA) coefficients framework. The techniques may involve, in some examples, predictively coding weight values (which may also be referred to as "weights" without the term "value" following) included in a code vector-based decomposition of a vector. The techniques may involve, in further examples, selecting one of a predictive vector quantization mode and a non-predictive vector quantization mode for coding a vector based on one or more criteria (e.g., a signal-to-noise ratio associated with coding the vector according to the respective mode).

In another aspect, a device configured to decode a bitstream comprises one or more processors configured to extract, from the bitstream, a type of quantization mode; and switch, based on the type of quantization mode, between non-predictive vector dequantization to reconstruct a first set of one or more weights used to approximate a multi-directional V-vector in the higher order ambisonics domain, and predictive vector dequantization to reconstruct a second set of one or more weights used to approximate the multi-directional V-vector in the higher order ambisonics domain. The memory may be configured to store the reconstructed first set of one or more weights used to approximate the multi-directional V-vector in the higher order ambisonics domain, and the reconstructed second set of one or more weights used to approximate the multi-directional V-vector in the higher order ambisonics domain.

In another aspect, a method of decoding a bitstream comprises extracting, from the bitstream, a type of quantization mode, and switching, based on the type of quantization mode, between non-predictive vector dequantization to reconstruct a first set of one or more weights used to approximate a multi-directional V-vector in the higher order ambisonics domain, and predictive vector dequantization to reconstruct a second set of one or more weights used to approximate the multi-directional V-vector in the higher order ambisonics domain, and retrieving from a buffer unit a previously reconstructed set of one more weights used to approximate the multi-directional V-vector in the higher order ambisonics domain, wherein the previously reconstructed set of one or more weights are based on either a non-predictive vector dequantization or a predictive vector dequantization.

In another aspect, an apparatus configured to decode a bitstream comprises, means for extracting, from the bitstream, a type of quantization mode, and means for switching, based on the type of quantization mode, between non-predictive vector dequantization to reconstruct a first set of one or more weights used to approximate the multi-directional V-vector in the higher order ambisonics domain, and predictive vector dequantization to reconstruct a second set of one or more weights used to approximate the multi-directional V-vector in the higher order ambisonics domain, and means for storing the reconstructed first set of one or more weights used to approximate the multi-directional V-vector in the higher order ambisonics domain, and the reconstructed second set of one or more weights used to approximate the multi-directional V-vector in the higher order ambisonics domain.

In another aspect, a device configured to produce a bitstream comprises a memory configured to store a first set of one or more weights used to approximate the multi-directional V-vector in the higher order ambisonics domain, and a second set of one or more weights used to approximate the multi-directional V-vector in the higher order ambisonics domain, one or more processors, electrically coupled to the memory, configured to switch between non-predictive vector quantization of the first set of one or more weights used to approximate the multi-directional V-vector in the higher order ambisonics domain, and predictive vector quantization of the second set of one or more weights used to approximate the multi-directional V-vector in the higher order ambisonics domain, and specify, in the bitstream including a representation of the multi directional V-vector in the higher order ambisonics domain, a type of quantization mode indicative of the switch.

In another aspect, a method of producing a bitstream comprises switching between non-predictive vector quantization of a first set of one or more weights used to approximate the multi-directional V-vector in the higher order ambisonics domain, and predictive vector quantization of a second set of one or more weights used to approximate the multi-directional V-vector in the higher order ambisonics domain, retrieving from a buffer unit, during predictive vector quantization of the second set of one or more weights used to approximate the multi-directional V-vector in the higher order ambisonics domain, a previously reconstructed set of one more weights used to approximate the multi-directional V-vector in the higher order ambisonics domain, wherein the previously reconstructed set of one or more weights are based on either a non-predictive vector dequantization or a predictive vector dequantization, and specifying, in the bitstream a type of quantization mode indicative of the switching.

In another aspect, an apparatus configured to produce a bitstream comprises, means for switching between non-predictive vector quantization of a first set of one or more weights used to approximate the multi-directional V-vector in the higher order ambisonics domain, and predictive vector quantization of a second set of one or more weights used to approximate the multi-directional V-vector in the higher order ambisonics domain, means for retrieving from a memory during predictive vector quantization of the second set of one or more weights used to approximate the multi-directional V-vector in the higher order ambisonics domain, a previously reconstructed set of one more weights used to approximate the multi-directional V-vector in the higher order ambisonics domain, wherein the previously reconstructed set of one or more weights are based on either a non-predictive vector dequantization in a local decoder of an encoder or a predictive vector dequantization in the local decoder of the encoder, and means for specifying, in the bitstream a type of quantization mode indicative of the switching.

The details of one or more aspects of the techniques are set forth in the accompanying drawings and the description below. Other features, objects, and advantages of the techniques will be apparent from the description and drawings, and from the claims.

BRIEF DESCRIPTION OF DRAWINGS

FIGS. 18 and 19 are tables illustrating comparison example performance characteristics of predictive vector quantization techniques in "PVQ only mode" of this disclosure with different methods to obtain the alpha factors.

FIGS. 20A and 20B are tables illustrating comparison example performance characteristics of "PVQ only mode" and "VQ only mode" in accordance with this disclosure.

DETAILED DESCRIPTION

Figure 1:
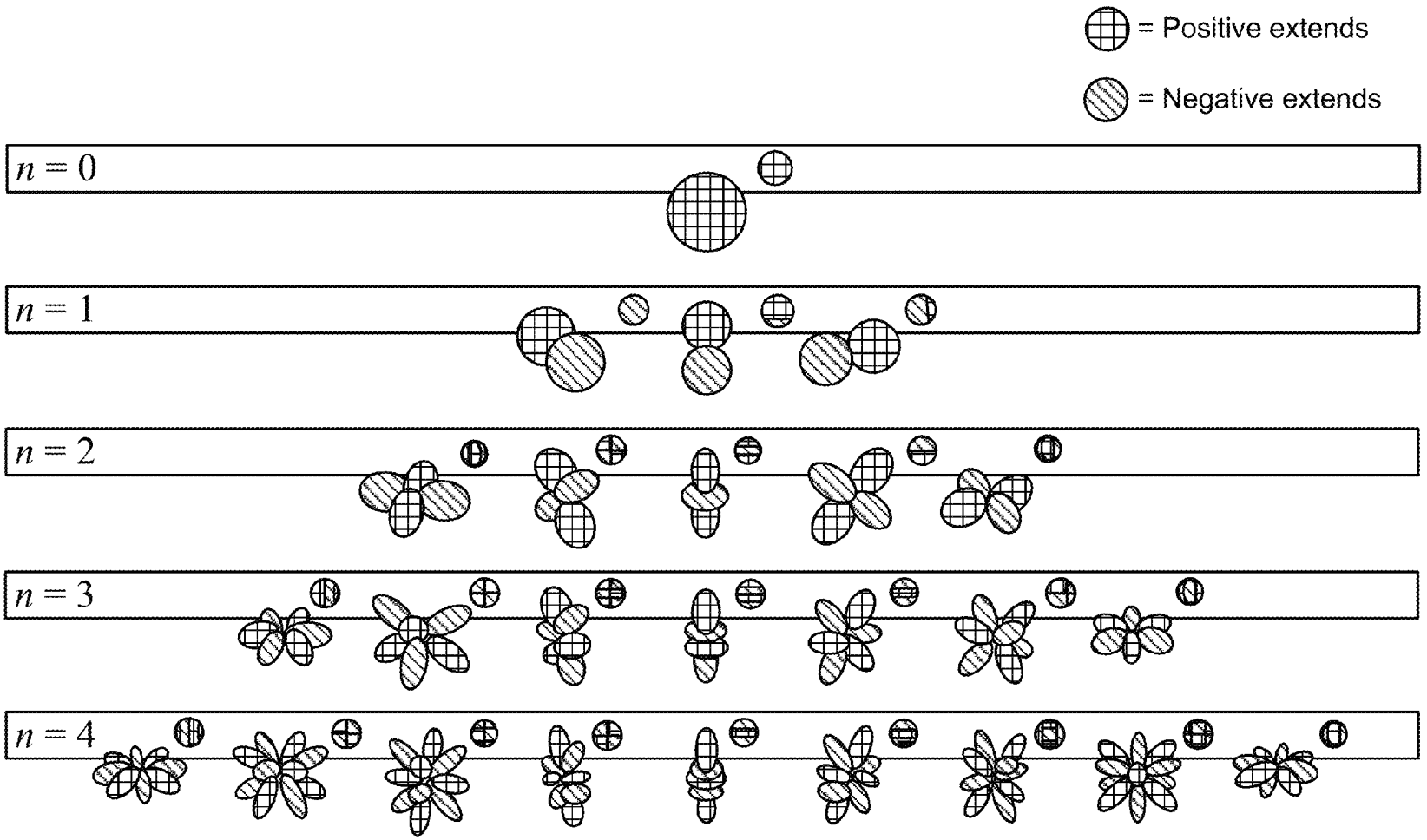
FIG. 1 is a diagram illustrating spherical harmonic basis functions of various orders and sub-orders.

As used herein, "A and/or B" means "A or B", or both "A and B". The term "or" as used in this disclosure is to be understood to refer a logically inclusive or not a logically exclusive or, where for example the logical phrase (if A or B) is satisfied when A is present, when B is present or where both A and B are present (contrary to the logically exclusive or where when A and B are present the if statement is not satisfied).

In general, techniques are described for efficiently quantizing vectors included in a vector-based decomposition based framework version of a plurality of higher order ambisonic (HOA) coefficients. The techniques may involve, in some examples, predictively coding weight values (which may also be referred to as "weights" without the term "value" following) included in a code vector-based decomposition of a vector. The techniques may involve, in further examples, selecting one of a predictive vector quantization mode and a non-predictive vector quantization mode for coding a vector based on one or more criteria (e.g., a signal-to-noise ratio associated with coding the vector according to the respective mode). Vector quantization (VQ) of a vector that does not depend on past quantized vectors stored in memory of an encoder or decoder from a previous time segment (e.g. a frame), may be described as memoryless. However, when past quantized vectors stored in memory of an encoder or decoder from a previous time segment (e.g a frame), the current quantized vector in the current time segment (e.g. a frame) may be predicted, and may be referred to as predictive vector quantization (PVQ) and described as memory-based. In this disclosure, various VQ and PVQ configurations are described in more detail with respect to a higher order ambisonic (HoA) vector-based decomposition framework. A PVQ configuration may be referred to as a PVQ only mode when performing predictive vector quantization based on only using past segment (frame or sub-frame) predicted vector quantized weight without the ability to access any of the past vector quantized weight vectors from a non-predictive vector quantization unit (e.g. as in FIG. 4 the NPVQ unit 520). A "VQ only mode" may denote performing vector quantization without previous vector quantized weight vectors from (from a past frame or past sub-frames) generated by a either a non-predictive vector quantization unit (e.g. see FIG. 4 NPVQ unit 520) or predictive vector quantization unit (e.g. see FIG. 4 PVQ unit 540).

In addition, switching between VQ and PVQ configurations within the HoA vector based framework are also described. Such switching may be referred to as SPVQ or switched-predictive vector quantization. Moreover, there may be switching between scalar Quantization and either a VQ only mode, a PVQ only mode, or SPVQ enabled mode within the HoA vector based decomposition framework.

Prior to recent developments in representing soundfields using HOA-based signals, the evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed "surround arrays." One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "higher-order ambisonics" or HOA, and "HOA coefficients"). The MPEG encoder may be described in more detail in a document entitled the MPEG-H 3D Audio Standard, entitled "Information Technology—High efficiency coding and media delivery in heterogeneous environments—Part 3: 3D Audio," ISO/IEC JTC1/SC 29, dated 2014 Jul. 25 (Jul. 25, 2014), ISO/IEC 23008-3, ISO/IEC JTC 1/SC 29/WG 11 (filename: ISO_IEC 23008-3_(E)_(DIS of 3DA).doc).

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for content (e.g., a movie) once, and not spend effort to remix the soundtrack for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r,\theta_r,\phi_r\}$ of the soundfield, at time t, can be represented uniquely by the SHC, $A_n^m(k)$. Here, $$k = \frac{\omega}{c},$$

is the speed of sound (~343 m/s), $\{r_r,\theta_r,\phi_r\}$ is a point of reference (or observation point), $j_n(\bullet)$ is the spherical Bessel function of order n, and $Y_n^m(\theta_r,\phi_r)$ are the spherical harmonic basis functions of order n and suborder m. It can be recognized that the term in square brackets is a frequency-domain representation of the signal (i.e., $S(\omega,r_r,\theta_r,\phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025. The SHC may also be referred to as higher-order ambisonic (HOA) coefficients.

To illustrate how the SHCs may be derived from an object-based description, consider the following equation (1). The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\phi_s),$$

where i is $\sqrt{-1}$, $h_2^{(2)}(\bullet)$ is the spherical Hankel function (of the second kind) of order n, and $\{r_s,\theta_s,\phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). In one example, the coefficients contain information about the soundfield (the pressure as a function of 3D coordinates), and the above represents the transformation from individual objects to a representation of the overall soundfield, in the vicinity of the observation point $\{r_r,\theta_r,\phi_r\}$. The remaining figures are described below in the context of object-based and SHC-based audio coding.

Figure 2:
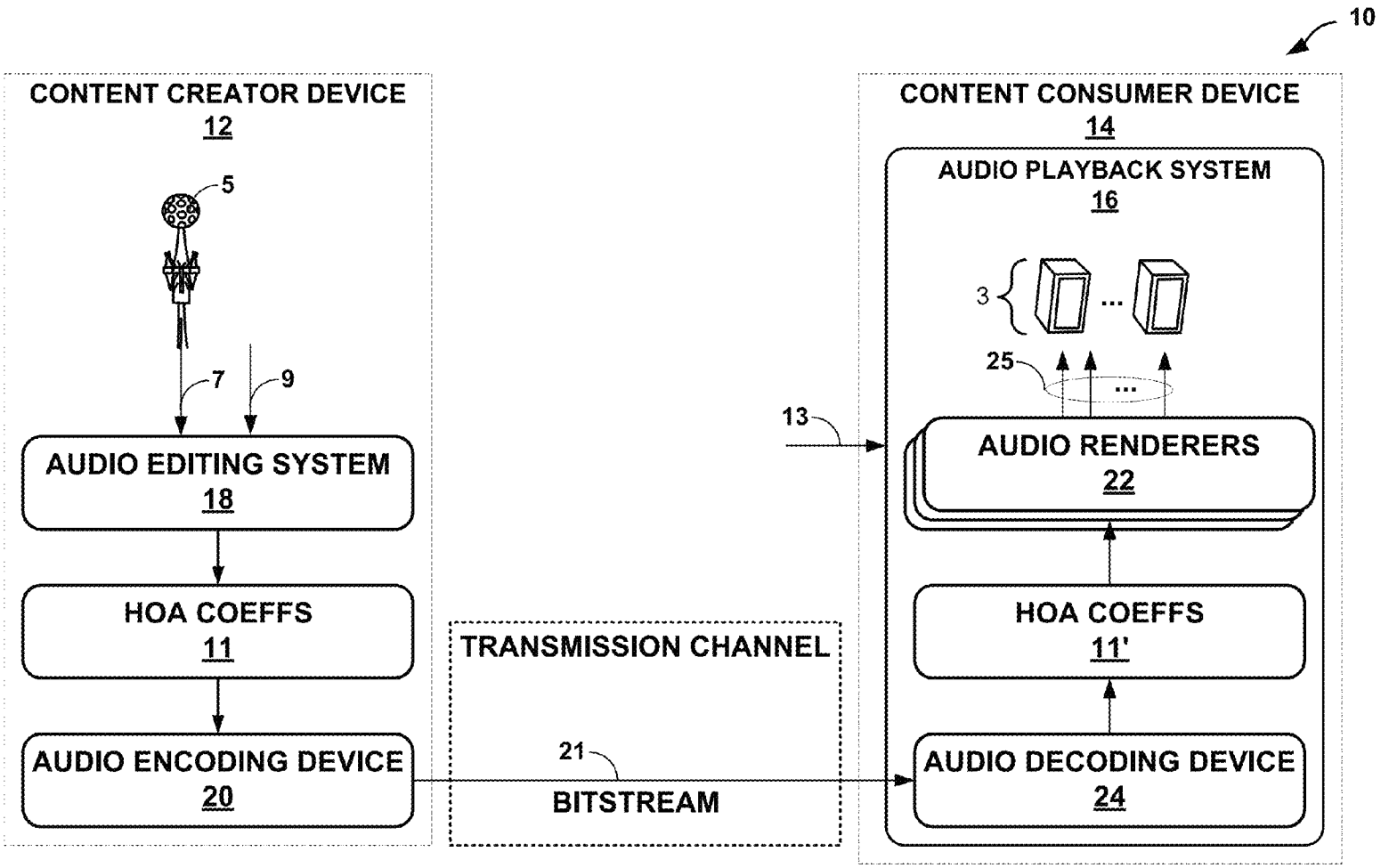
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may likewise be operated by an individual. The content consumer device 14 may include an audio playback system 16, which may refer to any form of audio playback system capable of rendering HOA coefficients 11 for play back as multi-channel audio content.

As shown in FIG. 2, the content creator device 12 includes an audio editing system 18. The content creator device 12 may obtain live recordings 7 in various formats (including directly as HOA coefficients) and audio objects 9, which the content creator device 12 may edit using audio editing system 18. A three-dimensional curved microphone array 5 may capture the live recordings 7. The three-dimensional curved microphone array 5 may be a sphere, with a uniform distribution of microphones placed on the sphere. The content creator device 12 may, during the editing process, generate HOA coefficients 11 from the audio objects 9 and the live recordings 7 and mix the HOA coefficients 11 from the audio objects 9 and the live recordings 7. The audio editing system 18 may then render speaker feeds from the mixed HOA coefficients 11, listening to the rendered speaker feeds in an attempt to identify various aspects of the soundfield that require further editing.

The content creator device 12 may then edit HOA coefficients 11 (potentially indirectly through manipulation of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients. In some contexts, content creator device 12 may utilize only live content and in other contexts content creator device 12 may utility recorded content.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired channel or a wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In may be possible that the content creator device 12 and consumer device 14 are on device, such that the content may be recorded at one point in time, and played back at a later point in time. In any event, the techniques of this disclosure should not be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different audio renderers 22. The renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers 3.

To select the appropriate renderer or, in some instances, generate an appropriate renderer, the audio playback system 16 may obtain loudspeaker information 13 indicative of a number of loudspeakers 3 and/or a spatial geometry of the loudspeakers 3. In some instances, the audio playback system 16 may obtain the loudspeaker information 13 using a reference microphone and driving the loudspeakers 3 in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate one of the audio renderers 22 based on the loudspeaker information 13. The audio playback system 16 may, in some instances, generate one of the audio renderers 22 based on the loudspeaker information 13 without first attempting to select an existing one of the audio renderers 22. One or more of the loudspeakers 3 (which may also be referred to as "speakers 3") may then playback the rendered loudspeaker feeds 25. The loudspeaker 3 may be configured to output the speaker feed based on, as described in more detail below, a representation of a V-vector in a higher order ambisonic domain.

Figure 3:
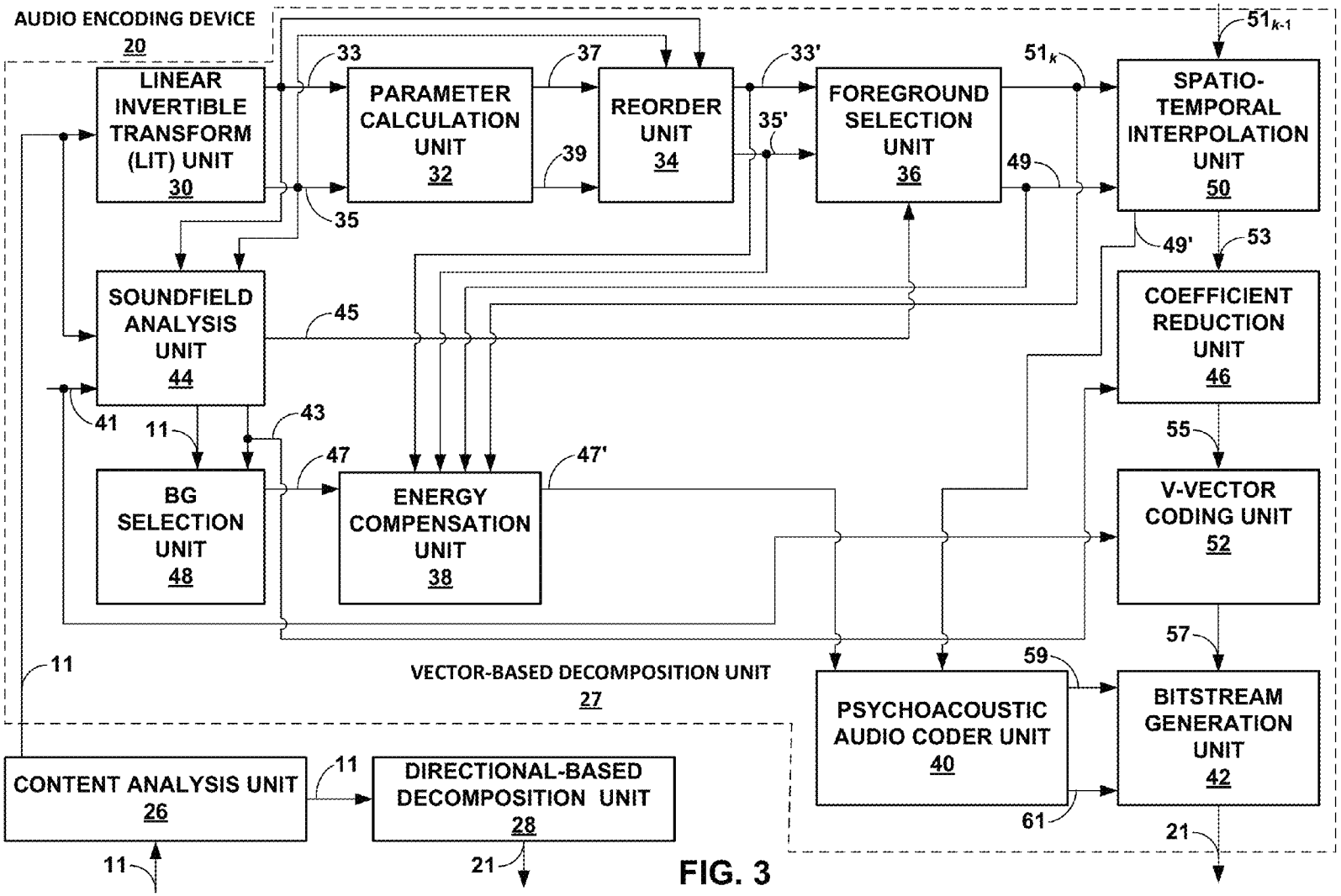
FIG. 3 is a block diagram illustrating, in more detail, the audio encoding device shown in the example of FIG. 2 that may perform various aspects of the techniques described in this disclosure in a Higher order Ambisonic (HoA) vector-based decomposition framework.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28.

The content analysis unit 26 represents a unit configured to analyze the content of the HOA coefficients 11 to identify whether the HOA coefficients 11 represent content generated from the live recording 7 or the audio object 9. The content analysis unit 26 may determine whether the HOA coefficients 11 were generated from the live recording 7 of an actual soundfield or from the artificial audio object 9. In some instances, when the HOA coefficients 11 were generated from the live recording 7, the content analysis unit 26 passes the HOA coefficients 11 to the vector-based decomposition unit 27. In some instances, when the HOA coefficients 11 were generated from the synthetic audio object 9, the content analysis unit 26 passes the HOA coefficients 11 to the directional-based decomposition unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a V-vector coding unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. The decomposition may reduce the HOA coefficients 11 into principal or fundamental components that are different from the HOA coefficients and may not represent a selection of a subset of the HOA coefficients 11. Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object.

Both the vectors in the U matrix and the V matrix may be normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD to decouple the audio time-signals (in U), their energies (in S) and their spatial characteristics (in V) may support various aspects of the techniques described in this disclosure. Further, the model of synthesizing the underlying HOA[k] coefficients, X, to reconstruct the HOA[k] coefficients at the decoder by a vector multiplication of US[k] and V[k] may result in the term "vector-based decomposition" as performed by the encoder to determine US[k] and V[k], which is used throughout this document.

Although described as being performed directly with respect to the HOA coefficients 11, the LIT unit 30 may apply the decomposition to derivatives of the HOA coefficients 11. For example, the LIT unit 30 may apply the SVD with respect to a power spectral density matrix derived from the HOA coefficients 11. By performing the SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, ω, r), and an energy property (e). Each of the parameters for the current frame may be denoted as R[k], θ[k], ϕ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], ϕ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound selection unit 36 ("foreground selection unit 36") and an energy compensation unit 38. The foreground selection unit 36 may also be referred to as a predominant sound selection unit 36.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels.

The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield ($nBGa=(MinAmbHOAorder+1)^2$), and indices (i) of additional BG HOA channels to send (which may collectively be denoted as background channel information 43 in the example of FIG. 3). The background channel information 43 may also be referred to as ambient channel information 43. Each of the channels that remains from numHOATransportChannels—nBGa, may either be an "additional background/ambient channel", an "active vector-based predominant channel", an "active directional-based predominant signal" or "completely inactive". The soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 4A and 4B, to extract the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+nBGa]$. The ambient HOA coefficients 47 may also be referred to as "ambient HOA channels 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times nFG$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 40 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the V-vector coding unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(NBG+1)^2+1, (N+1)^2]$.

The V-vector coding unit 52 may represent a unit configured to perform quantization or other form of coding to compress the reduced foreground V[k] vectors 55 to generate coded foreground V[k] vectors 57. The V-vector coding unit 52 may output the coded foreground V[k] vectors 57 to the bitstream generation unit 42. In operation, the V-vector coding unit 52 may represent a unit configured to compress or otherwise code a spatial component of the soundfield, i.e., one or more of the reduced foreground V[k] vectors 55 in this example. The V-vector coding unit 52 may perform any one of the following 13 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The V-vector coding unit 52 may perform multiple forms of quantization with respect to each of the reduced foreground V[k] vectors 55 to obtain multiple coded versions of the reduced foreground V[k] vectors 55. The V-vector coding unit 52 may select one of the coded versions of the reduced foreground V[k] vectors 55 as the coded foreground V[k] vector 57.

By looking at the syntax elements denoted NbitsQ above that are associated with the type of quantization mode, it should be noted that the V-vector coding unit 52 may, in other words, select one of the non-predicted vector-quantized V-vector (e.g. NbitsQ value of 4), predicted vector-quantized V-vector (NbitsQ value not shown explicitly, but see next paragraph), the non-Huffman-coded scalar-quantized V-vector (eg. NbitsQ value of 5), and the Huffman-coded scalar-quantized V-vector (e.g. NbitQ value of 6, 7, 8 and 16 shown) to use as the output for the switched quantized V-vector based on any combination of the criteria discussed in this disclosure.

A modified version of the quantization mode table above that has the 13 quantization modes could be paired with an additional syntax element (e.g., an pvq/vq selection syntax element) that may identify whether, for the general vector quantization mode (e.g. NbitsQ equals four), the vector quantization is a predictive vector quantization mode or a non-predictive vector quantization mode. For example, a pvq/vq selection syntax element equaled 1, means that in conjunction with NbitsQ equal to four, there could be a predictive vector quantization mode, otherwise, if the pvq/vq selection bit syntax element equaled one and NbitsQ equaled four, the vector quantization mode would be non-predictive.

In some examples, the V-vector coding unit 52 may select a quantization mode from a set of quantization modes that includes a vector quantization mode and one or more scalar quantization modes, and quantize an input V-vector based on (or according to) the selected mode. The V-vector coding unit 52 may then provide the selected one of the non-predicted vector-quantized V-vector (e.g., in terms of weight values or bits indicative thereof), predicted vector-quantized V-vector (e.g., in terms of residual weight error values or bits indicative thereof), the non-Huffman-coded scalar-quantized V-vector and the Huffman-coded scalar-quantized V-vector to the bitstream generation unit 42 as the coded foreground V[k] vectors 57.

In an alternative example, the V-vector coding unit 52 may perform any one of the following 14 type of quantization modes, as indicated by a quantization mode syntax element denoted "NbitsQ":

| NbitsQ value | Type of Quantization Mode |
|---|---|
| 0-2: | Reserved |
| 3: | Predictive Vector Quantization |
| 4: | Non-predictive Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

In the example quantization mode table directly above, the V-vector coding unit 52 may include separate quantization modes for predictive vector quantization (e.g., NbitsQ equals three) and non-predictive vector quantization (e.g., NbitsQ equals four).

Figure 4:
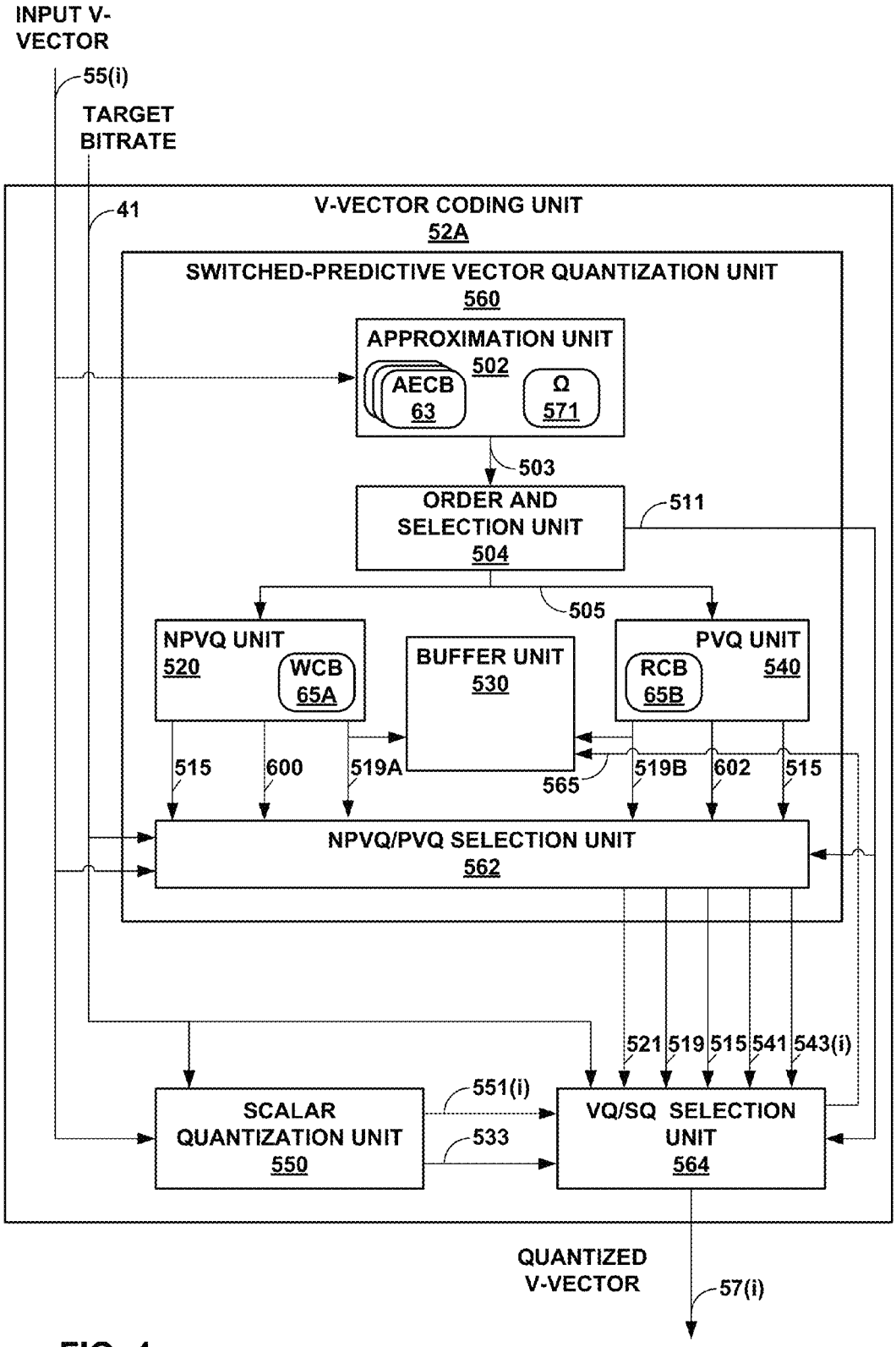
FIG. 4 is a diagram illustrating, in more detail, the V-vector coding unit, of the HoA vector-based decomposition framework, in the audio encoding device 24 shown in FIG. 3.

FIG. 4 is a diagram illustrating a V-vector coding unit 52A configured to perform various aspects of the techniques described in this disclosure. The V-vector coding unit 52A may represent one example of the V-vector coding unit 52 included within the audio encoding device 20 shown in the example of FIG. 3. In the example of FIG. 4, the V-vector coding unit 52A includes a scalar quantization unit 550, a switched-predictive vector quantization unit 560 and a vector quantization/scalar quantization (VQ/SQ) selection unit 564. The scalar quantization unit 550 may represent a unit configured to perform one or more of the various scalar quantization modes listed above (i.e., as identified in the above table by an NbitsQ values between 5 and 16 in this example).

The scalar quantization unit 550 may perform the scalar quantization in accordance with each of the modes with respect to a single input V-vector 55(*i*). The single input V-vector 55(*i*) may refer to one (or, in other words, an ith one) of the reduced foreground V[k] vectors 55. Based on the target bitrate 41, the scalar quantization unit 550 may select one of the scalar quantized versions of the input V-vector 55(*i*), outputting the scalar quantized version of the input V-vector 55(*i*) to a vector quantization/scalar quantization (VQ/SQ) selection unit 564 also included in the V-vector coding unit 52. The scalar quantized version of the input V-vector 55(*i*) is denoted as SQ vector 551(*i*).

The scalar quantization unit 550 may also determine an error (denoted as $ERROR_{SQ}$) that identifies an error as a result of the scalar quantization of the input V-vector 55(*i*). The scalar quantization unit 550 may determine $ERROR_{SQ}$ in accordance with the following equation (1):

$$ERROR_{SQ}=|V_{FG}-\hat{V}_{SQFG}| \quad (1)$$

where $V_{FG}$ denotes the input V-vector 55(*i*) and $\hat{V}_{SQFG}$ denotes the SQ vector 551(*i*). The scalar quantization unit 550 may output the $ERROR_{SQ}$ to the VQ/SQ selection unit 564 as $ERROR_{SQ}$ 533.

As described in more detail below, the switched-predictive vector quantization unit 560 may represent a unit configured to switch between non-predictive vector quantization of a first set of one or more weights and a second set of one or more weights. As further shown in the example of FIG. 4, the switched-predictive vector quantization unit 560 may include an approximation unit 502, an order and selection unit 504, a non-predictive vector quantization (NPVQ) unit 520, a buffer unit 530, a predictive vector quantization unit 540, and a vector quantization/predictive vector quantization unit (VQ/PVQ) selection unit 562. The approximation unit 502 may represent a unit configured to generate an approximation of the input V-vector 55(*i*) based on one or more volume code vectors 571 transformed from one or more azimuth-elevation codebooks (AECB) 63. It should be noted that the buffer unit 530 is part of a physical memory.

The approximation unit 502 may, in other words, approximate the input V-vector 55(*i*) as a combination of one or more weights and one or more volume code vectors 571. The sets of weights may be denoted mathematically by variable ω. The code vectors may be denoted mathematically by variable Ω. As such, the volume code vectors 571 are shown in the example of FIG. 4 as "Ω 571." The input V-vector 55(*i*) may be denoted mathematically by the variable $V_{FG}$. In one example, the volume code vectors 571 may be derived using a statistical analysis of various input V-vectors (similar to the input V-vector 55(*i*)) generated through application of the above described processes to a myriad of sample audio soundfields (as described by HOA coefficients) to result in, on average, a least amount of error when approximating any given input V-vector.

Figure 5:
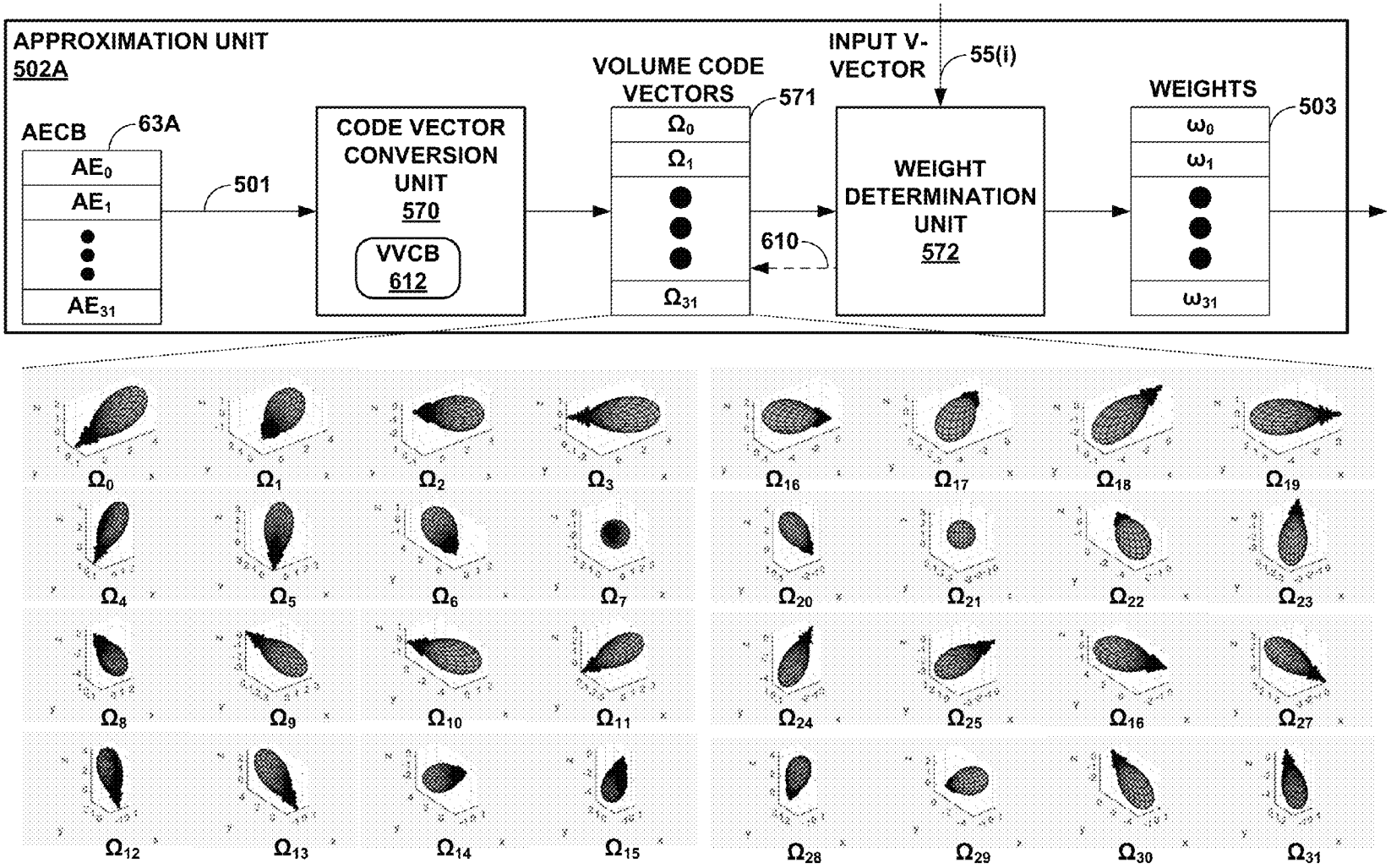
FIG. 5 is a diagram illustrating, in more detail, the approximation unit included within the V-vector coding unit of FIG. 4 in determining the weights.

In a different example, the volume code vectors 571 may be generated by transforming a set of azimuth angles and elevation angles (or, a set of azimuth angles and elevation positions) in a table in a spatial domain to a Higher Order Ambisonics Domain, as further described in FIG. 5. The azimuth and elevation positions in the table may also be determined by the geometry of the positions of microphones in the microphone array 5 illustrated in FIG. 2. Thus, the encoding device of FIG. 3 may be further integrated into a device that comprises a microphone array 5 configured to capture an audio signal with microphones positioned at different azimuth and elevation angles.

Given that the input V-vector 55(*i*) and the set of code vectors may be fixed, the approximation unit 502 may attempt to solve for the weights 503 (ω) using the following equations (2A) and 2(B):

$$V_{FG} \approx \sum_{j=1}^{J=32} \omega_j \Omega_j \tag{2A}$$

$$V_{FG} = \sum_{j=1}^{J=25} \omega_j \Omega_j \tag{2B}$$

In the above example equations (2A), an (2B), $\Omega_j$ represents the jth code vector in a set of code vectors $\{\Omega_j\}$, $\omega_j$ represents the jth weight in a set of weights $\{\omega_j\}$. According to equation (1), the approximation unit 502 may multiply a jth weight by a jth code vector for a set of J volume code vectors 571 and sum the result of the J multiplications to approximate the input V-vector 55(*i*), resulting in a weighted sum of code vectors.

In one configuration, the closed form configuration, the approximation unit 502 may solve for the weights ω based on the following equation (3):

$$\omega_k = V_{FG}\Omega_k^T \tag{3}$$

where $Q_k^T$ represents a transpose of the kth code vector in a set of code vectors $(\{\Omega_k\})$, and $\omega_k$ represents the jth weight in a set of weights $\{\omega_k\}$.

In some examples, in the closed form configuration, the code vectors may be a set of orthonormal vectors. For example, if there are $(N+1)^2$ code vectors, where $N=4^{th}$ order, the 25 code vectors may be orthogonal, and further be normalized so that the code vectors are orthonormal. In such examples where the set of code vectors $(\{\Omega_j\})$ are orthonormal, the following expression may apply:

$$\Omega_j\Omega_k^T = \begin{cases} 1 & \text{for } j = k \\ 0 & \text{for } j \neq k \end{cases} \tag{4}$$

In such examples where equation (4) applies, the right-hand side of equation (3) may simplify as follows:

$$V_{FG}\Omega_k^T = \left(\sum_{j=1}^{J=25} \omega_j \Omega_j\right)\Omega_k^T = \omega_k \tag{5A}$$

where $\omega_k$ corresponds to the kth weight in the weighted sum of code vectors. The weighted sum of code vectors may refer, as one example, the summation of each of the plurality of volume code vectors multiplied by each of the plurality of weights from the current time segment.

In examples where the set of code vectors are not strictly orthonormal, or strictly orthogonal, the set of J weights may be based on the following equation (5B):

$$V_{FG}\Omega_k^T \approx \left(\sum_{j=1}^{J=32} \omega_j \Omega_j\right)\Omega_k^T = \omega_k \tag{5B}$$

where $\omega_k$ corresponds to the kth weight in the weighted sum of code vectors.

In additional examples, the code vectors may be one or more of the following: a set of directional vectors, a set of orthogonal directional vectors, a set of orthonormal directional vectors, a set of pseudo-orthonormal directional vectors, a set of pseudo-orthogonal directional vectors, a set of directional basis vectors, a set of orthogonal vectors, a set of pseudo-orthogonal vectors, a set of spherical harmonic basis vectors, a set of normalized vectors, and a set of basis vectors. In examples where the code vectors include directional vectors, each of the directional vectors may have a directionality that corresponds to a direction or directional radiation pattern in 2D or 3D space.

In a different configuration, the best-matched-fit configuration, the approximation unit 502 may be configured to implement a matching algorithm to identify the weights $\omega_k$. The approximation unit 502 may select different sets of weights for each of the volume code vectors 571 using an iterative approach that minimizes the error between a weighted sum of code vectors (e.g. using equations (5A or 5B)) and the input V-vector 55(*i*). Different error criterions may be used, such as L1 norm variants (e.g., absolute value of difference) or L2 norm (square root of the difference of squares).

In the above example, the weights 503 include 32 different weights 503 corresponding to the 32 different volume code vectors. However, the approximation unit 502 may utilize a different one of the AECBs 63 having a different number of AE vectors 501 (see FIG. 5), resulting in a different number of the volume code vectors 571. The above referenced MPEG-H 3D Audio Standard provides for a number of different vector codebooks in Annex F. The AECBs 63 may, for example, correspond to the vector codebooks denoted in tables F.2-F.11. For the above example, where J=32, the 32 volume code vectors 571 may represent transformed versions of the azimuth-elevation (AE) vectors 501 defined in table F.6. As described in more detail below, the approximation unit 502 may transform the AE vectors 501 (see FIG. 5) according to section F.1.5 of the above reference MPEG-H 3D Audio Standard.

In some examples, the approximation unit 502 may select between different ones of the AECBs 63 to code different input V-vectors 55(*i*). In addition, the approximation unit 502 may switch between different ones of the AECBs 63 when coding the same input V-vector 55(*i*) as the same input V-vector 55(*i*) changes over time.

The approximation unit 502 may, in some examples, utilize one of the AECBs 63 corresponding to table F.11 (having 900 code vectors) when the input V-vector 55(*i*) specifies a single direction of a sound source having a single direction (e.g., describing a direction in the soundfield of a buzzing bee). The approximation unit 502 may utilize the 32 AE vectors 501 when the input V-vector 55(*i*) corresponds to a multi-directional sound source, i.e, a sound source spanning multiple directions, or contain multiple sound sources arriving from a different plurality of angular directions. In this respect, the input V-vector 55(*i*) may include a singular directional V-vector 55(*i*) or a multi-directional V-vector 55(*i*).

When approximating a single directional input V-vector 55(*i*), the approximation unit 502 may select a single one of the 900 volume code vectors 571 transformed from the 900 AE vectors (defined using a azimuth angle and an elevation angle) that best represents the single directional input V-vector 55(*i*) (e.g., in terms of an error between each of the AE vectors 501 and the input V-vector 55(*i*)). The approximation unit 502 may determine a weight value of either −1 or 1 when using the single selected one of the AE vectors 501. Alternatively, the approximation unit 502 may access one of the weight codebooks (WCB) 65A. The one of the WCB 65A that the approximation unit 502 may access may include weights similar to F.12.

The approximation unit 502 may utilize various other combinations of weight values and volume code vectors. However, for ease of discussion purposes, the example where J=32 is used throughout the disclosure to discuss the techniques in terms of the 32 AE vectors 501 (see FIG. 5). The approximation unit 502 may output the 32 weights 503 (which are one example of one or more weights) to the order and selection unit 504.

FIG. 5 is a diagram illustrating, in more detail, an example of the approximation unit 502 included within the V-vector coding unit 52A of FIG. 4 in determining the weights. The approximation unit 502A of FIG. 5 may represent one example of the approximation unit 502 shown in the example of FIG. 4. The approximation unit 502A may include a code vector conversion unit 570 and a weight determination unit 572.

The code vector conversion unit 570 may represent a unit configured to receive the AE vectors 501 from one of the AECB 63 (denoted AECB 63A) and convert (or, in other words, transform) the 32 AE vectors 501 from the azimuth and elevation angles in the spatial domain in a table, such as the azimuth and elevation angles in table F.6 to a vector having a volume in the HOA domain, as shown in the bottom half of FIG. 5. The azimuth and elevation angles for the 32 AE vectors may be based on the geometrical position of the microhpones in a three-dimensional curved microphone array 5 used to capture the live recordings 7. As noted above with respect to FIG. 2, the three-dimensional curved microphone array 5 may be a sphere, with a uniform distribution of microphones placed on the sphere. Each microphone location in the three-dimensional curved microphone array may be described by an azimuth an elevation angle. The code vector conversion unit 570 may output 32 volume code vectors 571 to the weight determination unit 572.

The code vector conversion unit 570 may apply a mode matrix $\psi^{N_1,N_2}$ of order $N_1$ with respect to the directions $\Phi_q^{(N_2)}$ to the 32 AE vectors 501. The above referenced MPEG-H 3D Audio Standard may denote the directions using the "a" symbol. In other words, the mode matrix $\psi^{N_1,N_2}$ may include spherical basis functions that each point in one of the $\Phi_q^{(N_2)}$ directions, where $q=1, \ldots, O_2=(N_2+1)^2$. The mode matrix $\psi^{N_1,N_2}$ may be defined as $\Psi^{(N_1,N_2)}: =[S_1^{(N_1)}\ S_2^{(N_1)} \ldots S_{O_2}^{(N_1)}]\in\mathbb{R}^{O_1,O_2}$, with $S_q^{(N_1)}: =[S_0^0(\Phi_q^{(N_2)})\ S_{-1}^{-1}(\Phi_q^{(N_2)})\ S_{-1}^0(\Phi_q^{(N_2)}) \ldots S_{N_1}^{N_1}(\Phi_q^{(N_2)})]\in\mathbb{R}^{O_1}$, and $O_1=(N_1+1)^2$. The $S_M^N$ may denote the spherical basis function of order N and sub-order M. In other words, each of volume code vectors of the volume code vectors 571 may be defined in the HOA domain and are based on a linear combination of spherical harmonic basis functions oriented in one of a plurality of angular directions defined by a set of azimuth and elevation angles. The azimuth and elevation angles may be predefined or obtained by the geometrical position of microphones in the microphone array 5, such as illustrated in FIG. 2.

Although described as performing this conversion for every application of the 32 AE vectors 501, the code vector conversion unit 570 may perform this conversion only once during any given encoding process rather than on an application-by-application basis and store the 32 volume code vectors 571 to a codebook. Moreover, the approximation unit 502 may not include a code vector conversion unit 570 in some implementations and may store the 32 volume code vectors 571 with the 32 volume code vectors 571 having been predetermined. The approximation unit 502 may store the 32 volume code vectors 571 as a volume vectors (VV) CB (VVCB) 612 in some examples. Again, the 32 volume code vectors 571 are shown in the bottom half of FIG. 5. The 32 volume code vectors 571 may be denoted as $\Omega_{0,\ldots,31}$.

The weight determination unit 572 may represent a unit configured to determine the 32 weights 503 (or another number of a plurality of weights 503) for a current time segment (e.g., an ith audio frame) corresponding to the 32 volume AE vectors 501 defined in a higher order ambisonic domain and indicative of the input V-vector 55(*i*). The weight determination unit 572 may determine the 32 weights 503 using either the closed form configuration or best fit match configuration describe previously above. As such, the J (e.g. J=32) weights 503 (denoted as $\omega_{0,\ldots,31}$) may be determined by multiplying the input V-vector 55(*i*) by the transpose of the J volume code vectors 571.

Returning to FIG. 4, the order and selection unit 504 represents a unit configured to order the 32 weights 503 and select a non-zero subset of the weights 503. The order and selection unit 504 may, as one example, order the 32 weights 503 in ascending order. Alternatively, the order and selection unit 504 may, as another example, order the 32 weights 503 in descending order. The order and selection unit 504 may order the 32 weights 503 based on highest value to lowest value, or lowest value to highest value, where the magnitude of the values may or may not be considered when ordering. Once the weights 503 are ordered, the order and selection unit 504 may select a non-zero subset of the ordered 32 weights 503 that result in a weighted sum of code vectors that closely match the weighted sum of code vectors with a full set of weights. Thus, non-zero subset of weights that are relatively small, i.e., closer to zero value, may not be selected.

Figure 6:
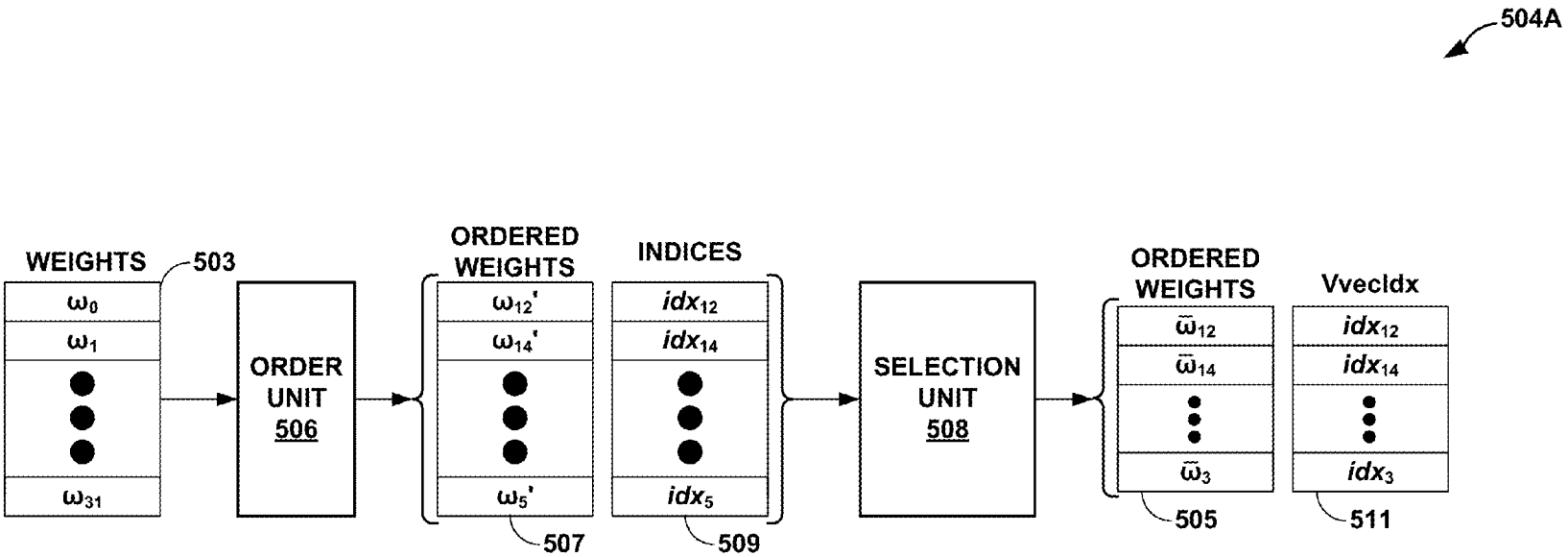
FIG. 6 is a diagram illustrating, in more detail, the order and selection unit included within the V-vector coding unit of FIG. 4 in ordering and selecting the weights.

FIG. 6 is a diagram illustrating, in more detail, an example of the order and selection unit 504A included within the V-vector coding unit 52A of FIG. 4 in ordering and selecting the weights. The order and selection unit 504A of FIG. 6 represents one example of the order and selection unit 504 of FIG. 4.

As shown in FIG. 6, the order and selection unit 504A may include an order unit 506 that may, for example, order the 32 weights 503 in descending order. The individual weights $\omega_0, \ldots, \omega_{31}$ may be reordered from largest to smallest magnitude (ignoring the sign). As such, the resulting reordered 32 ordered weights 507 $\omega_{12}, \omega_{14}, \ldots, \omega_5$ are illustrated with indices 509 that are reordered.

Because the original weight values of the 32 weights 503 were in the respective order corresponding to the 32 volume code vectors 571, no index information may be specified. However, because the order unit 506 has rearranged the weights in the 32 ordered weights 507, the order unit 506 may determine (e.g., generate) the 32 indices 509 indicating one of the volume code vectors 571 to which each of the 32 ordered weights 507 correspond. The order unit 506 outputs the 32 ordered weights 507 and the 32 indices 509 to the selection unit 508.

The selection unit 508 may represent a unit configured to select a non-zero subset of the ordered weights 507 and the 32 indices 509. The ordered weights 507 may be denoted as ω'. The selection unit 508 may be configured to select a predetermined number (Y) or, alternatively, a dynamically determined (Y) of the 32 ordered weights 507 and 32 indices 509. The dynamic determination of the number of weights may, as one example, be based on the target bitrate 41.

Y may denote any number of the J ordered weights 507, including any non-zero subset of the ordered weights 507. For ease of illustration purposes, the selection unit 508 may be configured to select eight (e.g. Y=8) weights. Although described as selecting 8 weights below, the selection unit 508 may select any Y of the J weights.

The selection unit 508 may, in some examples, select the top (when ordered in descending order) 8 weights of the 32 ordered weights 507 and the corresponding 8 indices of the 32 indices 509. The 8 indices 511 may represent data indicative of which of the 32 code vectors correspond to each of the 8 weight values. The selection of the weights may be expressed by the following equation (5):

$$\{\omega_k'\}_{k=1,\ldots,32} \Rightarrow \{\overline{\omega}_k\}_{k=1,\ldots,8} \tag{6}$$

The subset of the weight values together with their corresponding volume code vectors may be used to form a weighted sum of code vectors (which again may refer, as one example, the summation of each of the plurality of volume code vectors multiplied by each of the plurality of weights from the current time segment) that estimates, or still approximates, the V-vector, as shown in the following expression:

$$\overline{V}_{FG} \approx \sum_{j=1}^{8} \overline{\omega}_j \Omega_j \tag{7}$$

where $\overline{\omega}_j$ represents the jth weight in a subset of weights ($\{\overline{\omega}_j\}$) and $\overline{V}_{FG}$ represents an estimated V-Vector. The estimated V-vector may be coded by the non-predictive vector quantization unit 520, where the set of weights $\{\overline{\omega}_j\}$ may be vector quantized, and the set of code vectors $\{\Omega_j\}$ may be used to compute the weighted sum of code vectors. As the ordered weights that were not selected from the full set of J (e.g. 32) weights were relatively small, i.e. closer to zero value, the weighted sum of code vectors still closely match the weighted sum of code vectors with a full set of weights. Thus, the estimated V-Vector may approximate the V-Vector.

Although not expressly drawn for ease of readability, a combination of weight determination unit 572 and a selection unit 504 may be part of an Approximator unit and the best-fit-match configuration may be used to select the 8 weights that may not necessarily be ordered and compute a weighted sum of code vectors that still closely match the weighted sun of code vectors with a full set of weights (e.g. J=32). Though there is not necessarily an ordered unit in the Approximator unit, the output of the Approximator unit would output the estimated V-Vector described above. Similarly, the order and selection unit 504 could also be part of the Approximator unit, and in such case also output an estimated V-Vector using 8 weights that may approximate the V-vector using the full set of 32 weights.

The selection unit 508 may output the 8 indices 511 as 8 VvecIdx syntax elements 511 to the VQ/SQ selection unit 564 of the V-vector coding unit 52A, as depicted in FIG. 4. The selection unit 508 may also output the 8 ordered weights 505 to both the NPVQ unit 520 and the PVQ unit 540 of the switched-predictive vector quantization unit 560. In this respect, the ordered weights 505 may represent a first set of weights output to the NPVQ unit 520 and a second wet of weights output to the PVQ unit 540.

Returning again to the example of FIG. 4, the NPVQ unit 520 may receive the 8 ordered weights 505 (which also may be referred to as the "selected ordered weights 505"). The NPVQ unit 520 may represent a unit configured to perform non-predictive vector quantization with respect to the 8 ordered weights 505. Vector quantization may refer to a process by which a group of values are quantized jointly rather than independently. Vector quantization may leverage statistical dependencies among the group of values to be quantized.

In other words, vector quantization, which is also referred to as block quantization or pattern matching quantization, may encode values from a multi-dimensional vector space into a finite set of values from a discrete subspace of lower dimension. The NPVQ unit 520 may store the finite set of values to a table common to both the audio encoding device 20 and the audio decoding device 24 and index each of the sets of values. The index may effectively quantize each set of values. In the example of FIG. 4, the index may represent an 8-bit code (or any other number of bit code depending on the number of entries of the table) that identifies an approximation of the 8 ordered weights 505. Vector quantization may therefore quantize the 8 ordered weights 505 as an index into a table or other data structure, thereby potentially reducing a number of bits to represent the 8 ordered weights 505 into an 8 bit index.

Vector quantization may be trained to reduce error and better represent the data set (e.g., the 8 ordered weights 505 in this example). There may be different types of training that vary in complexity. The training generally attempts to assign quantization values to denser areas of the data set in an attempt to better represent the data set. The result of the training, meaning the weight values that approximate the 8 ordered weights 505, may be stored to a weight codebook (WCB) 65. Different ones of the WCBs 65A may be derived for quantizing different numbers of weights. For purposes of illustration, a vector quantization codebook of WCBs 65A with 8 weight values is discussed. However, different ones of the WCBs 65A with a different numbers of weight values may apply.

To further reduce the dynamic range of the 8 weight values and thereby facilitate better selection of the weight values to be used in place of the 8 weight values, only the magnitude may be considered during training One example where the sign of the values may be disregarded is when there is a high relative symmetry (meaning that the distribution of values in the positive and negative are similar in distribution and number to some degree above a threshold). As such, the NPVQ unit 520 may perform non-predictive vector quantization with respect to the magnitude of the 8 ordered weights 505 and separately indicate the sign information (e.g., by way of a SgnVal syntax element for each of the weights 505).

Figure 7A:
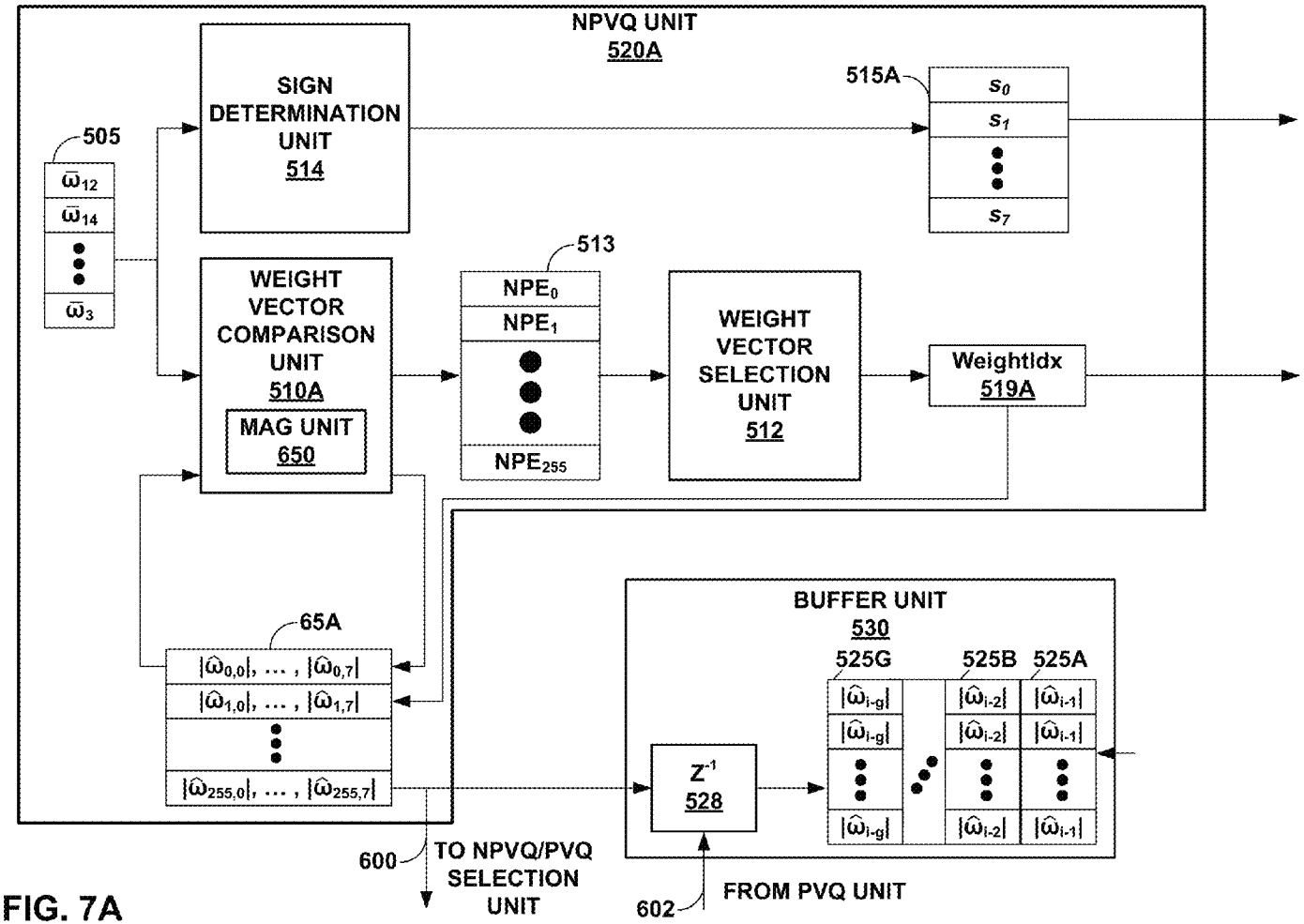
FIGS. 7A and 7B are diagrams illustrating, in more detail, configurations of the NPVQ unit included within the V-vector coding unit of FIG. 4 in vector quantizing the selected ordered weights.
Figure 7B:
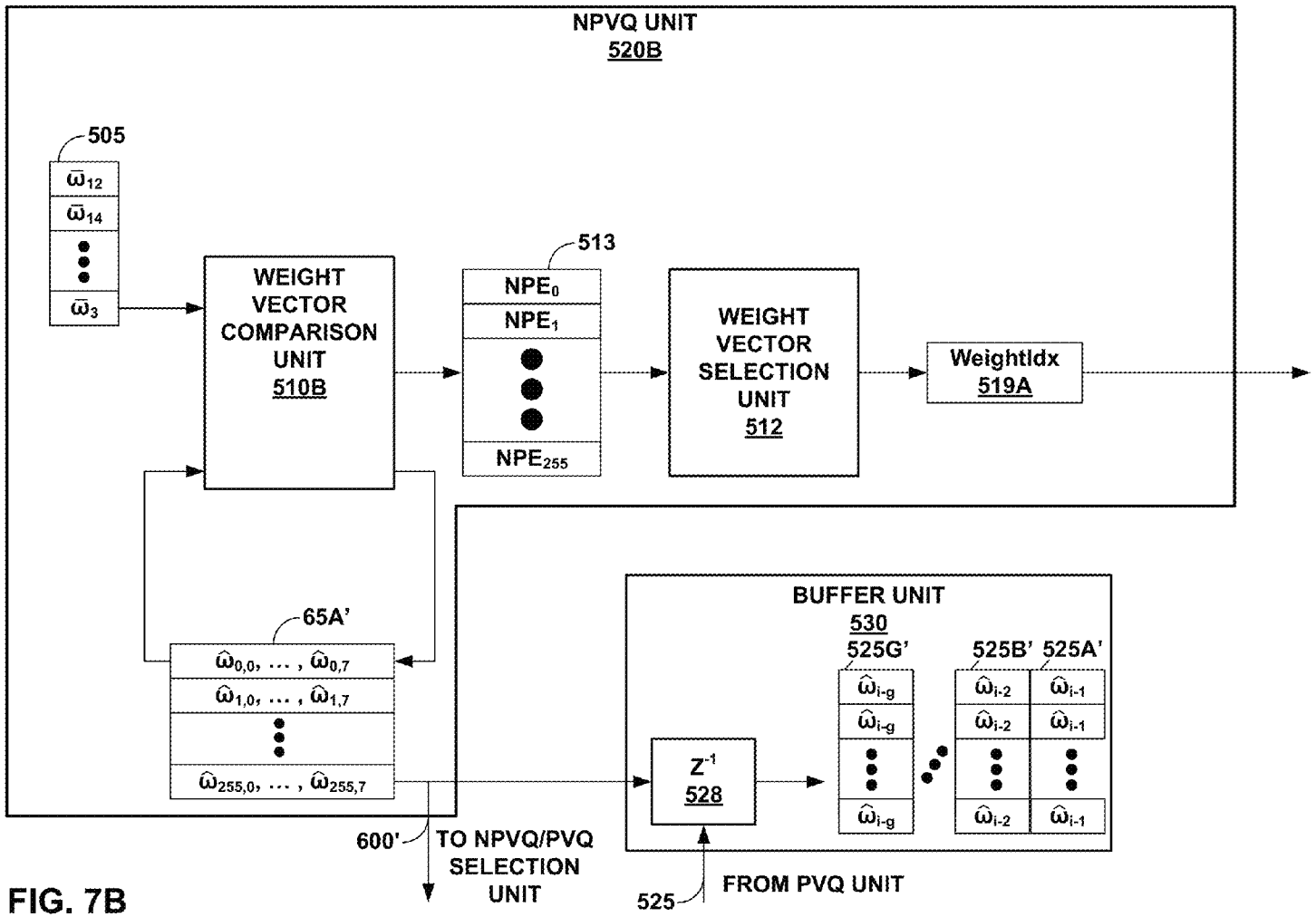

FIGS. 7A and 7B are diagram illustrating, in more detail, different examples of the NPVQ unit included within the V-vector coding unit of FIG. 4 in vector quantizing the selected ordered weights. The NPVQ unit 520A of FIG. 7A may represent one example of the NPVQ unit 520 shown in FIG. 4. The NPVQ unit 520A may include a weight vector comparison unit 510, a weight vector selection unit 512, and a sign determination unit 514.

The weight vector comparison unit 510A may represent a unit configured to receive the 8 ordered weights 505 and perform a comparison to each entry of the weight codebook (WCB) 65A. As noted above, there may be a number of different WCBs 65A. The weight vector comparison unit 510A may select between the different WCBs 65A based on any number of different criteria, including the target bitrate 41.

In the example of FIG. 7A, the WCB 65A may be representative of the weight codebook defined in table F.13 of the MPEG-H 3D Audio Standard referenced above. The WCB 65A may include 256 entries (shown as 0 to 255). Each of the 256 entries may include a weight vector having eight quantization values to be used as a possible approximation of the 8 ordered weights 505.

The absolute values of the weights $\{\overline{\omega}_k\}_{k=1,\ldots,8}$ may be vector-quantized with respect to the predefined weighting values $\hat{\omega}$ of table F.13 of the above referenced MPEG-H 3D Audio Standard and signaled with the associated row number index. In the example of FIG. 7A, each row of the WCB 65A includes $\hat{\omega}_{0,\ldots,7}$ sorted in descending order with the row being denoted in the first sub-script number (e.g., the $\hat{\omega}_{0,\ldots,7}$ of row one are denoted $\hat{\omega}_{0,0}, \ldots, \hat{\omega}_{0,7}$). Given that the weight vectors in the WCB 65A are unsigned (meaning that no sign information is given), the weight vectors are denoted as the absolute value of the weight vectors. (e.g., the $\omega_{0,\ldots,7}$ of row one are denoted $|\hat{\omega}_{0,0}|, \ldots, |\hat{\omega}_{0,7}|$)

The weight vector comparison unit 510A may iterate through each entry of the WCB 65A to determine an error that results from quantizing the weights $\{\omega_k\}_{k=1,\ldots,8}$. The weight vector comparison unit 510A may include a magnitude unit 650 ("mag unit 650") that determines that absolute value or, in other words, magnitude of each of the ordered weights 505. The magnitudes of the ordered weights 505 may be denoted as $|\{\overline{\omega}_k\}|$. The weight vector comparison unit 510A may compute the error for the xth row of the WCB 65A in accordance with the following equation (8):

$$NPE_x = |\{\overline{\omega}_k\}| - |\{\hat{\omega}_{x,k}\}| = (|\hat{\omega}_0| - |\hat{\omega}_{x,0}|) + \ldots + (|\hat{\omega}_7| - |\hat{\omega}_{x,7}|) \quad (8)$$

where NPEx denotes the non-predictive error (NPE) for the xth row of the WCB 65A. The weight vector comparison unit 510A may output 256 errors 513 to the weight vector selection unit 512.

The number signs of the 8 ordered weights 505 $\{\overline{\omega}k\}_{k-1,\ldots,8}$ are separately coded in accordance with the following equation (9):

$$s_k = \begin{cases} 1, & \overline{\omega}_k \geq 0 \\ 0, & \overline{\omega}_k < 0 \end{cases}. \quad (9)$$

where $s_k$ denotes the sign bit for the kth one of the 8 ordered weights 505. Based on the sign bit, the sign determination unit 514A may output 8 SgnVal syntax elements 515A, which may represent one or more bits indicative of a sign for each of the corresponding Bordered weights 505.

The weight vector selection unit 512 may represent a unit configured to select one of the entries of the WCB 65A to use in place of the 8 ordered weights 505. The weight vector selection unit 512 may select the entry based on the 256 errors 513. In some examples, the weight vector selection unit 512 may select the entry of the WCB 65A with the lowest (or, in other words, smallest) one of the 256 errors 513. The weight vector selection unit 512 may output an index associated with the lowest error, which also identifies the entry. The weight vector selection unit 512 may output the index as a "WeightIdx" syntax element 519A.

The subset of the weight values together with their corresponding volume code vectors may be used to form a weighted sum of code vectors that produces the quantized V-vector, as shown in the following equation:

$$\hat{V}_{FG} = \sum_{j=1}^{8} (2s_j - 1)|\hat{\omega}_j|\Omega_j \quad (10)$$

where $s_j$ represents the jth sign bit in a subset of sign bits $(\{s_j\})$, $|\hat{\omega}_j|$ represents the jth weight in a subset of unsigned weights $(\{\hat{\omega}_j\})$, and $\hat{V}_{FG}$ may represent a non-predictive vector quantized version of the input V-vector 55(*i*). The right hand side of expression (10) may represent a weighted sum of code vectors that includes a set sign bits $(\{s_j\})$, a set of weights $(\{\hat{\omega}_j\})$ and a set of code vectors $(\{\Omega_j\})$.

The NPVQ unit 520A may output the SgnVal 515A and the WeightIdx 519A to the NPVQ/PVQ selection unit 562. The NPVQ unit 520A may also access the WCB 65A based on the WeightIdx 519A to determine the selected weights 600. The NPVQ unit 520A may output the selected weights 600 to the NPVQ/PVQ selection unit 562 and to the buffer unit 530.

The buffer unit 530 may represent a unit configured to buffer selected weights 600. The buffer unit 530 may include a delay unit 528 (denoted as "$Z^{-1}$ 528") configured to delay the selected weights 600 by one or more frames. The buffered weights may represent one or more reconstructed weights from a past time segment. The past time segment may refer to a frame or other unit of compression or time. The reconstructed weights may also be denoted as previous weights or as previous reconstructed weights. The reconstructed weights 531 may comprise an absolute value of reconstructed weights 531. The reconstructed weights of a past time segment are denoted as previous reconstructed weights 525A-525G. As shown in the example of FIG. 7A, the buffer unit 530 may also buffer reconstructed weights 602 from the PVQ unit 540.

Referring to the example of FIG. 7B, the NPVQ unit 520B may represent another example of the NPVQ unit 520 shown in FIG. 4. The NPVQ unit 520B may be substantially similar to the NPVQ unit 520A of FIG. 7A except that the ordered weight vectors in the WCB 65A are signed values. The signed version of the WCB 65A is denoted in the example of FIG. 7B as WCB 65A'. In addition, the buffer unit 530 may buffer selected weights 600' having a sign value. The previous reconstructed weights 600' stored by buffer unit 530 may be denoted as previous reconstructed weights 525A'-525G'.

Given that the weight vectors of the WCB 65A' are signed values, a sign determination unit 514A is not required because the sign and weight values are jointly quantized by the selected signed weight vector of the WCB 65A'. In other words, the WeightIdx 519A may jointly identify both the sign values and the quantized weight values. As such, in this example, the weight vector comparison unit 510 of FIG. 7B does not include a magnitude unit 650 and as a result is denoted as weight vector comparison unit 510B.

Returning again to the example of FIG. 4, the PVQ unit 540 may represent a unit configured to perform predictive vector quantization with respect to the Y (e.g. 8) ordered weights 505. Although as noted above, Y non-ordered weights may also be used when an alternate Apprximator unit is used that includes a selector unit and not an order unit, or other applicable descriptions where the weights are not ordered. As such, the PVQ unit 540 may perform a form of vector quantization with respect to a predicted version of the Y (e.g. 8) ordered or non-ordered weights rather than with respect to the 8 weights (which may also be ordered or non-ordered) themselves as in the non-predictive form of vector quantization. For ease of readability, examples below often describe ordered weights, though a person of ordinary skill in the art could recognize that the techniques described may also be performed without strictly requiring that weights be necessarily reordered. It should also be noted that the weight vector selection unit or weight comparison units in the NPVQ unit 520A and NPVQ unit 520B do not depend on past quantized vectors stored in memory of an encoder or decoder from a previous time segment (e.g. a frame), to produce the vector quantized weight vectors represented by WeightIdx 519A or WeightIdx 519B. As such, the NPVQ units may be described as memoryless.

FIGS. 8A-8H are diagrams illustrating, in more detail, the PVQ unit included within the V-vector coding unit 52A of FIG. 4 in vector quantizing the selected ordered weights.

Any of the PVQ units shown in FIGS. 8A-8H or included elsewhere may be configured to have a memory, in FIGS. 8A-8H it is denoted as QW Buffer Unit 530, which is configured to store a reconstructed plurality of weights that are used to approximate the multi-directional V-vector in the higher order ambisonics domain from a past time segment. The delay buffer 528 delays the writing of the reconstructed plurality of weights. This delay may be a delay of an entire audio frame or a sub frame. It should also be noted that the reconstructed plurality of weights (for example as denoted by label 531) may be stored in different forms (e.g. with absolute values of the plurality of weights or as a difference of absolute values of the plurality of weights, or as the difference of plurality of weights, etc.). In addition, there may be a weight index or weight error index (also may be denoted as a weight index) that is associated with the quantization of the plurality of weights. These weight indices may be vector quantized and the weight index or weight indices may be writing into the bitstream so that the decoder device is also able to reconstruct the weights and also use the reconstructed weights at the decoder device to approximate the multi-directional V-Vector.

Figure 8A:
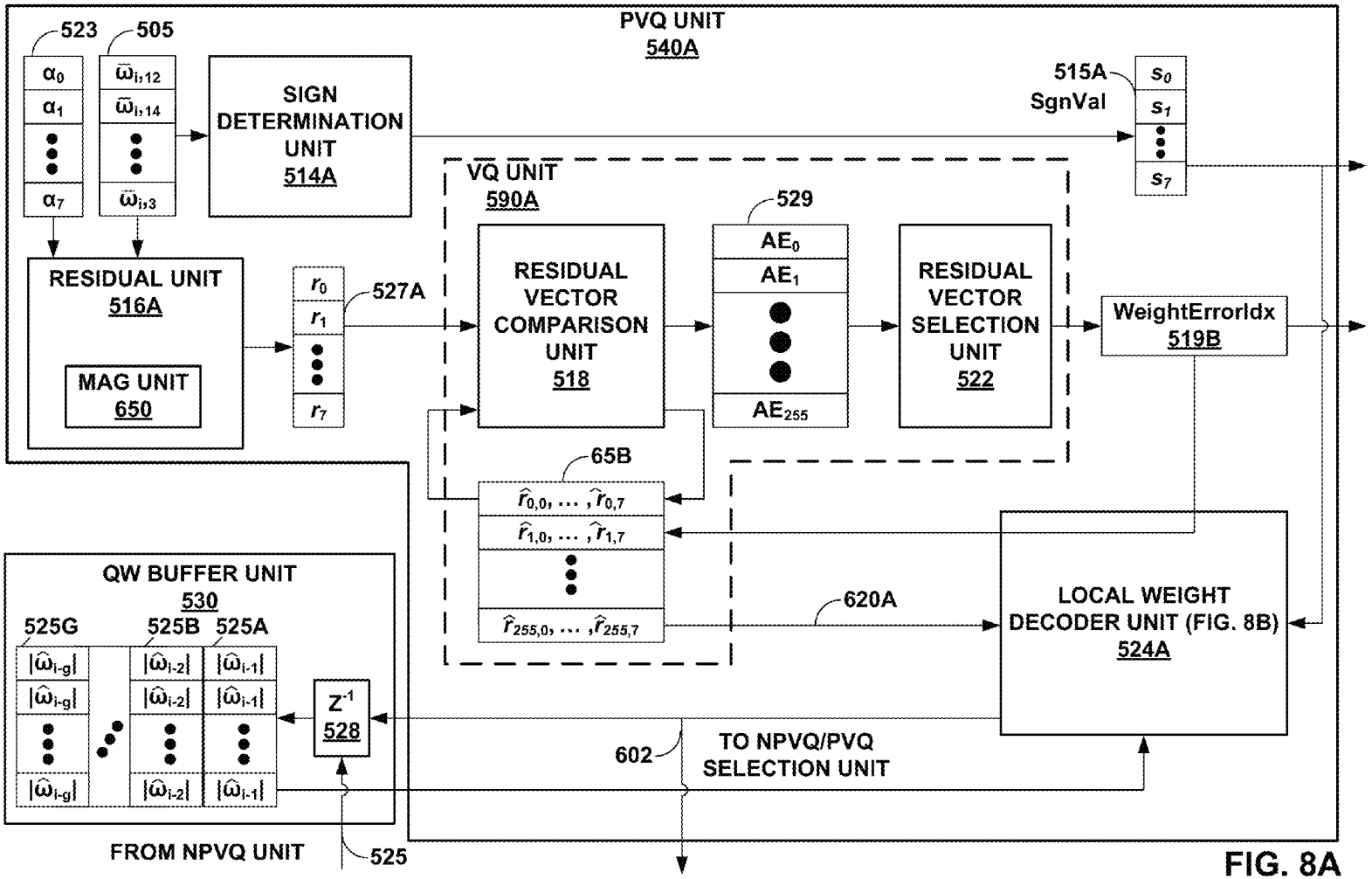
FIGS. 8A, 8C, 8E, and 8G are a diagrams illustrating, in more detail, configurations of the PVQ unit included within the V-vector coding unit of FIG. 4 in vector quantizing the selected ordered weights.

As shown in the example of FIG. 8A, the PVQ unit 540A may represent one example of the PVQ unit 540 shown in FIG. 4. The PVQ unit 540A may include a sign determination unit 514, a residual error unit 516A, a residual vector comparison unit 518, a residual vector selection unit 522, and a local weight decoder unit 524A (where the local weight decoder unit 524A is shown in more detail in the example of FIG. 8B).

The sign determination unit 514A of the PVQ unit 540 may be substantially similar to the sign determination unit 514 of the NPVQ unit 520. The sign determination unit 514A may output the 8 SgnVal syntax elements 515A indicating the numerical signs of the 8 ordered weights 505.

The residual error unit 516A may represent a unit configured to determine residual weight errors 527A (which may also be referred to as a "set of residual weight errors 527A"). In some examples, the residual error unit 516A may determine the 8 residual weight errors 527A according to the following equation:

$$r_{i,j}=|\omega_{i,j}|-\alpha_j|\hat{\omega}_{i-1,j}| \tag{11}$$

where $r_{i,j}$ denotes a jth residual weight error of the residual weight errors 527A for an ith audio frame, $|\omega i,j|$ is a magnitude (or absolute value) of the corresponding jth weight value $\omega_{i,j}$ for an ith audio frame, $|\hat{\omega}_{i,j}|$ a magnitude (or absolute value) of the corresponding jth reconstructed weight value $\hat{\omega}_{i,j}$ for an ith audio frame, and $\alpha_j$ denotes a jth weight factor of 8 weight factors 523. The residual error unit 516A may include a magnitude unit 650 that determines the absolute value or, in other words, magnitude of the 8 ordered weights 505. The absolute value of the 8 ordered weights 505 may be alternatively referred to as a weight magnitude or as a magnitude of a weight.

The 8 ordered weights 505, $\omega_{i,j}$, corresponds to the jth weight value from an ordered subset of weight values for the ith audio frame. In some examples, the ordered subset of weights (i.e., the 8 ordered weights 505 in the example of FIG. 8A) may correspond to a subset of the weight values in a code vector-based decomposition of the input V-vector 55(*i*) that are ordered based on magnitude of the weight values (e.g., ordered from greatest magnitude to least magnitude). As such, the ordered weights 505 may also be referred to herein as "sorted weights 505" given that the ordered weights may be sorted by magnitude.

The $|\hat{w}_{i-1,j}|$ term in equation (11) may be alternatively referred to as a quantized previous weight magnitude or as a magnitude of a quantized previous weight. The 8 reconstructed previous weights 525 may be alternatively referred to as a weighted reconstructed weight value magnitude or a weighted magnitude of a reconstructed weight value. The 8 reconstructed previous weights 525, $\hat{\omega}_{i-1,j}$, corresponds to the jth reconstructed weight value from an ordered subset of reconstructed weight values for the (i−1)th or any other temporally preceding audio frame (in coding order). In some examples, the ordered subset (or set) of reconstructed weight values may be generated based on quantized predictive weight values that correspond to the reconstructed weight values.

In some examples, $\alpha_j=1$ in equation (11). In other examples, $\alpha_j\neq 1$. When not equal to one, the 8 weight factors 523, $\alpha_j$, may be determined based on the following equation:

$$\alpha_j = \frac{\sum_{i=1}^{l} \omega_{i,j}\omega_{i-1,j}}{\sum_{i=1}^{l} \omega_{i-1,j}^2} \tag{12}$$

where I corresponds to the number of audio frames used to determine $\alpha_j$. As described in more detail below, the weighting factor, in some examples, may be determined based on a plurality of different weight values from a plurality of different audio frames.

The residual error unit 516A may, in this manner, determine the 8 residual weight errors 527A (which may also be referred to as "residual weight errors 527A") based on the 8 ordered weights 505 for a current time segment (e.g., the ith audio frame) and the previous reconstructed weights 525 from a past audio frame (e.g., the reconstructed weights 525A from the (i−1) th audio frame). The 8 residual weight errors 527A may represent the difference between the 8 ordered weights and one of the 8 reconstructed previous weights 525. The residual error unit 516A may use the 8 reconstructed weights 525A rather than the previous weights ($\omega_{i-1,j}$) because the reconstructed previous weights 525 are available at the audio decoding device 24, while the 8 ordered weights 505 may not be available. The residual error unit 516 may output the 8 residual weight errors 527A determined in accordance with equation (11) to the residual vector comparison unit 518.

The residual vector comparison unit 518 may represent a unit configured to compare the 8 residual weight errors 527A to one or more of the entries of the residual weight error codebook (RWC) 65B (which may also be referred to as a "residual codebook 65B"). In some examples, there may be a number of different RCBs 65B. The residual vector comparison unit 518 may select between the different RCBs 65B based on any number of different criteria, including the target bitrate 41 of FIG. 4. The residual vector comparison unit 518 may, in other words, determine the plurality of residual weight errors 527A based on a plurality of sorted weights 505.

In some examples, the number of components in each of the vector quantization residual vectors may be dependent on the number of weights (which may be denoted by the variable Y) that are selected to represent the input V-vector 55(*i*). In general, for a codebook with Y-component candidate quantization vectors, the residual vector comparison unit 518 may vector quantize Y weight at a time to generate a single quantized vector. The number of entries in the quantization codebook may be dependent upon the target bit-rate 41 used to vector quantize the weight values.

The residual vector comparison unit 518 may, in some examples, iterate through all of the entries (e.g., the 256 entries shown in the example of FIG. 8A) and determine an approximation error (AE) for each entry. Each of the 256 entries may include a residual vector having eight approximation values to be used as a possible approximation of the 8 residual weight errors 527A. In the example of FIG. 8A, each row of the RCB 65B includes $\hat{r}_{0,\ldots,7}$ with the row being denoted in the first sub-script number (e.g., the $\hat{r}_{0,\ldots,7}$ of row one are denoted $\hat{r}_{0,0}, \ldots, \hat{r}_{0,7}$).

The residual vector comparison unit 518 may iterate through each entry of the RCB 65B to determine an error that results from approximating the residual weight errors 527. The residual vector comparison unit 518 may compute the error for the xth row of the RCB 65B in accordance with the following equation (13):

$$AE_x=\{r_k\}-\{\hat{r}_{x,k}\}=(r_0-\hat{r}_{x,0})+\ldots+(r_7-\hat{r}_{x,7}) \tag{13}$$

where $AE_x$ denotes the approximation error (AE) for the xth row of the RCB 65B. The residual vector comparison unit 518 may output 256 errors 529 to the residual vector selection unit 522.

The residual vector selection unit 522 may represent a unit configured to select one of the entries of the RCB 65B to use in place or, in other words, instead of the 8 residual weight errors 527. The residual vector selection unit 522 may select the entry based on the 256 errors 529. In some examples, the residual vector selection unit 522 may select the entry of the RCB 65B with the lowest (or, in other words, smallest) one of the 256 errors 529. The residual vector selection unit 522 may output an index associated with the lowest error, which also identifies the entry. The residual vector selection unit 522 may output the index as a "WeightErrorIdx" syntax element 519B. The WeightErrorIdx syntax element 519B may represent an index value indicative of which of the Y-component vectors from the RCB 65B is to be selected to generate the dequantized version of the Y residual weight errors.

In this respect, the residual vector comparison unit and the residual vector selection unit 522 may represent a vector quantization (VQ) unit 590A. The VQ unit 590A may effectively vector quantize the residual weight errors 527A to determine a representation of the residual weight errors 527A. The representation of the residual weight errors 527A may include the WeightErrorIdx 519B.

The subset of the weight values together with their corresponding volume code vectors 571 may be used to form a weighted sum of volume code vectors that produces the quantized V-vector, as shown in the following equation:

$$\hat{V}_{FG}=\sum_{j=1}^{8}(2s_j-1)(|\hat{r}_{i,j}|+\alpha_j|\hat{\omega}_{i-1,j}|)\Omega_j \tag{14}$$

The right hand side of expression (14) may represent a weighted sum of code vectors that includes a set sign bits ($\{s_j\}$), a set of residuals ($\{\hat{r}_{i,j}\}$) for an ith audio frame, a set of weight factors ($\{\alpha_j\}$), a set of weights ($\{\hat{\omega}_{i-1,j}\}$) for an (i−1)th audio frame representative of a past time segment, and a set of code vectors ($\{\Omega_j\}$). The PVQ unit 540A may output the SgnVal 515A and WeightErrorIdx 519B to the NPVQ/PVQ selection unit 562 (shown in FIG. 4). The PVQ unit 540A may also provide the WeightErrorIdx 519B to the local weight decoder unit 524A, which is shown in more detail with respect to the example of FIG. 8B.

Figure 8B:
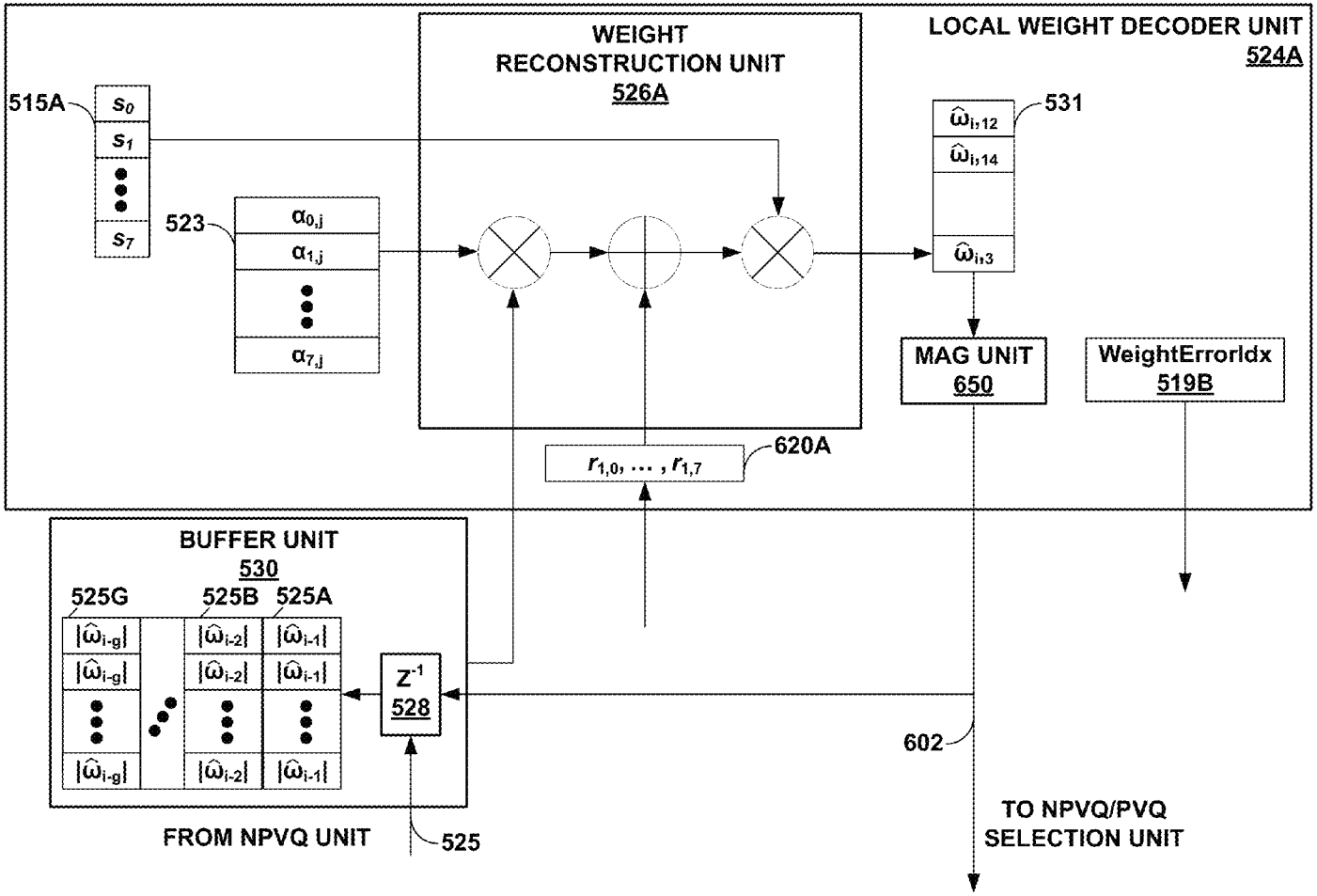
FIGS. 8B, 8D, 8F, and 8H are a diagrams illustrating, in more detail, configurations of the local weight decoder unit included with the different configurations described in FIGS. 8A, 8C, 8E, and 8G.

As shown in the example of FIG. 8B, the local weight decoder unit 524A includes a weight reconstruction unit 526A and a delay unit 528. The weight reconstruction unit 526A represents a unit configured to reconstruct the 8 ordered weights 505 based on the 8 weight factors 523 ($\{\alpha_j\}$), a selected residual vector 620A representative of $\{\hat{r}_{i,j}\}$, and the 8 previous reconstructed weights 525 representative of $|\{\hat{\omega}_{i-1,j}\}|$. The weight reconstruction unit 526A may reconstruct the jth one of the 8 weight values 505 in accordance with the following equation to generate a jth one of 8 reconstructed weight values 531:

$$\hat{\omega}_{i,j}=(\hat{r}_{WeightIdx,j}|+\alpha_j|\hat{\omega}_{i-1,j}| \tag{15}$$

The reconstructed weight may be denoted as $\hat{\omega}_{i,j}$ in the above equation (15).

Denoting the reconstructed weight with the same notation $\hat{\omega}_{i,j}$ as that of the quantized weight may imply that the reconstructed weight is the same as the quantized weights discussed above. The notation may however distinguish a perspective from which each value is understood. A quantized weight may refer to a weight obtained through quantization by an encoder. A reconstructed weight may refer to a weight obtained through dequantization by a decoder.

Although such notation may imply a distinction of perspective, it should be understood that in some examples a reconstructed weight may be different than a quantized weight while in other examples a reconstructed weight may be the same as the quantized weight. For example, when the reconstructed weight is a signed value but the quantized weight is an unsigned value, the reconstructed weight may be different. In examples where both the reconstructed weight and the quantized weight are signed values, the reconstructed weight may be the same as the quantized weight.

In the example of FIG. 8B, the weight reconstruction unit 526A may obtain the selected residual weight vector 620A by interfacing with the RCB 65B. Although shown as being included within the PVQ unit 640A, the local weight decoder unit 524A may include the RCB 65B. When the local weight decoder unit 524A is used within an audio decoding device, the RCB 65B may be included within the local weight decoder unit 524A. Although shown as stored locally within the PVQ unit 640A, the RCB 65B may reside in a memory external from the PVQ unit 640A or the local weight decoder unit 524A and may be accessed via common memory access processes.

The weight reconstruction unit 526A may vector dequantize the WeightErrorIdx 519B (which may represent a weight index) to determine a selected residual vector 620A (which may represent a plurality of residual weight errors). The weight reconstruction unit 526 may vector dequantize the WeightErrorIdx 519B based on the RCB 65B to determine the selected residual vector 620A. The RCB 65B may represent one example of a residual weight error codebook.

The weight reconstruction unit 526A may reconstruct a plurality of weights 602 based on the selected residual vector 620A. The weight reconstruction unit 526 retrieve from the buffer unit 530 (which may represent in some examples at least a portion of a memory) one of the sets of the reconstructed plurality of weights 525 from a past time segment (where the past segment occurs in time previous to the current time segment). The current time segment may represent a current audio frame. In some examples, the past time segment may represent a previous frame. In other examples, the past time segment may represent a frame earlier in time than a previous frame. The weight reconstruction unit 526A may reconstruct, as described above with respect to equation (15), the plurality of weights 531 for a current time segment based on the plurality of residual weight errors represented by the selected residual weight vector 620A and one of the reconstructed plurality of weights 525 from the past time segment.

The weight reconstruction unit 526A may output the 8 reconstructed weights 602 (which again may represent a reconstructed plurality of weights), which may be denoted mathematically as $\omega_{i,j}$, to the magnitude unit 650. The magnitude unit 650 may determine a magnitude or, in other words, an absolute value of the reconstructed weights 602. The magnitude unit 650 may output the magnitude of the reconstructed weights 602 to the buffer unit 530, which may operate in the manner described above with respect to FIGS. 7A and 7B to buffer the previous reconstructed weights 525. The local weight decoder unit 524A may output the reconstructed weights 602 to the NPVQ/PVQ selection unit 562.

Figure 8C:
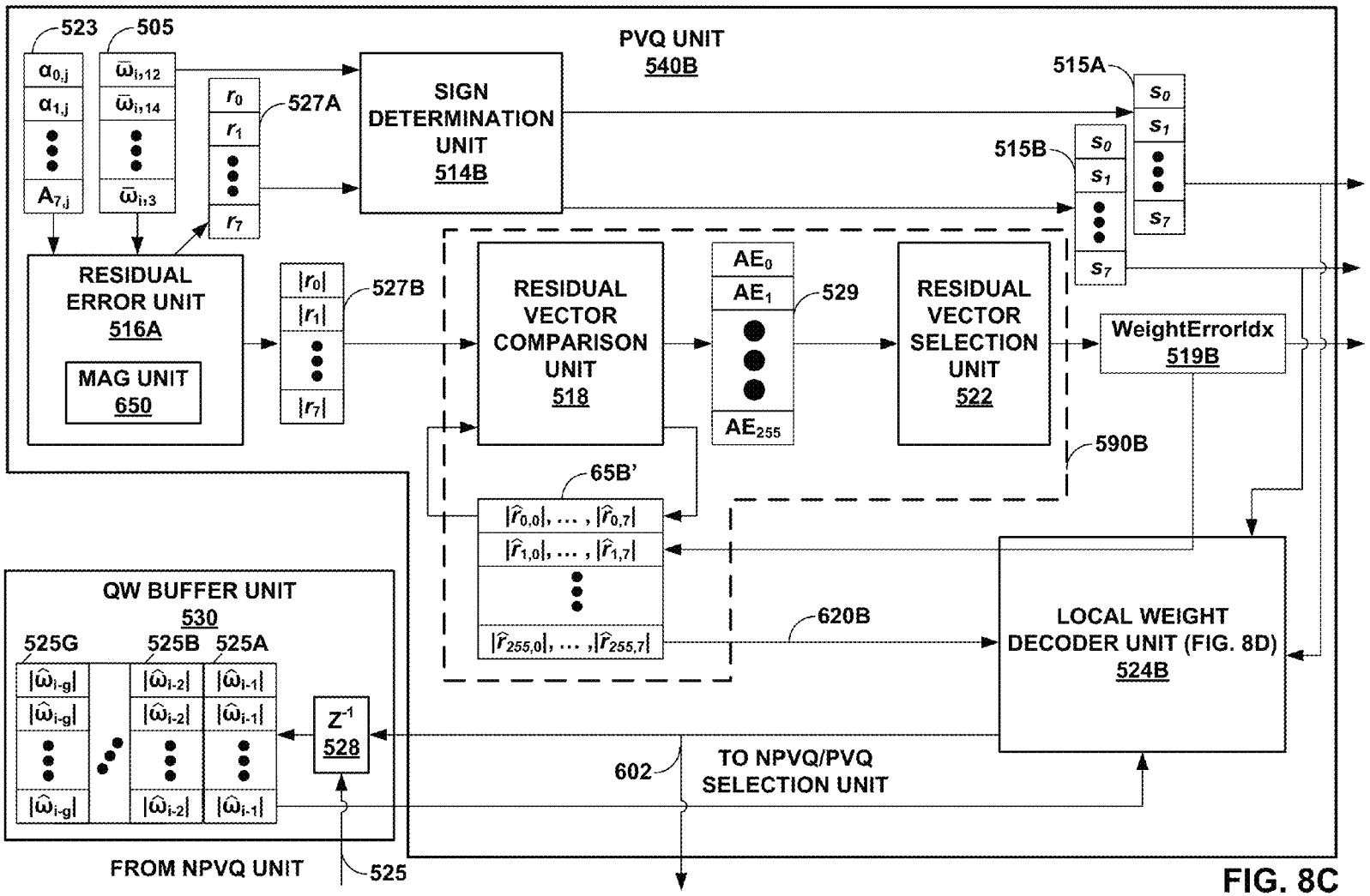

FIG. 8C is a block diagram illustrating another example of the PVQ unit 540 shown in FIG. 4. A PVQ unit 540B of FIG. 8C is similar to the PVQ unit 540A except that the PVQ unit 540B operates with respect to the absolute values of both the ordered weights 505 and the residual weight errors 527A. The absolute value of the residual weight errors 527A may be denoted as residual weight errors 527B.

Given that the residual weight errors 527B are unsigned values, the PVQ unit 540B includes a vector quantization unit 590B that performs vector quantization in a similar manner as that described above with respect to the VQ unit 590A with respect to an RBC 65B'. RBC 65B' includes the absolute values of the residual weight vectors of RBC 65B. Moreover, the PVQ unit 540B includes a sign determination unit 514B that determines sign information 515B for the residual weight errors 527A.

Figure 8D:
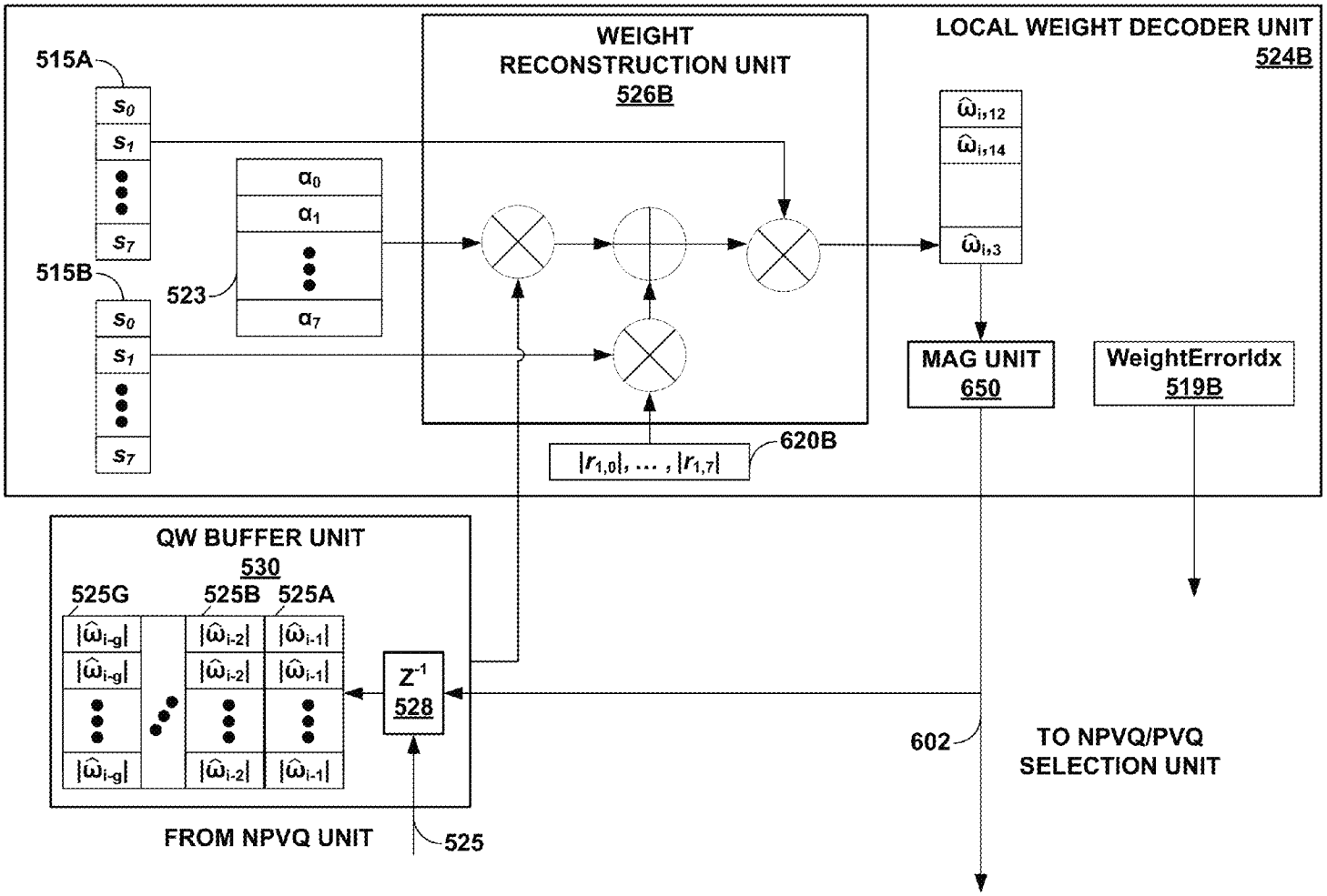

The PVQ unit 540B includes a local weight decoder unit 524B that reconstructs the weight 602 based on the selected residual vector 620B of the RCB 65B', as shown in more detail in FIG. 8C. Referring to FIG. 8D, the local weight decoder unit 524B reconstructs the weights 602 based on the sign information 515A and 515B, the weight factors 523, one of the previous reconstructed weights 525A, and the selected residual weight errors 620B.

Figure 8E:
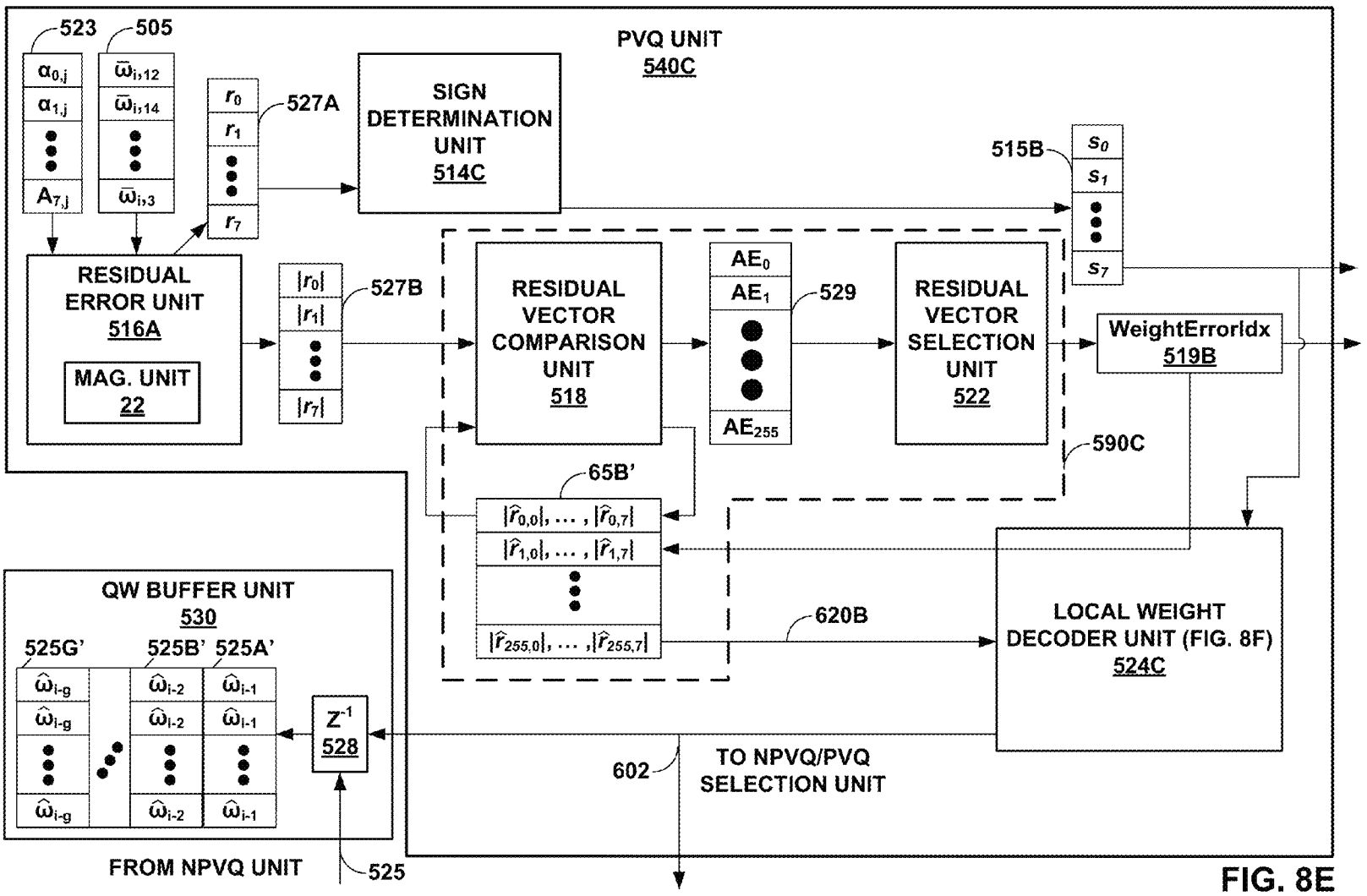

FIG. 8E is a block diagram illustrating another example of the PVQ unit 540 shown in FIG. 4. A PVQ unit 540C of FIG. 8E is similar to the PVQ unit 540B except that the PVQ unit 540C operates with respect to the signed values of the ordered weights 505 and the absolute values of the residual weight errors 527A. Again, the absolute value of the residual weight errors 527A may be denoted as residual weight errors 527B.

Given that the residual weight errors 527B are unsigned values but the ordered weight 505 are signed values, the PVQ unit 540C includes a vector quantization unit 590C that performs vector quantization in a similar manner as that described above with respect to the VQ unit 590A but with respect to an RBC 65B'. RBC 65B' includes the absolute values of the residual weight vectors of RBC 65B. Moreover, the PVQ unit 540B includes a sign determination unit 514C that only determines sign information 515B for the residual weight errors 527A.

Figure 8F:
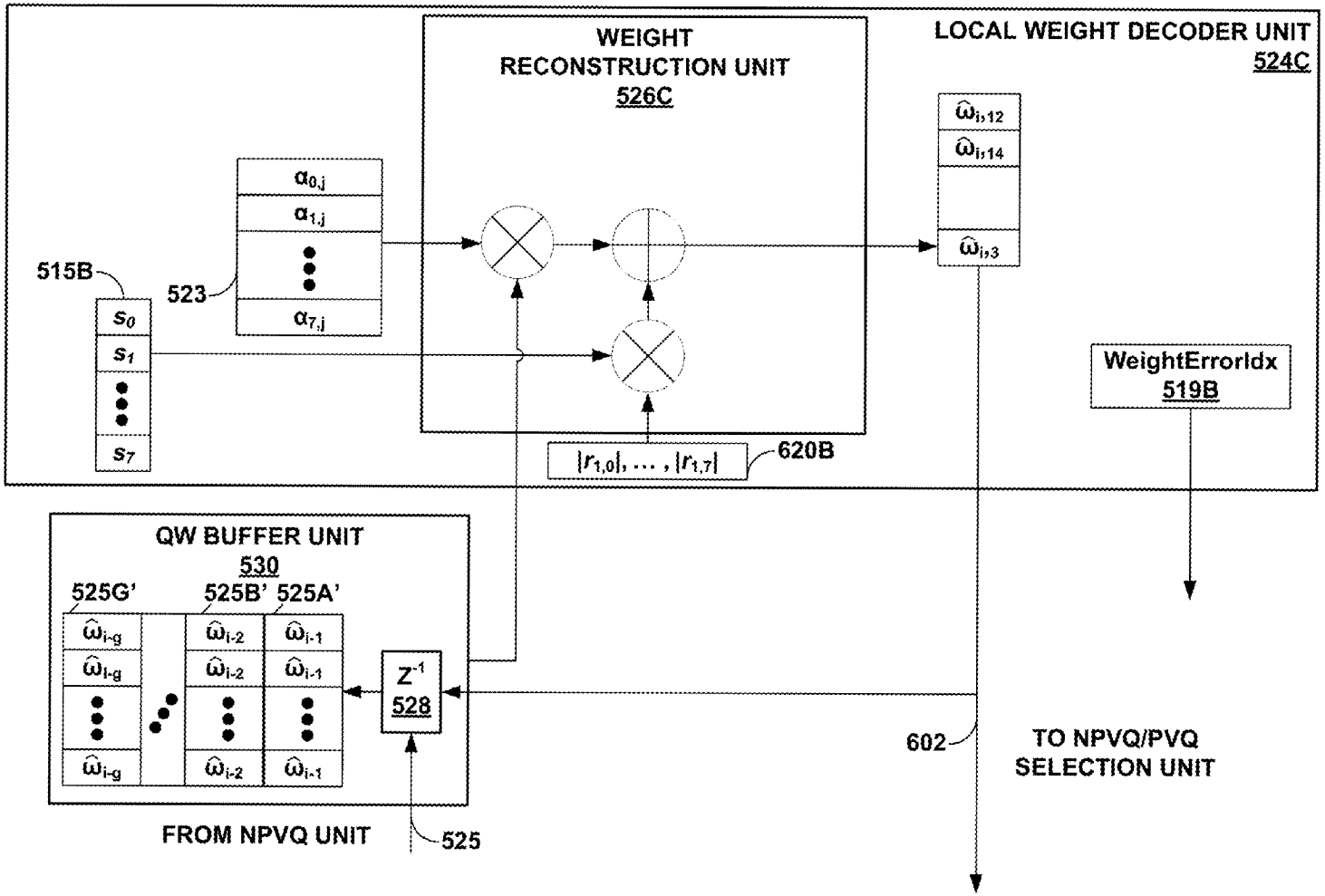

The PVQ unit 540B includes a local weight decoder unit 524C that reconstructs the weight 602 based on the selected residual vector 620B of the RCB 65B', as shown in more detail in FIG. 8F. Referring to FIG. 8F, the local weight decoder unit 524C reconstructs the weights 602 based on the sign information 515B, the weight factors 523, one of the previous reconstructed weights 525A' (where the prime 0 may denote unsigned values), and the selected residual weight errors 620B.

Figure 8G:
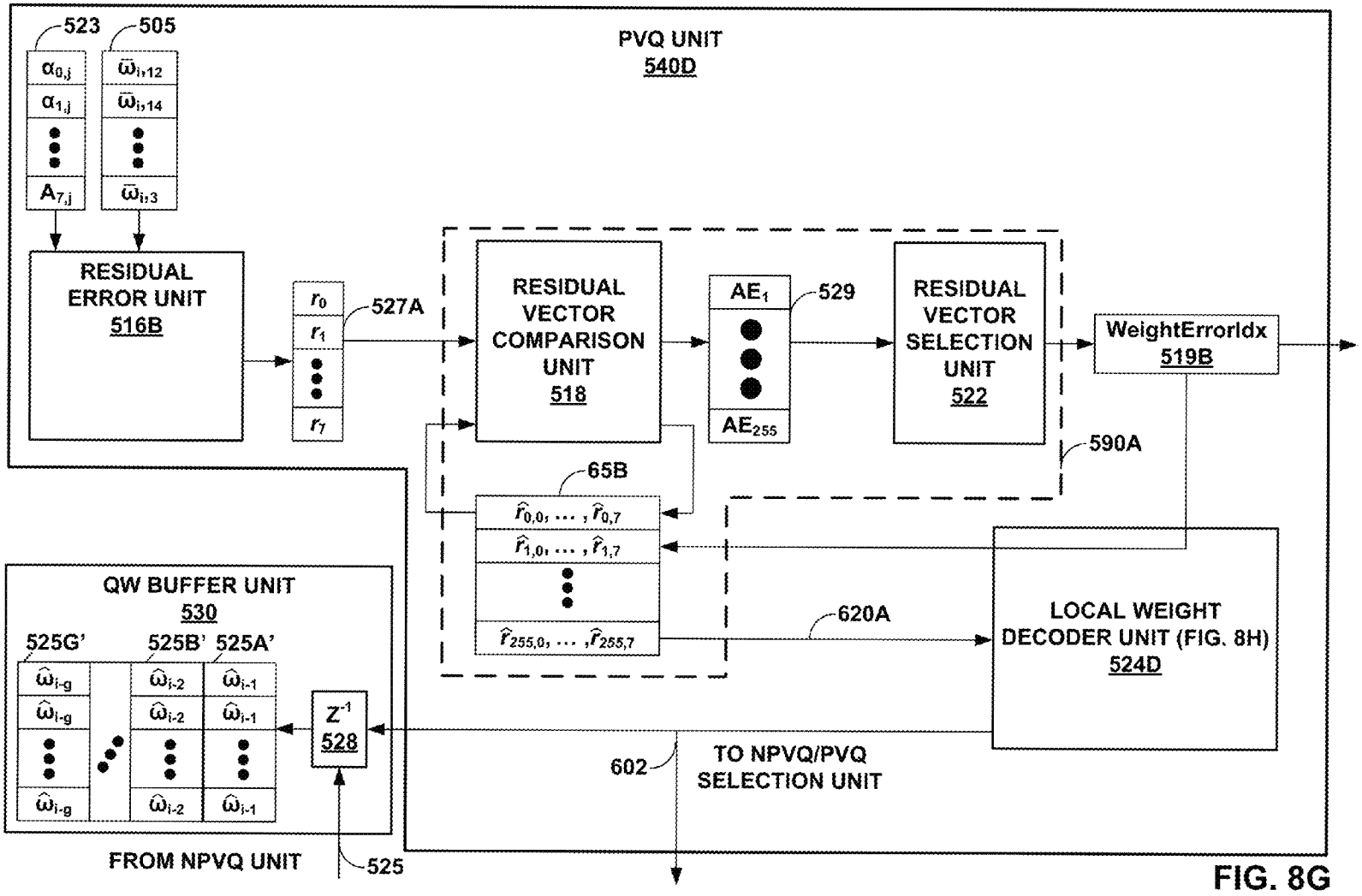

FIG. 8G is a block diagram illustrating another example of the PVQ unit 540 shown in FIG. 4. A PVQ unit 540D of FIG. 8G is similar to the PVQ unit 540C except that the PVQ unit 540D operates with respect to the signed values of the ordered weights 505 and the signed values of the residual weight errors 527A.

Given that the residual weight errors 527B are signed values and the ordered weight errors 505 are signed values, the PVQ unit 540D includes a vector quantization unit 590A that performs vector quantization in a similar manner as that described above with respect to the VQ unit 590A of the PVQ unit 540A. Moreover, the PVQ unit 540D does not include a sign determination unit 514A in that sign information is not separately quantized from the values of the residual weight errors 527A and the ordered weights 505.

Figure 8H:
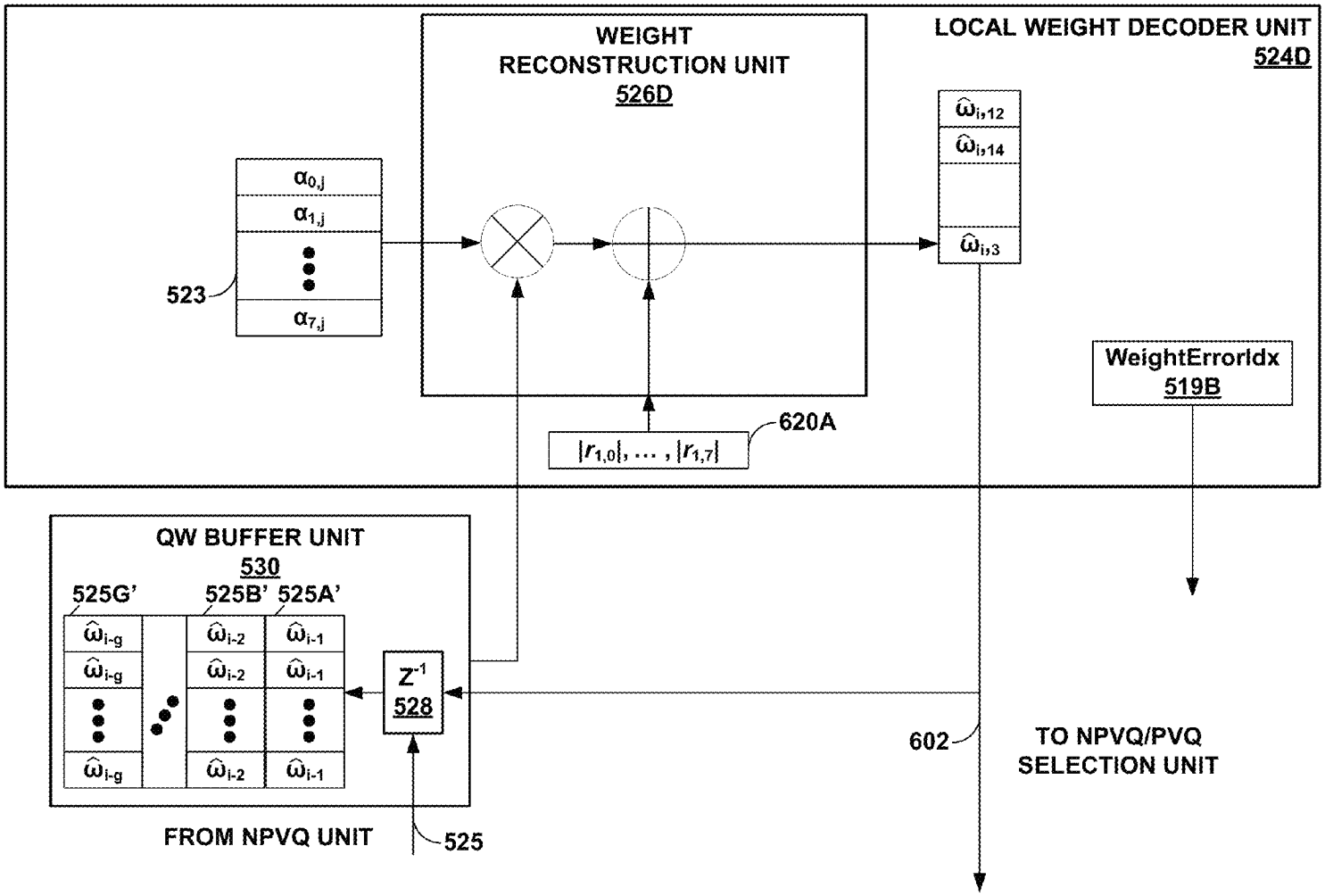

The PVQ unit 540D includes a local weight decoder unit 524D that reconstructs the weights 602 based on the selected residual vector 620A of the RCB 65B, as shown in more detail in FIG. 8F. Referring to FIG. 8H, the local weight decoder unit 524D reconstructs the weights 602 based on the weight factors 523, one of the previous reconstructed weights 525A' (where the prime 0 may denote unsigned values), and the selected residual weight errors 620B.

Returning to the example of FIG. 4, the switched-predictive vector quantization unit 560 may in this respect vector quantize weight values based on different quantization codebooks as described above. The NPVQ unit 520 may perform vector quantization according to a non-predictive vector quantization mode based on a first vector quantization codebook (e.g., WCB 65A). The PVQ unit 540 may perform vector quantization according to a predictive vector quantization mode based on a second vector quantization codebook (e.g., RCB 65B).

Each of the WCB 65A and RCBs 65B may be implemented as an array of entries where each of the entries includes a quantization codebook index and a corresponding quantization vector. Each codebook contains 256 entries (i.e., 256 indices identifying each of the 256 eight-component quantization vectors). Each of the indices in the quantization codebook may correspond to a respective one of the eight-component quantization vectors. The eight-component quantization vectors used in each of the codebooks may be different.

The number of components in each of the vector quantization residual vectors may be dependent on the number of weights (where the number of weights may be denoted by the variable Y in this disclosure) that are selected to represent a single input V-vector 55(*i*). The number of entries in the quantization codebook may be dependent upon the bit-rate of the respective vector quantization mode being used to vector quantize the weight values.

The VQ/PVQ selection unit 562 may represent a unit configured to select between the NPVQ version of the input V-vector 55(*i*) (which may be referred to as the NPVQ vector) and the PVQ version of the input V-vector 55(*i*) (which may be referred to as the PVQ vector). The NPVQ vector may be represented by syntax elements SgnVal 515, WeightIdx 519A and VvecIdx 511. The NPVQ unit 520 may also provide the reconstructed weights 600 to the NPVQ/PVQ selection unit 562. The PVQ vector may be represented by syntax elements SgnVal 515, WeightIdx 519B, and VvecIdx 511. The PVQ unit 540 may also provide the reconstructed weights 602 to the NPVQ/PVQ selection unit 562.

It should be noted that the PVQ units in FIGS. 4, 8B, 8D, 8F, and 8H have been drawn with the buffer unit 530 as having reconstructed weights 525 from an NPVQ unit or an input from a local weight decoder unit (524A, 524B, 524C or 524D). Such a configuration denotes a memory-based system as the past quantized vectors stored in memory of an audio encoding device (FIG. 3) or audio decoding device (FIG. 4) from a previous time segment (e.g a frame), the current vector quantized vector (denoted by the reconstructed weights 602) in the current time segment (e.g. a frame) may be predicted, based on a previous quantized vector with use of a predictive codebook (e.g. that store vector quantized predictive weight values or residual weight errors). The previous quantized vector being either the reconstructed weights 525 from an NPVQ unit or the reconstructed weights 525 from a local weight decoder unit (524A, 524B, 524C or 524D). However, there may be a PVQ configuration referred to as a PVQ only mode when the performing predictive vector quantization based on only using past segment (frame or sub-frame) predicted vector quantized weight vector is from the PVQ unit 540 without the ability to access any of the past vector quantized weight vectors from the NPVQ unit 520. As such, a PVQ only mode may be illustrated by previously drawn figures (FIGS. 4, 8B, 8D, 8F and 8H) without any reconstructed weights 525 from an NPVQ unit. The only input into buffer unit 530 in a PVQ only mode comes from a local weight decoder unit (524A, 524B, 524C or 524D).

Figure 9:
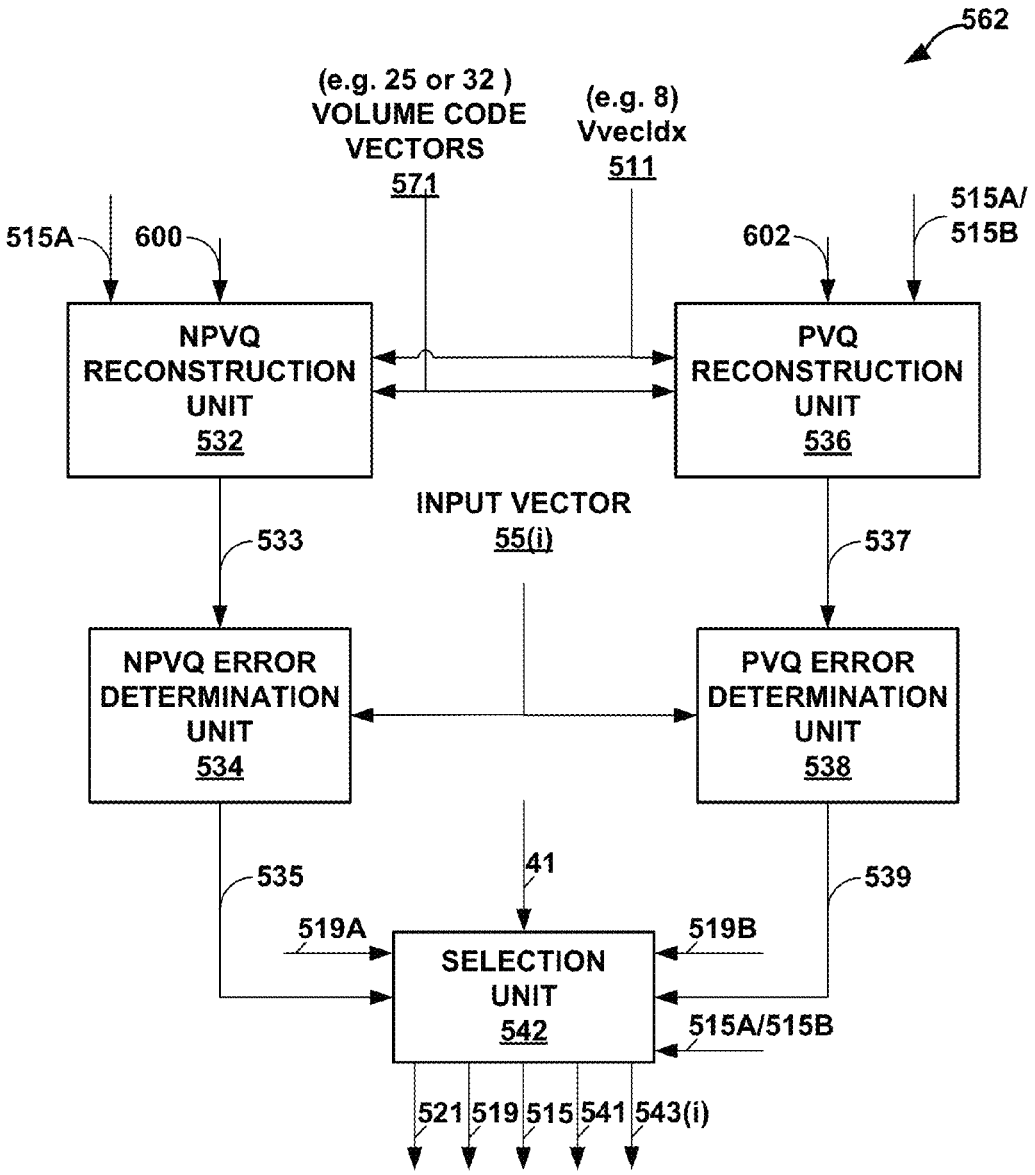
FIG. 9 is a block diagram illustrating, in more detail, the VQ/PVQ selection unit included within the switched-predictive vector quantization unit 560.

FIG. 9 is a block diagram illustrating, in more detail, the VQ/PVQ selection unit included within the switched-predictive vector quantization unit 560. The VQ/PVQ selection unit 562 includes an NPVQ reconstruction unit 532, an NPVQ error determination unit 534, a PVQ reconstruction unit 536, a PVQ error determination unit 538 and a selection unit 542.

The NPVQ reconstruction unit 532 represents a unit configured to reconstruct the input V-vector 55(*i*) based on the SgnVal syntax elements 515A indicative of the set of $\{s_j\}$, the reconstructed weights 600 that together with the SgnVal syntax elements 515A may be indicative of $\{\omega_j\}$, the VvecIdx syntax elements 511 and volume code vectors 571 that together may be indicative of $\{\omega_j\}$. The NPVQ reconstruction unit 532 may generate a quantized version of the input V-vector referred to as NPVQ vector 533 according to the above equation (10), which is reproduced (although in adjusted form to denote the quantized vector as $\hat{V}_{NPFG}$) in line for purposes of convenience $$\hat{V}_{NPFG} = \sum_{j=1}^{8} (2s_j - 1)\hat{\omega}_j\Omega_j.$$

The NPVQ reconstruction unit 532 may output the NPVQ vector 533 to the NPVQ error determination unit 534.

The NPVQ error determination unit 534 may represent a unit configured to determine a quantization error that results from quantizing the input V-vector 55(*i*). The NPVQ error determination unit 534 may determine the NPVQ quantization error according to the following equation (16):

$$\text{ERROR}_{NPVQ} = |V_{FG} - \hat{V}_{NPFG}| \tag{16}$$

where $\text{ERROR}_{NPVQ}$ denotes the NPVQ error as the absolute value of the difference between the input V-vector 55(*i*) (denoted $V_{FG}$) and the NPVQ vector 533 (denoted $\hat{V}_{NPFG}$). It should be noted that in a different configuration as illustrated with respect to FIGS. 8A-8H, for example, the absolute value is not required in equation (16). The NPVQ error determination unit 534 may output the error 535 to the selection unit 542.

The PVQ reconstruction unit 536 represents a unit configured to reconstruct the input V-vector 55(*i*) based on the SgnVal syntax elements 515 indicative of the set of $\{s_j\}$, the reconstructed weights 602 that together with the SgnVal syntax elements 515A/515B may be indicative of ($|\hat{r}_{i,j}|+\alpha_j\hat{\omega}_{i-1,j}, \hat{r}_{i,j}+\alpha_j|\hat{\omega}_{i-1,j}|, |\hat{r}_{i,j}|+\alpha_j|\hat{\omega}_{i-1,j}|$ or $\hat{r}_{i,j}+\alpha_j\hat{\omega}_{i-1,j}$) depending on which configuration is used as illustrated in FIG. 8A-8H. The VvecIdx syntax elements 511 and volume code vectors 571 that together may be indicative of $\{\Omega_j\}$. The PVQ reconstruction unit 536 may generate a quantized version of the input V-vector referred to as a PVQ vector 537 according to the above equation (14), which is reproduced (although in adjusted form to denote the quantized vector as $\hat{V}_{PFG}$) in line for purposes of convenience (to not have to expressly re-illustrate or re-iterate the various configurations throughout FIG. 8A-8H), the example with 8 weights and absolute value of the residual weight errors and absolute value of the past reconstructed weights is illustrated, $$\hat{V}_{PFG} = \sum_{j=1}^{8} (2s_j - 1)(|\hat{r}_{i,j}| + \alpha_j|\hat{\omega}_{i-1,j}|)\Omega_j.$$

The PVQ reconstruction unit 536 may output the NPVQ vector 533 to the PVQ error determination unit 538.

The PVQ error determination unit 538 may represent a unit configured to determine a quantization error that results from quantizing the input V-vector 55(*i*). The PVQ error determination unit 538 may determine the PVQ quantization error according to the following equation (16):

$$\text{ERROR}_{PVQ} = |V_{FG} - \hat{V}_{PFG}| \quad (17)$$

where $\text{ERROR}_{PVQ}$ represents a PVQ error 539 as the absolute value of the difference between the input V-vector 55(*i*) (denoted $V_{FG}$) and the PVQ vector 537 (denoted $\hat{V}_{PFG}$). It should be noted that in a different configuration as illustrated with respect to FIGS. 8A-8H, for example, the absolute value is not required in equation (17). The PVQ error determination unit 538 may output the PVQ error 539 to the selection unit 542.

In some examples, the NPVQ error determination unit 534 and the PVQ error determination unit 538 may base the errors (535 and 539) on the $\text{ERROR}_{NPVQ}$ and the $\text{ERROR}_{PVQ}$ respectively. In other words, the errors (535 and 539) may be expressed as a signal-to-noise ratio (SNR) or in any way errors are commonly represented that utilize at least in part the $\text{ERROR}_{NPVQ}$ and the $\text{ERROR}_{PVQ}$ respectively. As noted above, a mode bit D may be signaled to indicate whether NPVQ or PVQ was selected. The SNR may include this bit, which may degrade the SNR as discussed below in more detail. In instances where existing syntax elements are expanded to signal NPVQ and PVQ separately (e.g., as discussed above with respect to the NbitsQ syntax element), the SNR may improve.

The selection unit 542 may select between the NPVQ vector 533 and the PVQ vector 537 based on the target bitrate 41, the errors (535 and 539) or both the target bitrate 41 and the errors (535 and 539). The selection unit 562 may select the NPVQ vector 533 for a higher target bitrate 41 and select PVQ vector 537 for a lower relative target bitrate 41. The selection unit 542 may output the selected one of NPVQ vector 533 or the PVQ vector 537 as the VQ vector 543(*i*). The selection unit 542 may also output the corresponding one of errors (535 and 539) as the VQ error 541 (which may be denoted as $\text{ERROR}_{VQ}$). The selection unit 542 may further output the SgnVal syntax elements 515, the WeightIdx syntax elements 519A and CodebkIdx syntax element 521 for the VQ vector 543(*i*).

The selection unit 542, in selecting between the the NPVQ vector 533 or the PVQ vector 537, may effectively perform a switch between non-predictive vector dequantization to reconstruct a first set of one or more weights (and thereby determine a reconstructed first set of one or more weights), and predictive vector dequantization to reconstruct a second set of one or more weights (and thereby determine a reconstructed second set of one or more weights). The reconstructed first set of one or more weights and the reconstructed second set of one or more weights may each represent reconstructed set of one or more weights. The selection unit 542 may output the CodebkIdx syntax element 521, when VQ is selected as discussed in more detail below, to the bitstream generation unit 42 shown in FIG. 3. The bitstream generation unit 42 may then specify the quantization mode in the form of the CodebkIdx syntax element 521 indicative of the switch in the bitstream 21, which may include a representation of the V-vector.

Returning to the example of FIG. 4, the VQ/PVQ selection unit 562 may output the VQ vector 543, the VQ error 541, the SgnVal syntax elements 515, the WeightIdx syntax elements 519A and CodebkIdx syntax element 521 to the VQ/SQ selection unit 564. The VQ/SQ selection unit 564 may represent a unit configured to select between the VQ vector 543(*i*) and the SQ input V-vector 551(*i*). The VQ/SQ selection unit 564 may, similar to the VQ/PVQ selection unit 562, base the selection at least in part on the target bitrate 41, an error measurement (e.g., error measurements 541 and 553) computed with respect to each of the VQ input V-vector 543(*i*) and the SQ input V-vector 551(*i*) or a combination of the target bitrate 41 and the error measurements. The VQ/SQ selection unit 564 may output the selected one of the VQ input V-vector 543(*i*) and the SQ input V-vector 551(*i*) as a quantized V-vector 57(*i*), which may represent an i-th one of the coded foreground V[k] vectors 57. The foregoing operations may be repeated for each of the reduced foreground V[k] vectors 55, iterating through all of the reduced foreground V[k] vectors 55.

The VQ/PVQ selection unit 562 may also output selection information 565 to the buffer unit 530. The VQ/PVQ selection unit 562 may output the selection information 565 to indicate whether the quantized V-vector 57(*i*) was non-predictive vector quantized, predictive vector quantized or scalar quantized. The VQ/PVQ selection unit 562 may output the selection information 565 so that the buffer unit 530 may remove, delete or mark for deletion those of the previous reconstructed weights 525 that may be discarded.

In other words, the buffer unit 530 may mark, tag or associate data with each of the previous reconstructed weights 525A-525G ("reconstructed weights 525"). The buffer unit 530 may associate data indicative of whether each of the previous reconstructed weights 525 were NPVQ or PVQ. The buffer unit 530 may associate the data in this manner so as to identify one or more of the previous reconstructed weights 525 that were not selected by the VQ/SQ selection unit 564. Based on the selection information 565, the buffer unit 530 may remove those of the previous reconstructed weights 525 that will not be specified in vector quantized form in the bitstream 21. The buffer unit 530 may remove those not specified in vector quantized form in the bitstream 21 as the previous reconstructed weights 525 not specified in vector quantized form in the bitstream 21 are not available to the local weight decoder units 524 for use in determining the reconstructed weights 602.

Returning to the example of FIG. 3, the V-vector coding unit 52 may provide to the bitstream generation unit 42 data indicative of which quantization codebook was selected for quantizing the weights corresponding to one or more of the reduced foreground V[k] vectors 55 so that the bitstream generation unit 42 may include such data in the resulting bitstream. In some examples, the V-vector coding unit 52 may select a quantization codebook to use for each frame of HOA coefficients to be coded. In such examples, the V-vector coding unit 52 may provide data indicative of which quantization codebook was selected for quantizing weights in each frame to the bitstream generation unit 42. In some examples, the data indicative of which quantization codebook was selected may be a codebook index and/or identification value that corresponds to the selected codebook.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57 (which may also be referred to as quantized foreground V[k] vectors 57), the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21. The bitstream 21 may include a primary or main bitstream and one or more side channel bitstreams.

For NPVQ, the bitstream generation unit 42 may, when NPVQ is selected, specify a weight index for NPVQ as the WeightErrorIdx 519B in the bitstream 21. The bitstream generation unit 42 may also specify, in the bitstream 21, a plurality of V-vector indices (as the VVecIdx syntax elements 511) indicative of the volume code vectors 571 used to quantize the each of the input V-vectors 55.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, the V-vector coding unit 52 may, although not shown in the example of FIG. 3, provide weight value information to the reorder unit 34. In some examples, the weight value information may include one or more of the weight values calculated by the V-vector coding unit 52. In further examples, the weight value information may include information indicative of which weights were selected for quantization and/or coding by the V-vector coding unit 52. In additional examples, the weight value information may include information indicative of which weights were not selected for quantization and/or coding by the V-vector coding unit 52. The weight value information may include any combination of any of the above-mentioned information items as well as other items in addition to or in lieu of the above-mentioned information items.

In some examples, the reorder unit 34 may reorder the vectors based on the weight value information (e.g., based on the weight values). In examples where the V-vector coding unit 52 selects a subset of the weight values to quantize and/or code, the reorder unit 34 may, in some examples, reorder the vectors based on which of the weight values were selected for quantizing or coding (which may be indicated by the weight value information).

Figure 10:
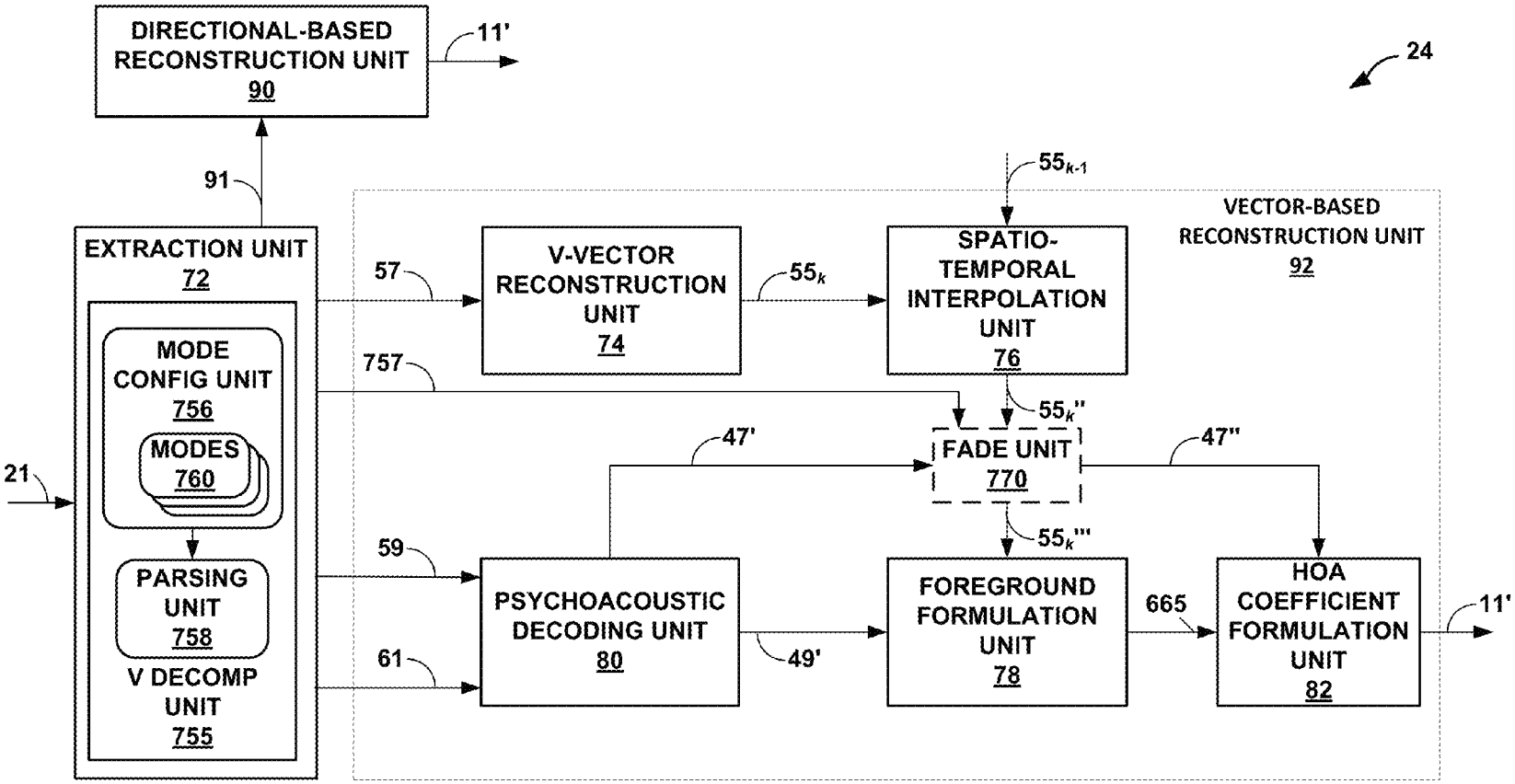
FIG. 10 is block diagram illustrating the audio decoding device of FIG. 2 in more detail.

FIG. 10 is a block diagram illustrating the audio decoding device 24 of FIG. 2 in more detail. As shown in the example of FIG. 4 the audio decoding device 24 may include an extraction unit 72, a directional-based reconstruction unit 90 and a vector-based reconstruction unit 92.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (in the example of FIG. 3), passing the directional-based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may operate so as to extract syntax elements and values for use by the vector-based reconstruction unit 92 in reconstructing the HOA coefficients 11. The vector-based reconstruction unit 92 may represent a unit configured to reconstruct the V-vectors from the encoded foreground V[k] vectors 57. The vector-based reconstruction unit 92 may operate in a manner reciprocal to that of the quantization unit 52. The vector-based reconstruction unit 92 includes a V-vector reconstruction unit 74, a spatio-temporal interpolation unit 76, a psychoacoustic decoding unit 80, a foreground formulation unit 78, an HOA coefficient formulation unit 82 and a fade unit 770.

The extraction unit 72 may extract the coded foreground V[k] vectors (which may include indices alone or the indices and a mode bit) in a higher order ambisonic domain, the encoded ambient HOA coefficients 59 and the encoded nFG signals 61. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

To extract the coded foreground V[k] vectors 57 (which may also be referred to as the "quantized V-vector 57" or as the "representation of the V-vector 55"), the encoded ambient HOA coefficients 59 and the encoded nFG signals 61, the extraction unit 72 may obtain an HOADecoderConfig container that includes, which includes the syntax element denoted CodedVVecLength. The extraction unit 72 may parse the CodedVVecLength from the HOADecoderConfig container. The extraction unit 72 may be configured to operate in any one of the above described configuration modes based on the CodedVVecLength syntax element.

In some examples, the extraction unit 72 may operate in accordance with the switch statement presented in the pseudo-code in section 12.4.1.9.1 of the above referenced MPEG-H 3D Audio Standard with the syntax presented in the following syntax table for VVectorData as understood in view of the accompanying semantics:

| Syntax | No. of bits | Mnemonic |
|---|---|---|
| VVectorData(i) | | |
| { | | |
| if (NbitsQ(k)[i] == 4){ | | |
| NumVvecIndices = CodebkIdx(k)[i] +1; | | |
| If (CodebkIdx(k)[i] == 0) { | | |
| VvecIdx[0] = VvecIdx + 1; | 10 | uimsbf |
| WeightVal[0] = ((SgnVal*2)−1); | 1 | uimsbf |
| AbsoluteWeightVal[k][0] = 1; | | |
| } elseif (CodebkIdx(k)[i] == 1) { | | |
| WeightIdx; | 8 | uimsbf |
| nbitsIdx = ceil(log2(NumOfHoaCoeffs)); | | |
| for (j=0; j< NumVvecIndices; ++j) { | | |
| VvecIdx[j] = VvecIdx + 1; | nbitsIdx | uimsbf |
| WeightVal[j] = ((SgnVal*2)−1) * | 1 | uimsbf |
| WeightValCdbk[CodebkIdx(k)[i]][WeightIdx][j]; | | |
| AbsoluteWeightVal[k][j] = \| WeightVal[j] \|; | | |
| } | | |
| } elseif (CodebkIdx(k)[i] == 2) { | | |
| WeightErrorIdx; | 8 | uimsbf |
| nbitsIdx = ceil(log2(NumOfHoaCoeffs)); | | |
| for (j=0; j< NumVvecIndices; ++j) { | | |
| VvecIdx[j] = VvecIdx + 1; | nbitsIdx | uimsbf |
| WeightVal[j] = ((SgnVal*2)−1) * | 1 | uimsbf |
| WeightValPredictiveCdbk[CodebkIdx(k)[i]][WeightErrorIdx][j] + | | |
| alphaVvec[j] * AbsoluteWeightVal[k−1][j]; | | |
| } | | |
| } | | |
| for (j= NumVvecIndices+1; j< NumOfHoaCoeffs; ++j) | | |
| AbsoluteWeightVal[k][j] = 0; | | |
| } | | |
| elseif (NbitsQ(k)[i] == 5){ | | |
| for (m=0; m< VVecLength; ++m){ | | |
| aVal[i][m] = (VecVal / 128.0) − 1.0; | 8 | uimsbf |
| } | | |
| elseif(NbitsQ(k)[i] >= 6){ | | |
| for (m=0; m< VVecLength; ++m){ | | |
| huffIdx = huffSelect(VVecCoeffId[m], PFlag[i], CbFlag[i]); | | |
| cid = huffDecode(NbitsQ[i], huffIdx, huffVal); | dynamic | huffDecode |
| aVal[i][m] = 0.0; | | |
| if ( cid > 0 ) { | | |
| aVal[i][m] = sgn = (sgnVal * 2) − 1; | 1 | bslbf |
| if (cid > 1) { | | |
| aVal[i][m] = sgn * (2.0^(cid −1) + intAddVal); | cid − 1 | uimsbf |
| } | | |
| } | | |
| } | | |
| } | | |
| } | | |

NOTE:
See section 11.4.1.9.1 for computation of VVecLength

VVectorData(VecSigChannelIds(i))

This structure contains the coded V-vector data used for the vector-based signal synthesis.

VVec(k)[i] This is the V-vector for the k-th HOAframe( ) for the i-th channel.

VVecLength This variable indicates the number of vector elements to read out.

VVecCoeffId This vector contains the indices of the transmitted V-vector coefficients.

VecVal An integer value between 0 and 255.

aVal A temporary variable used during decoding of the VVectorData.

huffVal A Huffman code word, to be Huffman-decoded.

sgnVal This is the coded sign value used during decoding.

intAddVal This is additional integer value used during decoding.

NumVecIndices The number of vectors used to dequantise a vector-quantised V-vector.

WeightIdx The index in WeightValCdbk used to dequantise a vector-quantised V-vector.

WeightErrorIdx The index in WeightValPredictiveCdbk used to dequantise a vector-quantised V-vector based on techniques described and illustrated previously with respect to the various PVQ units (e.g. 540A-540D) above.

nbitsW Field size for reading WeightIdx to decode a vector-quantised V-vector.

WeightValCdbk Codebook which contains a vector of positive real-valued weighting coefficients. If NumVecIndices is set to 1, the WeightValCdbk with 16 entries is used, otherwise the WeightValCdbk with 256 entries is used.

WeightValPredictiveCdbk Codebook which contains a vector of positive real-valued weighting residual coefficients. If NumVecIndices is set to 1, the WeightValCdbk with 16 entries is used, otherwise the WeightValCdbk with 256 entries is used.

VvecIdx An index for VecDict, used to dequantise a vector-quantised V-vector.

nbitsIdx Field size for reading individual VvecIdxs to decode a vector-quantised V-vector.

WeightVal A real-valued weighting coefficient to decode a vector-quantised V-vector.

AbsoluteWeightVal The absolute value of WeightVal.

Though the syntax elements AbsoluteWeightVal, WeightValPredicitiveCdbk, and WeightErrorIdx are described and expressly illustrated with respect to the syntax table above (and the alternative syntax table illustrated based on nbitQ equaling 3), different names may be used to reflect that other configurations such as discussed with respect to other aspects in FIGS. 8A-8H and other figures, for example. Moreover, in such configurations where the absolute value is not used, the syntax above may accordingly have a different form. As such, though some of the text below with respect to the syntax table above and the alternative syntax below is described with respect to the absolute value of the weight value(s), the description below describing elements of the syntax table illustrated may also be applicable to the configurations discussed with respect to other aspects of FIGS. 8A-8H, and other figures, for example.

The extraction unit 72 may parse the bitstream 21 to obtain the VVectorData for the ith V-vector (which is shown as VVectorData(i)). The quantized V-vector 57(*i*) may correspond, at least in part, to the VVectorData(i). Prior to extracting the VVectorData, the extraction unit 72 may extract, from the bitstream 21, a quantization mode, which as noted above may, as one example, correspond to a NbitsQ syntax element for the kth audio frame and the ith one of the quantized vectors 57 (denoted NbitsQ(k)[i] in the above syntax table). The extraction unit 72 may, based on the NbitsQ syntax element, first determine whether vector quantization was performed by determining whether NbitsQ(k)[i] equals four.

When the NbitsQ[k](i) equals four, the extraction unit 72 sets the NumVvecIndices syntax element equal to the CodebkIdx syntax element for the kth audio frame and the ith one of the quantized vectors 57 (denoted CodebkIdx(k)[i]). In this respect, the number of V-vector indices may be equal to the number of codebook indices.

The extraction unit 72 may then determine whether the CodebkIdx(k)[i] syntax element is equal to zero. When the CodebkIdx(k)[i] syntax element is equal to zero, a single V-vector index is specified and used to access table F.11. The extraction unit 72 may extract both a single 10-bit VvecIdx syntax element and a one-bit SgnVal syntax element from the bitstream 21. The extraction unit 72 may set the VvecIdx [0] syntax element to the parsed VvecIdx syntax element. The extraction unit 72 may also set the WeightVal[0] syntax element based on the SgnVal syntax element (i.e., equal to ((SgnVal*2)−1) in the above exemplary syntax table). The extraction unit 72 may effectively set the WeightVal[0] to a value of −1 or 1 based on the SgnVal syntax element. The extraction unit 72 may also set the AbsoluteWeightVal[k][0] to a value of one (which is effectively the absolute value of the WeightVal[0] syntax element given that the WeightVal [0] syntax element can only be a value of −1 or 1).

When the CodebkIdx(k)[i] syntax element is not equal to zero, the extraction unit 72 may determine whether the CodebkIdx(k)[i] syntax element is equal to one. When the CodebkIdx(k)[i] syntax element is equal to one, the extraction unit 72 may extract an 8-bit WeightIdx syntax element from the bitstream 21. The extraction unit 72 may also set the nbitsIdx syntax element to a value of the mathematical ceiling function (ceil) of the base two log ($\log_2$) of the number of HOA coefficients (which is represented by the "NumOfHoaCoeffs" syntax element and is equal to the order (N) plus one squared $(N+1)^2$).

The extraction unit 72 may next iterate through the number of V-vector indices. For each of the V-vector indices, the extraction unit 72 may extract a VvecIdx syntax element and a SgnVal syntax element. In effect, the extraction unit 72 may extract one of the 8 VvecIdx syntax elements 511 and one of the 8 SgnVal syntax elements 515. Although described herein with respect to 8 VvecIdx syntax elements 511 and 8 SgnVal syntax elements 515, any number of VvecIdx syntax elements 511 and SgnVal syntax elements 515 may be extracted from the bitstream 21 up to J. In each iteration, the extraction unit 72 may set the jth element of the VvecIdx[ ] array to the value of the VvecIdx syntax element plus one. Although shown as being performed by the extraction unit 72, the V-vector reconstruction unit 74 may determine WeightVal[ ] array and the AbsoluteWeightVal[ ][ ] array. As such, the extraction unit 72 may set a SgnVal[ ] array to the SgnVal during each iteration.

When the CodebkIdx(k)[i] syntax element is not equal to one, the extraction unit 72 may determine whether the CodebkIdx(k)[i] syntax element is equal to two. When the CodebkIdx(k)[i] syntax element is equal to two, the extraction unit 72 may extract an 8-bit WeightErrorIdx syntax element 519B from the bitstream 21. In this respect, the extraction unit 72 may extract, from the bitstream 21, a weight index 519B referred to as "WeightErrorIdx" in this example. The extraction unit 72 may also set the nbitsIdx syntax element to a value of the mathematical ceiling function (ceil) of the base two log ($\log_2$) of the number of HOA coefficients (which is represented by the "NumOfHoaCoeffs" syntax element and is equal to the order (N) plus one squared $(N+1)^2$).

The extraction unit 72 may next iterate through the number of V-vector indices. For each of the V-vector indices, the extraction unit 72 extracts a VvecIdx syntax element and a SgnVal syntax element. The extraction unit 72 may extract one of the 8 VvecIdx syntax elements 511 and one of the 8 SgnVal syntax elements 515. Although described herein with respect to 8 VvecIdx syntax elements 511 and 8 SgnVal syntax elements 515, any number of VvecIdx syntax elements 511 and SgnVal syntax elements 515 may be extracted from the bitstream 21 up to J.

In each iteration, the extraction unit 72 may set the jth element of the VvecIdx[ ] array to the value of the VvecIdx syntax element plus one. In this manner, the extraction unit 72 may extract, from the bitstream 21, the plurality of V-vector indices 511, which may be represented by the 8 VvecIdx syntax elements 511 in this example. Although shown as being performed by the extraction unit 72, the V-vector reconstruction unit 74 may determine WeightVal[ ] array and the AbsoluteWeightVal[ ][ ] array. As such, the extraction unit 72 may set a SgnVal[ ] array to the SgnVal during each iteration.

The extraction unit 72 may also iterate from the number of V-vector indices through the total number of HOA coefficients, setting the AbsoluteWeightVal[ ][ ] array to zero. Again, the V-vector reconstruction unit 74 may instead perform this operation. The remaining AbsoluteWeightVal[ ][ ] array entries are set to zero for purposes of prediction. The extraction unit 72 may then proceed to consider whether scalar quantization is to be performed (i.e., when NbitsQ(k)[i] is equal to five in the example of the above syntax table) and whether scalar quantization with Huffman coding is to be performed (i.e., when NbitsQ(k)[i] is equal to or greater than six in the example of the above syntax table). More information regarding scalar quantization is available in the above referenced International Patent Application Publication No. WO 2014/194099, entitled "INTERPOLATION FOR DECOMPOSED REPRESENTATIONS OF A SOUND FIELD," filed 29 May, 2014. The extraction unit 72 may in this manner provide the syntax elements representative of the quantized vector 57 to the V-vector reconstruction unit 74.

In the alternative example where there are 14 quantization modes discussed above, a different syntax table for the VVectorData(i) including an 'if' statement for "NbitsQ(k)[i]==3" when the NbitsQ syntax element with a value of three may indicate predictive vector quantization is to be performed. The NbitsQ syntax element with a value equal to four, in this alternative, may indicate non-predictive vector quantization is to be performed. This following syntax table represents this alternative example.

```
Syntax                                                          No. of bits Mnemonic
VVectorData(i)
{
   if (NbitsQ(k)[i] == 3){
       NumVvecIndices = CodebkIdx(k)[i] +2;
        WeighErrortIdx;                                              8      uimsbf
        nbitsIdx = ceil(log2(NumOfHoaCoeffs));
        for (j=0; j< NumVvecIndices; ++j) {
            VvecIdx[j] = VvecIdx + 1;                             nbitsIdx  uimsbf
            WeightVal[j] = ((SgnVal*2)−1) *                          1      uimsbf
WeightValPredictiveCdbk[CodebkIdx(k)[i]][WeightErrorIdx][j] +
alphaVvec[j] * AbsoluteWeightVal[k−1][j];
        }
   if (NbitsQ(k)[i] == 4){
       NumVvecIndices = CodebkIdx(k)[i] +1;
        If (CodebkIdx(k)[i] == 0) {
                VvecIdx[0] = VvecIdx + 1;                            10     uimsbf
                WeightVal[0] = ((SgnVal*2)−1);                        1     uimsbf
                AbsoluteWeightVal[k][0] = 1;
         } elseif (CodebkIdx(k)[i] == 1) {
                WeightIdx;                                            8     uimsbf
                nbitsIdx = ceil(log2(NumOfHoaCoeffs));
                for (j=0; j< NumVvecIndices; ++j) {
                    VvecIdx[j] = VvecIdx + 1;                     nbitsIdx  uimsbf
                    WeightVal[j] = ((SgnVal*2)−1) *                   1     uimsbf
                        WeightValCdbk[CodebkIdx(k)[i]][WeightIdx][j];
                        AbsoluteWeightVal[k][j] = | WeightVal[j] |;
                }
        }
        for (j= NumVvecIndices+1; j< NumOfHoaCoeffs; ++j)
                AbsoluteWeightVal[k][j] = 0;
   }
    elseif (NbitsQ(k)[i] == 5){
        for (m=0; m< VVecLength; ++m){
            aVal[i][m] = (VecVal / 128.0) − 1.0;                     8      uimsbf
   }
   elseif(NbitsQ(k)[i] >= 6){
        for (m=0; m< VVecLength; ++m){
            huffIdx = huffSelect(VVecCoeffId[m], PFlag[i], CbFlag[i]);
            cid = huffDecode(NbitsQ[i], huffIdx, huffVal);        dynamic  huffDecode
            aVal[i][m] = 0.0;
            if ( cid > 0 ) {
                aVal[i][m] = sgn = (sgnVal * 2) − 1;                 1      bslbf
                if (cid > 1) {
                    aVal[i][m] = sgn * (2.0^(cid −1) + intAddVal);  cid − 1  uimsbf
                }
            }
        }
   }
}
```

Figure 11:
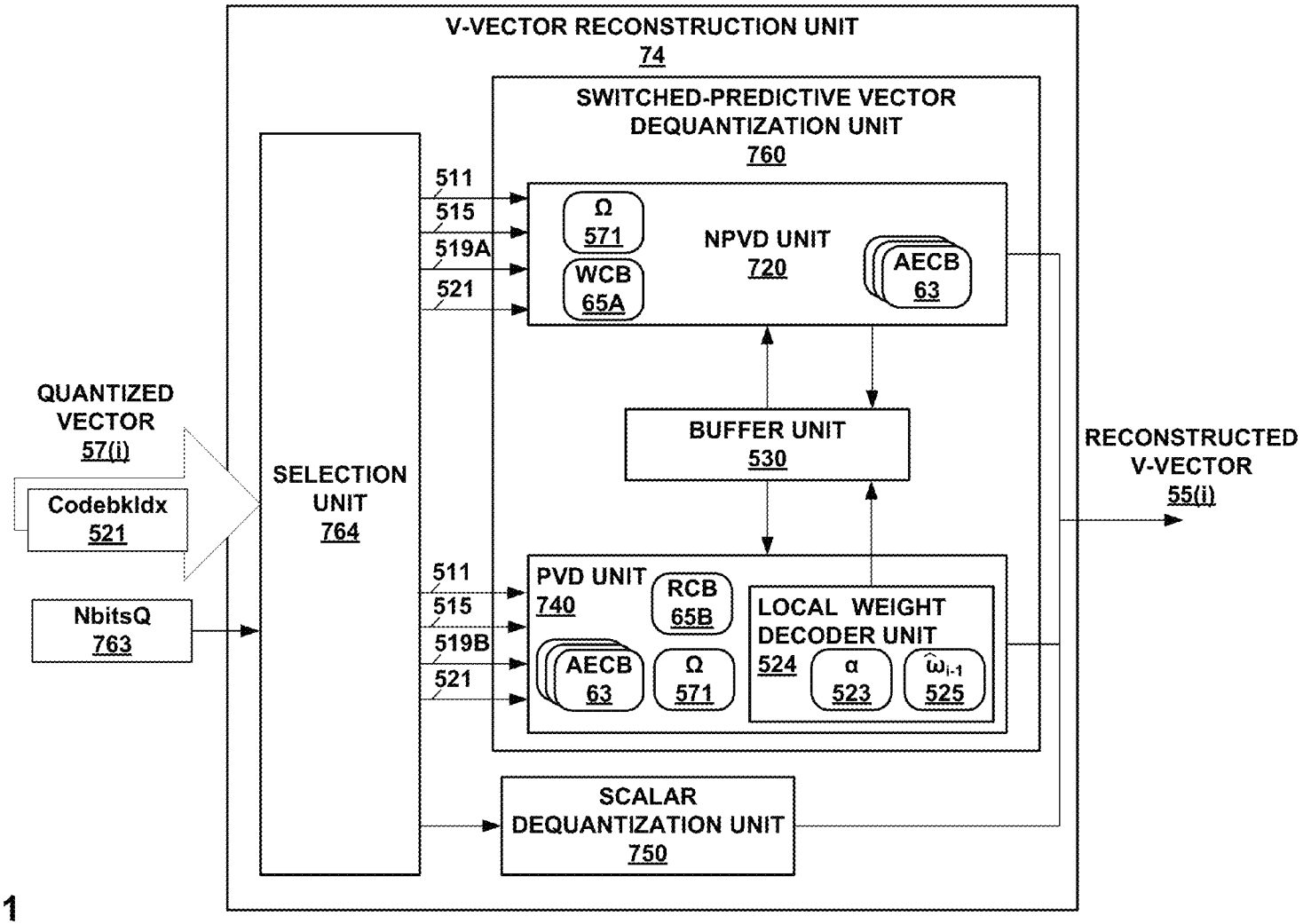
FIG. 11 is a diagram illustrating the V-vector reconstruction unit of the audio decoding device shown in the example of FIG. 4 in more detail.

FIG. 11 is a diagram illustrating, in more detail, the V-vector reconstruction unit of the audio decoding device shown in the example of FIG. 4. The V-vector reconstruction unit 74 may include a selection unit 764, a switched-predictive vector dequantization unit 760, and a scalar dequantization unit 750.

The selection unit 764 may represent a unit configured to select whether to perform non-predictive vector dequantization, predictive vector dequantization or scalar dequantization is to be performed with respect to a quantized V-vector 57(*i*) based on selection bits. The selection bits may represent, in one example, the NbitsQ syntax element. In another example, the selection bits may represent the NbitsQ syntax element and a mode bit, as discussed above. In some examples, the selection bits may represent a CodebkIdx syntax element in addition to the NbitsQ syntax element. As such, the selection bits are shown in the example of FIG. 11 as CodebkIdx 521 and NbitsQ syntax element 763. The CodebkIdx syntax element 521 is shown within the arrow representative of the quantized V-vector 57(*i*) as the quantized V-vector 57(*i*) may include, as one of the syntax elements representative of the quantized V-vector 57(*i*), the CodebkIdx syntax element 521.

When the NbitsQ syntax element equals four, the selection unit 764 may determine that vector quantization was performed. The selection unit 764 next determines the value of the CodebkIdx 521 syntax element to determine whether non-predictive or predictive vector quantization was performed. When the CodebkIdx 521 equals zero or one, the selection unit 764 determines that the quantized V-vector 57(*i*) has been non-predictive vector quantized. When the quantized V-vector 57(*i*) is determined to be non-predictive vector quantized, the selection unit 764 forwards the VvecIdx syntax elements(s) 511, the SgnVal syntax element(s)

515, the WeightIdx syntax element 519A to a non-predictive vector dequantization (NPVD) unit 720 of the switched-predictive vector dequantization unit 760.

When the CodebkIdx 521 equals two, the selection unit 764 determines that the quantized V-vector 57(*i*) has been predictive vector quantized. When the quantized V-vector 57(*i*) is determined to be predictive vector quantized, the selection unit 764 forwards the VvecIdx syntax elements(s) 511, the SgnVal syntax element(s) 515, the WeightIdx syntax element 519B to a predictive vector dequantization (PVD) unit 740 of the switched-predictive vector dequantization unit 760. Any combination of the syntax elements 511, 515 and 519B may represent data indicative of the weight values.

When the NbitsQ syntax element 763 equals five or six, the selection unit 764 determines that scalar quantization or scalar quantization with Huffman coding was performed. The selection unit 764 may then forward the quantized V-vector 57(*i*) to the scalar dequantization unit 750.

The switched-predictive vector quantization unit 760 may represent a unit configured to perform one or both of NPVD or PVD. The switched-predictive vector dequantization unit 760 may perform non-predictive vector dequantization for every frame of an entire bitstream or for only some subset of the frames of the entire bitstream. A frame may represent one example of a time segment. Another example of a time segment may represent a sub-frame. The switched-predictive vector dequantization unit 760 may perform predictive vector dequantization for every frame of an entire bitstream or for only some subset of the frames of the entire bitstream.

In some instances, the switched-predictive vector dequantization unit 760 may switch between non-predictive vector dequantization (NPVD) and predictive vector dequantization (PVD) on a frame-by-frame basis for any given bitstream. That is, the switched-predictive vector dequantization unit 760 may switch between NPVD to reconstruct a first set of one or more weights and PVD to reconstruct a second set of one or more weights. When operating on a frame-by-frame (or sub-frame by sub-frame) basis, the switched-predictive vector dequantization unit 760 may perform NPVD with respect to L number of frames followed by performing PVD with respect to the next P audio frames. In other words, operating on a frame-by-frame (or sub-frame by sub-frame) basis does not necessarily imply that the switch occurs for each frame (or sub-frame), but that there is a switch between NPVD and PVD for at least one frame in the bitstream 21.

The switched-predictive vector dequantization unit 760 may receive the CodebkIdx syntax element 521 extracted from the bitstream by the extraction unit 72. The CodebkIdx syntax element 521 may in some examples be indicative of a quantization mode in that the CodebkIdx syntax element 521 distinguishes between two or more vector quantization modes. The switched-predictive vector dequantization unit 760 may, in this respect, represent a unit configured to switch, based on the quantization mode represented by the CodebkIdx syntax element 521, between non-predictive vector dequantization to reconstruct the first set of one or more weights, and predictive vector dequantization to reconstruct a second set of one or more weights.

As shown in the example of FIG. 11, the switched-predictive vector dequantization unit 760 may include a non-predictive vector dequantization (NPVD) unit 720 configured to perform the non-predictive vector dequantization. The switched-predictive vector dequantization unit 760 may also include the predictive vector dequantization (PVD) unit 740 configured to perform the predictive vector dequantization. The switched-predictive vector dequantization unit 760 may also include a buffer unit 530 that is substantially similar to the buffer unit 530 described above with respect to the switched-predictive vector quantization unit 560.

It should be noted that the switching between VQ and PVQ configurations within the HoA vector based framework described in this disclosure may include the descriptions associated with FIGS. 10 and 11, and it should be readily understood that PVQ only mode and VQ only mode described previously apply to the NPVD unit 720 and PVD unit 740, i.e., in PVQ only mode the PVD unit 740 does not reconstruct weights based on past weight vectors that were decoded previously from the NPVD unit 720. Similarly, in VQ only mode the NPVD unit 720 provides reconstructed weights to buffer unit 530 in the switched-predictive vector dequantization unit 760 that were not reconstructed from the PVD unit 740.

Moreover, the switched-predictive vector quantization generally described may be referred to as SPVQ mode enabled. Furthermore, there may be switching between scalar quantization and either a VQ configuration, a PVQ configuration, or SPVQ enabled mode within the HoA vector based decomposition framework. As described above, there may be different type of quantization modes specified into the bitstream at the encoder previously described, and then extracted from the bitstream at a decoder device. There may be different ways as described above to be able to have a PVQ mode or NPVQ mode and switch back and forth. As an example, a vector quantization mode may be signalled and an additional nvq/pvq selection syntax elements may be used to specific the type of quantization mode in the bitstream. Alternating the value of nvq/pvq selection syntax element may be a way to implement an SPVQ mode enabled operation. As the vector quantization would switch between VQ and PVQ quantization.

Alternatively, a different implementation could be that a PVQ quantization mode (e.g. NbitsQ==3) is specified in the bistream during one or more frames. Once the encoder previously described wanted to switch to a VQ quantization mode (e.g. Nbits Q===4), a different type of vector quantization could be specified in the bitsream and then extracted from the bitstream at a decoder device. As such, this is a different way in which switching between a PVQ mode and NPVQ mode may be used to implement an QPVQ mode enabled operation.

The NPVD unit 720 may perform vector dequantization in a manner reciprocal to that described above with respect to the NPVQ unit 520. That is, the NPVD unit 720 may receive the VvecIdx syntax elements(s) 511, the SgnVal syntax element(s) 515, and the WeightIdx syntax element 519A. The NPVD unit 720 may identify one of the the AECB 63 based on the CodebkIdx syntax element 521 and perform the above noted conversion to generate the 32 volume code vectors 571. The code vectors may, as described above, be stored as a volume code vector codebook (VCVCBs). The 32 volume code vectors 571 may be denoted Ω.

The NPVD unit 720 may next reconstruct the WeightVal[ ] array in the manner shown in the above VVectorData (i) syntax table. The NPVD unit 720 may determine the weight as a function, at least in part, of the SgnVal, the CodebkIdx syntax element 521A and the WeightIdx syntax element 519A. The NPVD unit 720 may retrieve one of the WCBs 65A based on the CodebkIdx syntax element 521. The NPVD unit 720 may next obtain the quantized weights from the WCB 65A based on the WeightIdx syntax element 519A, which are denoted in the above equations as $\hat{\omega}$. The NPVD unit 720 may then reconstruct the weights according to the following equation:

$$\text{WeightVal}[j]=((\text{SgnVal}*2)-1)*\text{WeightValCdbk}[\text{CodebkIdx}(k)[i]][\text{WeightIdx}][j] \quad (18)$$

The NPVD unit 720 may, after reconstructing the weights as a function of the ((SgnVal*2)−1) times the quantized weights from the WCB 65A, reconstruct the V-vector 55(*i*) based on the following equation:

$$\hat{V}_{FG} = \sum_{i=1}^{I} \hat{\omega}_i \Omega_i \quad (19)$$

where $\hat{V}_{FG}$ V denotes the reconstructed V-vector 55(*i*), $\hat{\omega}_i$ denotes the ith reconstructed weight, $\Omega_i$ denotes the corresponding ith code vector and I denotes the number of the VVecIdx syntax elements 511. The NPVD unit 720 may output the reconstructed V-vector 55(*i*).

For ease of readability and convenience the remainder of the disclosure may use the terms, AbsoluteWeightVal, WeightValPredicitiveCdbk, and WeightErrorIdx or mathematical notations of variables in terms of absolute value; however, different names may be used to reflect that other configurations such as discussed with respect to other aspects in FIGS. 8A-8H and other figures, for example. Moreover, in such configurations where the absolute value is not used, the terms, variables and labels may accordingly have a different form or name. As such, though some of the description below is described with respect to the absolute value of the weight value(s), the weight values may also be applicable to the configurations discussed with respect to other aspects of FIGS. 8A-8H, and other figures, for example.

The PVD unit 740 may perform predictive vector dequantization in a manner reciprocal to that described above with respect to the PVQ unit 540. That is, the PVD unit 740 may receive the VvecIdx syntax elements(s) 511, the SgnVal syntax element(s) 515, the WeightErrorIdx syntax element 519B, and the CodebkIdx syntax element 521 to the switched-predictive vector dequantization unit 760. The PVD unit 740 may retrieve the AE vectors from the AECB 63 identified by the CodebkIdx syntax element 521B and perform the above noted conversion to generate the 32 volume code vectors 571. The code vectors may, as described above, be stored to a VCVCB. When stored to a VCVCB, the PVD unit 740 may retrieve the volume code vectors based on the plurality of V-vector indices. The 32 volume code vectors 571 may be denoted Ω.

The PVD unit 740 may next reconstruct the WeightVal[ ] array in the manner shown in the above VVectorData(i) syntax table. The PVD unit 740 may determine the weight as a function, at least in part, of the SgnVal, the CodebkIdx syntax element 521B, the WeightErrorIdx syntax value 519B, the weight factors 523 denoted as the alphaVvec syntax element and the reconstructed previous weights 525. The PVD unit 740 may include a weight decoder unit 524, which may be similar and possibly substantially similar to the local weight decoder unit 524A-524D shown in the examples of FIG. 8A-8H. The description below assumes, for ease of illustration purposes, that the local weight decoder unit 524A represents the local weight decoder unit 524A shown in the examples of FIGS. 8A and 8B. While described with respect to the exemplary local weight decoder unit 524A, the techniques may be performed with respect to any of the exemplary local weight decoder units 524B-524D shown in the examples of FIGS. 8C-8H.

The local weight decoder unit 524A may obtain the residual from the RCB 65B, which are denoted in the above equations as $\hat{r}$, based on the WeightErrorIdx syntax element 519B. local weight decoder unit 524A may reconstruct a plurality of weights according to the following equation:

$$\text{WeightVal}[j]=((\text{SgnVal}*2)-1)*\text{WeightValPredictiveCdbk}[\text{CodebkIdx}(k)[i]][\text{WeightErrorIdx}][j]+\text{alphaVvec}[j]*\text{AbsoluteWeightVal}[k-1][j] \quad (20)$$

where the WeightVal[j] represents the jth reconstructed weights 531 ($\hat{\omega}_{i,j}$ where i in this notation refers to a frame rather than k) for the ith one of the quantized vectors 57 in the kth audio frame, the SgnVal represents jth sign value $s_1$, the WeightValPredictiveCodbk[CodebkIdx(k)[i]][WeightErrorIdx][j] represents the jth residual weight errors 620A ($\hat{r}_{i,j}$ where i in this notation refers to a frame rather than k) for ith one of the quantized vectors 57 in the kth audio frame, the alphaVvec[j] represents the jth weight factor 523 ($\alpha_j$), and the AbsoluteWeightVal[k−1][j] represents jth one of the reconstructed previous weights 525 ($|\hat{\omega}_{i-1,j}|$ where i in this notation refers to a frame rather than k).

In this respect, the local weight decoder unit 524 may dequantize the weight index 519B to obtain a plurality of residual weight errors and reconstruct a plurality of weights 531 for a current time segment and based on the plurality of residual weight errors 620A and one of the reconstructed plurality of weights 525 from a past time segment. The above reconstruction is described in more detail with respect to FIG. 8B. Alternate reconstructions are described in more detail with respect to FIGS. 8D, 8F and 8H.

The PVD unit 740 may, after reconstructing the weights 531 for a current time segment (e.g., an ith audio frame), reconstruct the V-vector 55(*i*) based on the following equation:

$$\hat{V}_{FG} = \sum_{j=1}^{I} (2s_j - 1)(|\hat{r}_{i,j}| + \alpha_j|\hat{\omega}_{i-1,j}|)\Omega_j \quad (21)$$

where $\hat{V}_{FG}$ denotes the reconstructed V-vector 55(*i*). To reconstruct the V-vector 55(*i*), the PVD unit 740 may retrieve a jth one of the volume code vectors 571, which is denoted in the above equation (21) as $\Omega_j$. The PVD unit 740 may retrieve each of the jth volume code vectors 571 based on the plurality of V-vector indices represented by the VVecIdx syntax elements 511.

As noted above, the V-vector 55(*i*) may represent a multi-directional V-vector 55(*i*) representing multi-directional sound sources. As such, the PVD unit 740 may reconstruct a multi-directional V-vector 55(*i*) based on the J plurality of volume code vectors 571 and the reconstructed plurality of weights 531 from the current time segment. The NPVD unit 720 may output the reconstructed V-vector 55(*i*).

The scalar dequantization unit 750 may operate in a manner reciprocal to that described above to obtain the reconstruct V-vector 55(*i*). The scalar dequantization unit 750 may perform scalar dequantization with or without first (meaning before performing the scalar dequantization) applying Huffman decoding to the quantized V-vector 57(*i*). The scalar dequantization unit 750 may output the reconstructed V-vector 55(*i*).

The V-vector reconstruction unit 74 may in this way determine one or more bits indicative of the weights from the bitstream 21 (e.g., the index into one of the above described codebooks) via the extraction unit 72, and reconstruct the reduced foreground V[k] vectors $\mathbf{55}_k$ based on the weights and one or more corresponding volume code vectors. In some examples, the weights may include weight values corresponding to all code vectors in a set of code vectors that is used to the reconstructed reduced foreground V[k] vectors $\mathbf{55}_k$ (which may also be referred to as the reconstructed V-vectors 55). In such examples, the V-vector reconstruction unit 74 may reconstruct the reduced foreground V[k] vectors $\mathbf{55}_k$ based on the entire set or a subset of volume code vectors as a weighted sum of the volume code vectors.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $\mathrm{SHC}_{BG}$ 47' (where the $\mathrm{SHC}_{BG}$ 47' may also be denoted as "ambient HOA channels 47'''" or "ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 665. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 665 to the adjusted ambient HOA coefficients 47'' so as to obtain the HOA coefficients 11'. The prime notation reflects that the HOA coefficients 11' may be similar to but not the same as (or, in other words, a representation of) the HOA coefficients 11. The differences between the HOA coefficients 11 and 11' may result from loss due to transmission over a lossy transmission medium, quantization or other lossy operations.

Figure 12A:
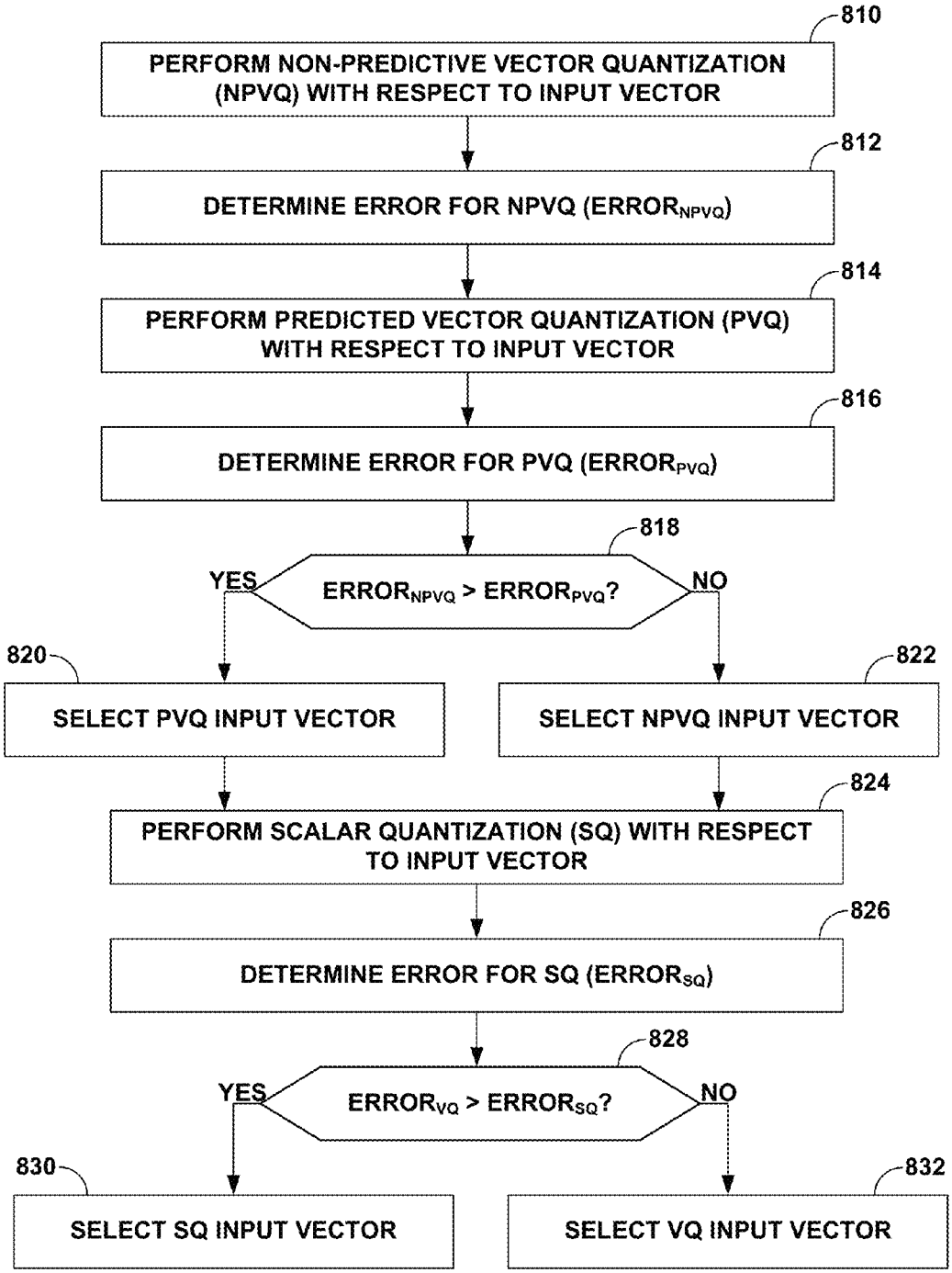
FIG. 12A is a flowchart illustrating exemplary operation of the V-vector coding unit of FIG. 4 in performing various aspects of the techniques described in this disclosure.

FIG. 12A is a flowchart illustrating exemplary operation of the V-vector coding unit of FIG. 5 in performing various aspects of the techniques described in this disclosure. The NPVQ unit 520 of the V-vector coding unit 52 may perform non-predictive vector quantization (NPVQ) with respect to the input V-vector 55(*i*) (810). The NPVQ unit 520 may determine an error that results from performing NPVQ with respect to the input V-vector 55(*i*) (where the error may be denoted $\mathrm{ERROR}_{NPVQ}$) (812).

The PVQ unit 540 of the V-vector coding unit 52 may perform predicted vector quantization (PVQ) in the manner described above with respect to the input V-vector 55(*i*) (814). The PVQ unit 540 may determine an error that results from performing PVQ with respect to the input V-vector 55(*i*) (where the error may be denoted $\mathrm{ERROR}_{PVQ}$) (816). When the $\mathrm{ERROR}_{NPVQ}$ is greater than the $\mathrm{ERROR}_{PVQ}$ ("YES" 818), the VQ/PVQ selection unit 562 of the V-vector coding unit 52 may select PVQ input V-vector, which may refer to the above noted syntax elements associated with the PVQ version of the V-vector 55(*i*) (820). When the $\mathrm{ERROR}_{VQ}$ is not greater than the $\mathrm{ERROR}_{PVQ}$ ("NO" 818), the VQ/PVQ selection unit 562 may select NPVQ input V-vector, which may refer to the above noted syntax elements associated with the NPVQ version of the V-vector 55(*i*) (822).

The VQ/PVQ selection unit 562 may output the selected one of the NPVQ input V-vector and the PVQ input V-vector as the VQ input V-vector to the VQ/SQ selection unit 564. The error associated with the VQ input V-vector may be denoted $\mathrm{ERROR}_{VQ}$, and is equal to the error determined for the selected one of the NPVQ input V-vector and the PVQ input V-vector.

The scalar quantization unit 550 of the V-vector coding unit 52 may also perform scalar quantization (824) with respect to the input V-vector 55(*i*). The scalar quantization unit 550 may determine an error that results from performing SQ with respect to the input V-vector 55(*i*) (where the error may be denoted $\mathrm{ERROR}_{SQ}$) (826). The scalar quantization unit 550 may output the SQ input V-vector 551(*i*) to the VQ/SQ selection unit 564.

When the $\mathrm{ERROR}_{VQ}$ is greater than the $\mathrm{ERROR}_{SQ}$ ("YES" 818), the VQ/SQ selection unit 564 may select SQ input V-vector 551(*i*) (830). When the $\mathrm{ERROR}_{VQ}$ is not greater than the $\mathrm{ERROR}_{SQ}$ ("NO" 828), the VQ/SQ selection unit 564 may select VQ input V-vector. The VQ/SQ selection unit 564 may output the selected one of the SQ input V-vector 551(*i*) and the VQ input V-vector as the quantized V-vector 57(*i*).

In this respect, the V-vector coding unit 52 may switch between non-predictive vector quantization of a first set of one or more weights, and predictive vector quantization of a second set of one or more weights.

Figure 12B:
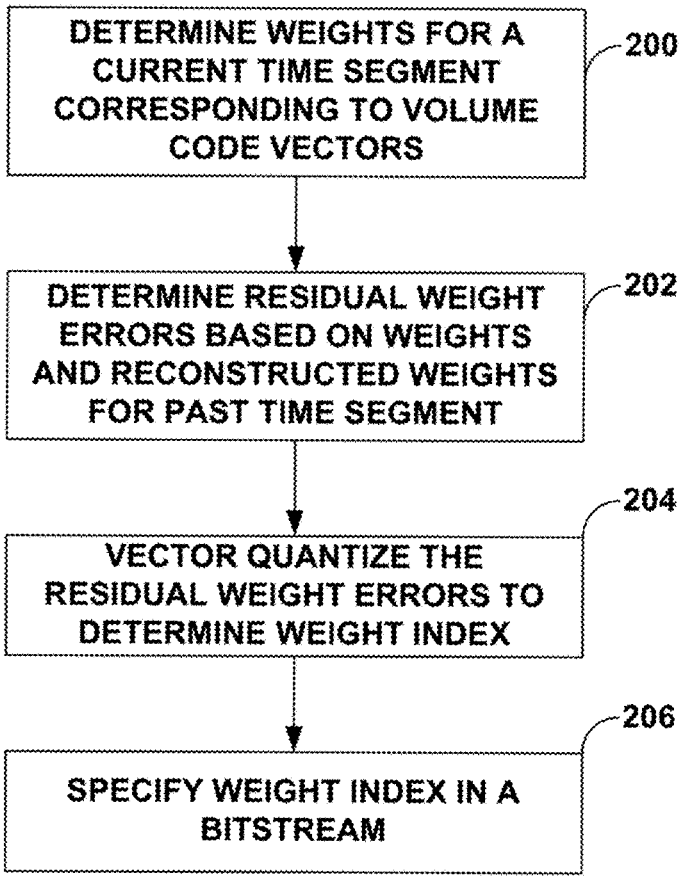
FIG. 12B is a flowchart illustrating exemplary operation of an audio encoding device in performing various aspects of the vector-based synthesis techniques described in this disclosure.

FIG. 12B is a flowchart illustrating exemplary operation of an audio encoding device, such as the audio encoding device 20 shown in the example of FIG. 3, in performing various aspects of the predictive vector quantization techniques described in this disclosure. The approximation unit 502 of the V-vector coding unit 52A (FIG. 4) representative of the V-vector coding unit 52 of the audio encoding device 20 shown in FIG. 3 may determine the weights 503 for a current time segment corresponding to volume code vectors 571 (200).

As described in more detail above, the PVQ unit 540 may determine residual weight errors based on the weights 503 (or, in some examples, ordered weights 505) and one of the reconstructed weights 525 for a past time segment (202). The PVQ unit 540 may vector quantize the residual weight errors to determine a weight index, which may be represented by the WeightErrorIdx syntax element 519B (204).

The PVQ unit 540 may, when PVQ is selected, provide the WeightErrorIdx syntax element 519B to the bitstream generation unit 42. The bitstream generation unit 42 may specify the WeightErrorIdx syntax element 519B in the bitstream 21 in the manner shown above in the syntax tables.

Figure 13A:
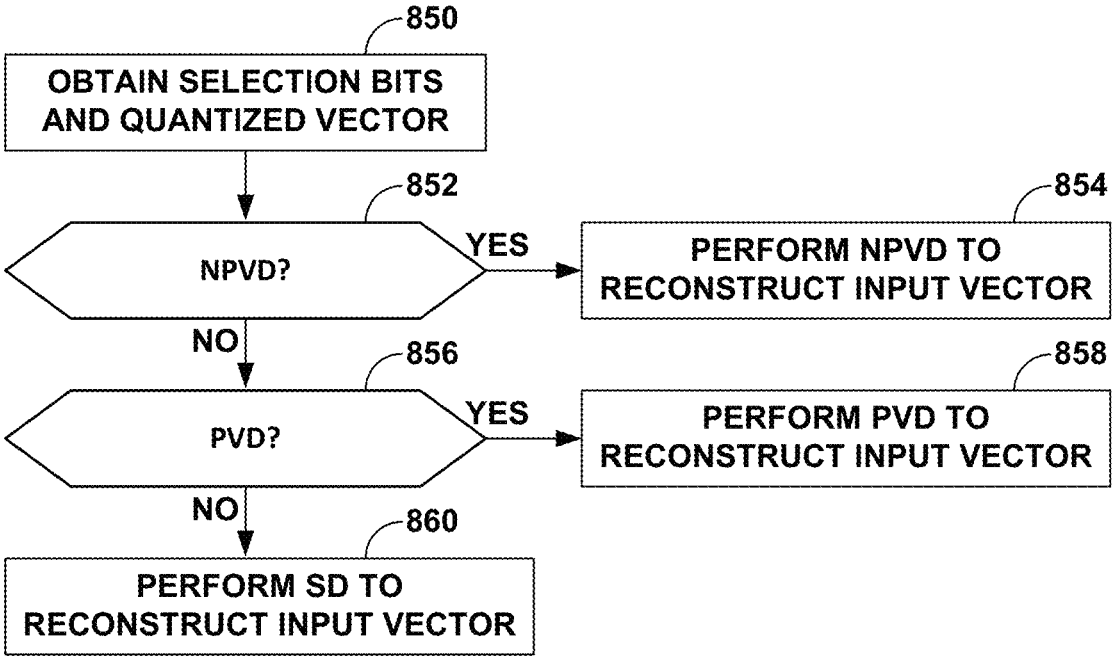
FIG. 13A is a flowchart illustrating exemplary operation of the V-vector reconstruction unit of FIG. 11 in performing various aspects of the techniques described in this disclosure.

FIG. 13A is a flowchart illustrating exemplary operation of the V-vector reconstruction unit of FIG. 11 in performing various aspects of the techniques described in this disclosure. The selection unit 764 of the V-vector reconstruction unit 74 may obtain the above described selection bits indicative of whether non-predictive vector dequantization (NPVD), predictive vector dequantization (PVD) or scalar dequantization (SD) is to be performed and the quantized V-vector 57(*i*).

When the selection bits indicate that NPVD is to be performed ("YES" 852), the selection unit 764 forwards the quantized V-vector 57(*i*) to the NPVD unit 720. The NPVD unit 720 performs NPVD with respect to the quantized V-vector 57(*i*) to reconstruct the input V-vector 55(*i*) (854).

When the selection bits indicate that NPVD is to not to be performed ("NO" 852) but that PVD is to be performed ("YES" 856), the selection unit 764 forwards the quantized V-vector 57(*i*) to the PVD unit 740. The PVD unit 740 performs PVD with respect to the quantized V-vector 57(*i*) to reconstruct the input V-vector 55(*i*) (858).

When the selection bits indicate that NPVD and PVD are not to be performed ("NO" 852 and "NO" 856), the selection unit 764 forwards the quantized V-vector 57(*i*) to the scalar dequantization unit 750. The scalar dequantization unit 750 performs SD with respect to the quantized V-vector 57(*i*) to reconstruct the input V-vector 55(*i*) (860).

Figure 13B:
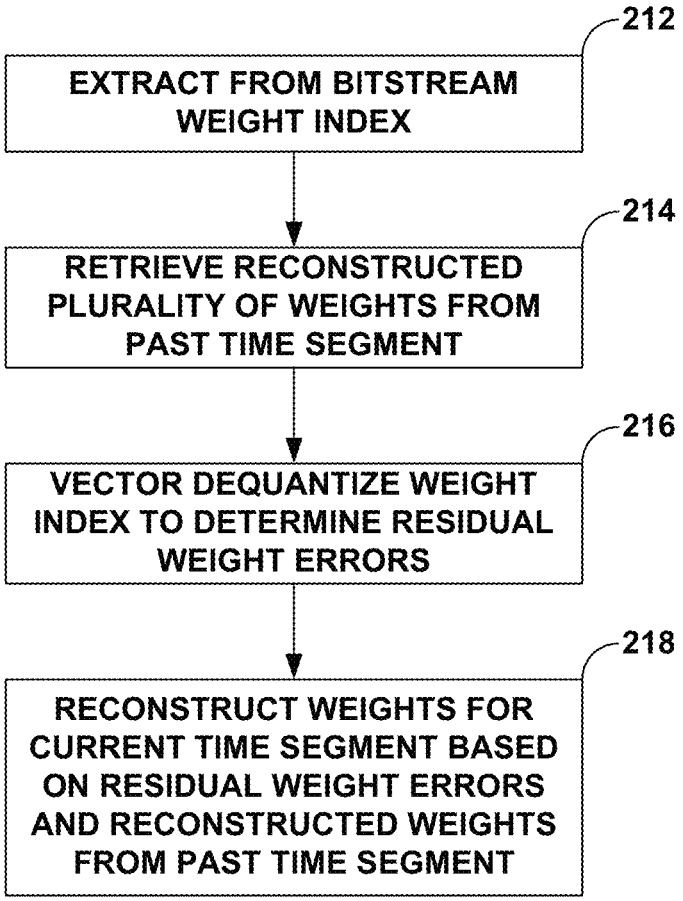
FIG. 13B is a flowchart illustrating exemplary operation of an audio decoding device in performing various aspects of the techniques described in this disclosure.

FIG. 13B is a flowchart illustrating exemplary operation of an audio decoding device, such as the audio decoding device 24 shown in FIG. 10 in performing various aspects of the predictive vector quantization techniques described in this disclosure. As described above, the extraction unit 72 of the audio decoding device 24 shown in FIG. 4 may extract, from the bitstream 21, a WeightErrorIdx syntax element 519B representative of the weight index (212).

The PVD unit 740 of the V-vector reconstruction unit 74 shown in FIG. 11 may retrieve, from buffer unit 530, one of the plurality of reconstructed weights 525 from the past time segment (214). The local weight decoder unit 524 of the PVD unit 740 may vector dequantize the WeightErrorIdx syntax element 519B to determine residual weight errors 620A in the manner described above with respect to FIG. 8B, 8D, 8F or 8H (216). The local weight decoder unit 524 of the PVD unit 740 may then reconstruct weights 531 for a current time segment based on the residual weigh errors 620 and the one of the reconstructed weights 525 from the past time segment (218).

Figure 14:
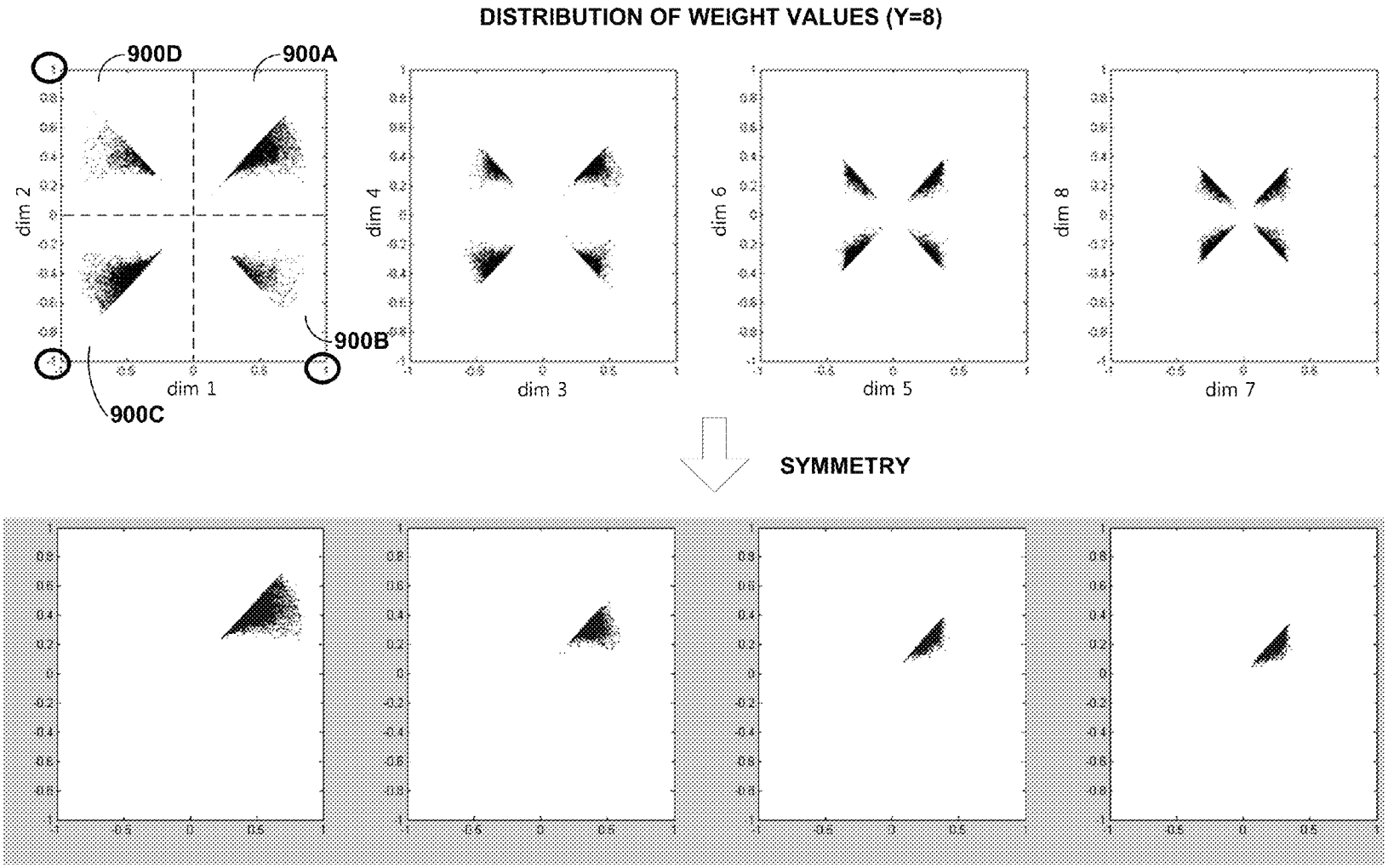
FIG. 14 is a diagram that includes multiple charts illustrating an example distribution of weights used for vector quantization of weights with the NPVQ unit in accordance with this disclosure.

FIG. 14 is a diagram that includes multiple charts illustrating an example distribution of weights used for vector quantization of weights with the NPVQ unit in accordance with this disclosure.

In the example distribution of FIG. 14, each V-vector (which may be referred to as an input V-vector 55(*i*)) is represented by eight weight values (i.e., Y=8). In other words, although there may be more than 8 weight values and/or code vectors in a full decomposition of the input V-vector 55(*i*), the 8 weight values with the greatest-magnitude are selected from all of the weight values to represent the input V-vector 55(*i*). The 8 greatest-magnitude weight values are then vector quantized.

In this example, vector quantization is performed with 8-component quantization vectors (i.e., Y-component quantization vectors, where Y=8). In other words, the weight values for each input V-vector 55(*i*), in this example, are grouped together into groups of eight weight values and are vector quantized with a single quantization vector and weight index.

Each of the four charts in the top row in FIG. 14 illustrates two of the eight weight values in each of a plurality of groups of 8 weight values that represent a sample distribution of input V-vectors 55. The notation dim1 denotes the first weight value in the ordered set of weight values (i.e., $\overline{w}_1$) for the input V-vector 55(*i*), dim2 denotes the second weight value in the set of weight values (i.e., $\overline{w}_2$) for the input V-vector 55(*i*), etc.

In some examples, the magnitude and sign of the weight values may be separately quantized. For example, in the example shown in FIG. 14 where each of the V-vectors is represented by eight weight values, an eight-dimensional vector quantization may be performed to vector quantize the magnitudes of the weight values. In such an example, a sign bit may be generated for each of the dimensions to indicate the sign of the respective dimension.

Given that each of the dim0-dim7 may have a separate sign bit, there may be 8 sign bits, two for each of the top row charts. The sign bits for each dim1-dim8 may effectively identify a quadrant of each of the top row charts. For example, the quadrants for the first top-row chart on the left are shown as quadrants 900A-900D. A sign bit set to one may indicate a positive (or zero) value, while the sign bit set to zero may indicate a negative value. The quadrant 900A may be specified by the sign bit for dim1 set to one and the sign bit for dim0 set to one. The quadrant 900B may be specified by the sign bit for dim1 set to one and the sign bit for dim2 set to zero. The quadrant 900C may be specified by the sign bit for dim1 set to zero and the sign bit for dim2 set to zero. The quadrant 900D may be specified by the sign bit for dim1 set to zero and the sign bit for dim2 set to one.

Given the symmetry of the weight value distributions among the quadrants identified by the sign bits, the weight distributions of the top row charts of FIG. 14 may be reduced to the four charts in the bottom row. By independently quantizing the magnitude and sign bit, the V-vector reconstruction unit 74 may reduce a number of bits allocated in comparison to jointly quantizing the magnitude and sign bit as the dynamic range is reduced to a single quadrant.

Figure 15:
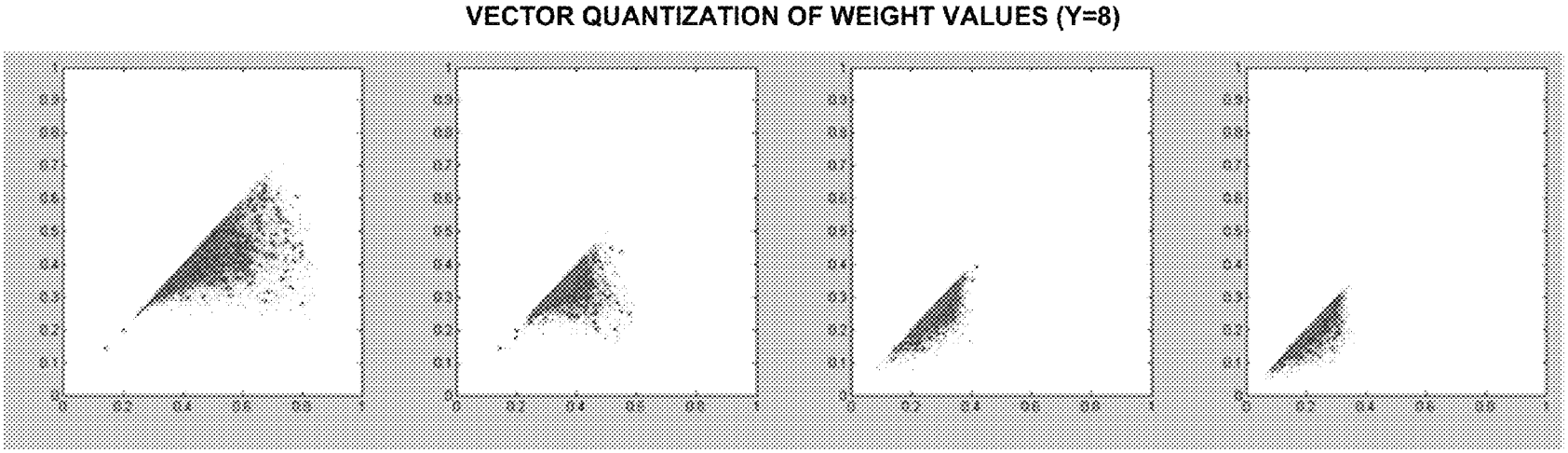
FIG. 15 is a diagram that includes multiple charts of the positive quadrant of the bottom row charts of FIG. 14 in more detail illustrating the vector quantization of weights in the NPVQ unit in accordance with this disclosure.

FIG. 15 is a diagram that includes multiple charts of the positive quadrant of the bottom row charts of FIG. 14 in more detail illustrating the vector quantization of weights in the NPVQ unit in accordance with this disclosure. In the charts of FIG. 15, the lighter grey values denote quantized weight values, while the darker grey values denote the original weight values.

Figure 16:
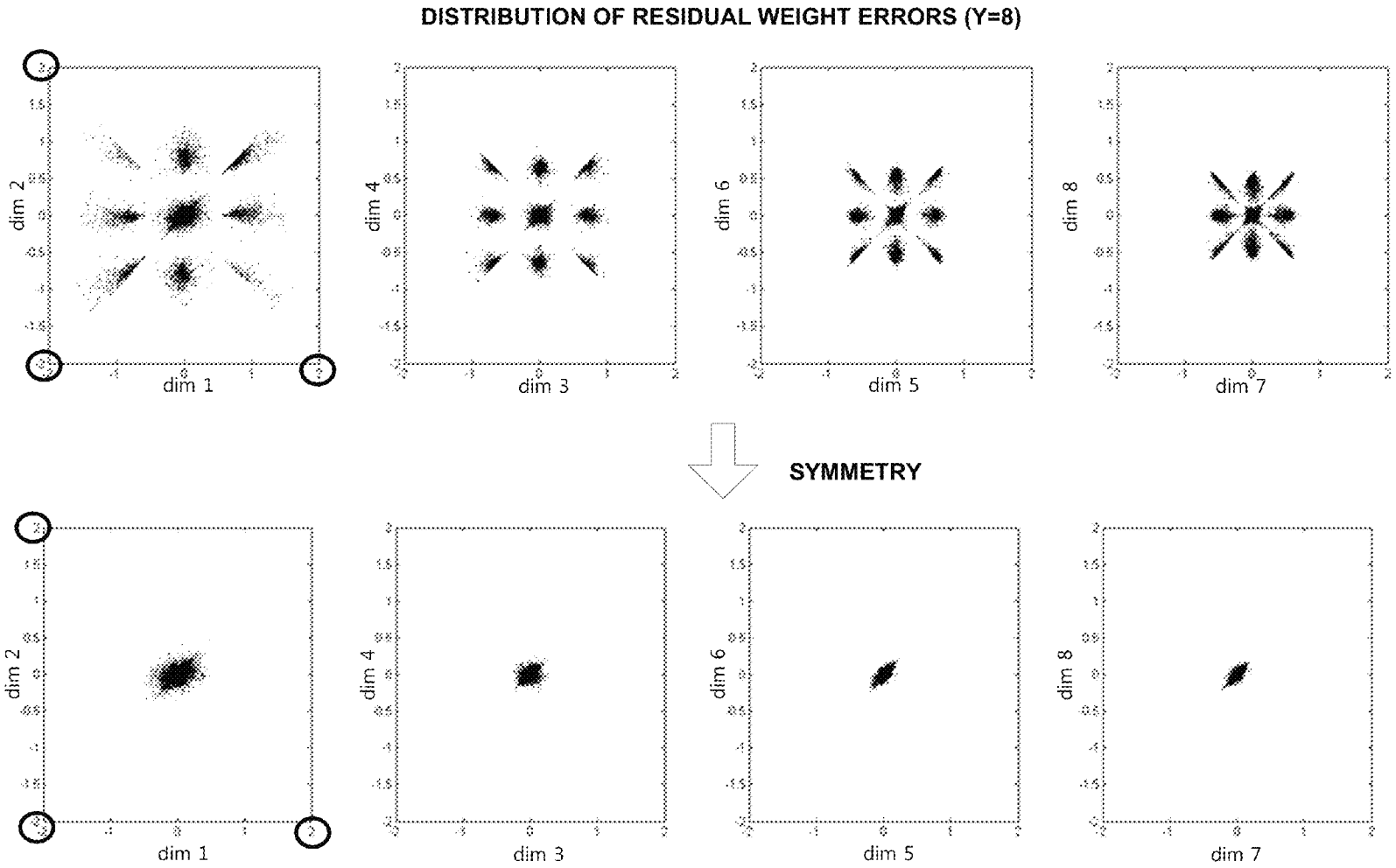
FIG. 16 is a diagram that includes multiple charts illustrating an example distribution of predictive weight values (predictive weight values may also be referred to as residual weight errors) used as part of the predictive vector quantization of the residual weight errors in the PVQ unit in accordance with this disclosure.

FIG. 16 is a diagram that includes multiple charts illustrating an example distribution of predictive weight values (predictive weight values may also be referred to as residual weight errors) used as part of the predictive vector quantization of the residual weight errors in the PVQ unit in accordance with this disclosure. The residual weight error for the jth index and the ith audio frame may be generated based on the following equation:

$$r_{i,j}=\overline{w}_{i,j}-\alpha_j\overline{w}_{i-1,j} \tag{22}$$

where $r_{i,j}$ the jth residual weight error from an ordered subset of weight values for the ith audio frame, $w_{i,j}$ corresponds to the jth weight value from an ordered subset of weight values for the ith audio frame, $w_{i-1,j}$ corresponds to the jth weight value from an ordered subset of weight values for the (i−1)th audio frame, and $\alpha_j$ corresponds to a weighting factor for the jth weight value from an ordered subset of weight values for an audio frame. In some examples, the indexing used in equation directly above may refer to the indices that occur after reordering and re-indexing the weight values as discussed above, i.e., $j \epsilon Ys$. In the example of FIG. 16, $\alpha_j=1$.

The residual weight error may also be referred to as a predictive weight value. A predictive weight value may refer to a value used to predict (and is therefore predictive of) a weight value of a current time frame. In this respect, the predicted weight value may represent a weight value predicted based on the predictive weight value and a reconstructed weight value from a past time frame.

Each input vector 55(*i*) in FIG. 16 is represented by eight predictive weight values (i.e., M=8 in this example). Each of the charts in the top row of FIG. 16 illustrates two of the eight predictive weight values in each of a plurality of groups of eight predictive weight values that represent a sample distribution of V-vectors. The notation dim1 denotes the first predictive weight value in an ordered set of predictive weight values for the input vector 55(*i*), dim2 denotes a second predictive weight value in an ordered set of weight values for the input vector 55(*i*), etc.

In some examples, the magnitude and sign of the weight values may be separately quantized. For example, in the example shown in FIG. 14 where each of the V-vectors is represented by eight weight values, an eight-dimensional vector quantization may be performed to vector quantize the magnitudes of the weight values. In such an example, a sign bit may be generated for each of the dimensions to indicate the sign of the respective dimension.

Similar to the non-predictive vector quantization, given that each of the dim0-dim7 may have a separate sign bit, there may be 8 sign bits, two for each of the top row charts. The sign bits for each dim1-dim8 may effectively identify a quadrant of each of the top row charts. Given the symmetry of the weight value distributions among the quadrants identified by the sign bits, the weight distributions of the top row charts of FIG. 14 may be reduced to the four charts in the bottom row. By independently quantizing the magnitude and sign bit, the V-vector reconstruction unit 74 may reduce a number of bits allocated in comparison to jointly quantizing the magnitude and sign bit as the dynamic range is reduced to a single quadrant.

In other words, prediction may occur in the absolute weight value domain, and sign information for each of the weight values may be transmitted independently of the predictive weight values.

For example, the predictive weight value for the jth index and the ith audio frame may be generated based on the following equation:

$$|r_{i,j}|=|\overline{\omega}_{i,j}|-\alpha_j|\overline{\omega}_{i-1,j}| \tag{23}$$

where $r_{i,j}$ the jth residual value from an ordered subset of weight values for the ith audio frame, $\overline{\omega}_{i,j}$, corresponds to the jth weight value from an ordered subset of weight values for the ith audio frame, $\overline{\omega}_{i-1,j}$ corresponds to the jth weight value from an ordered subset of weight values for the (i−1)th audio frame, $\alpha_j$ corresponds to a weighting factor for the jth weight value from an ordered subset of weight values for an audio frame, and the operator $|\chi|$ corresponds to a magnitude or absolute value of $\chi$. In some examples, the indexing used in equation (23) may refer to the indices that occur after reordering and reindexing the weight values as discussed above, i.e., $j \epsilon Ys$. In the example of FIG. 16, $\alpha_j=1$.

In some examples, the magnitude and sign of the predictive weight values may be separately quantized. For example, in the example shown in FIG. 16 where the input V-vector 55(*i*) is represented by eight weight values, an eight-dimensional vector quantization may be performed to vector quantize the magnitudes of the predictive weight values. In such an example, a sign bit may be generated for each of the dimensions to indicate the sign of the respective dimension (and thereby identify the quadrant).

Figure 17:
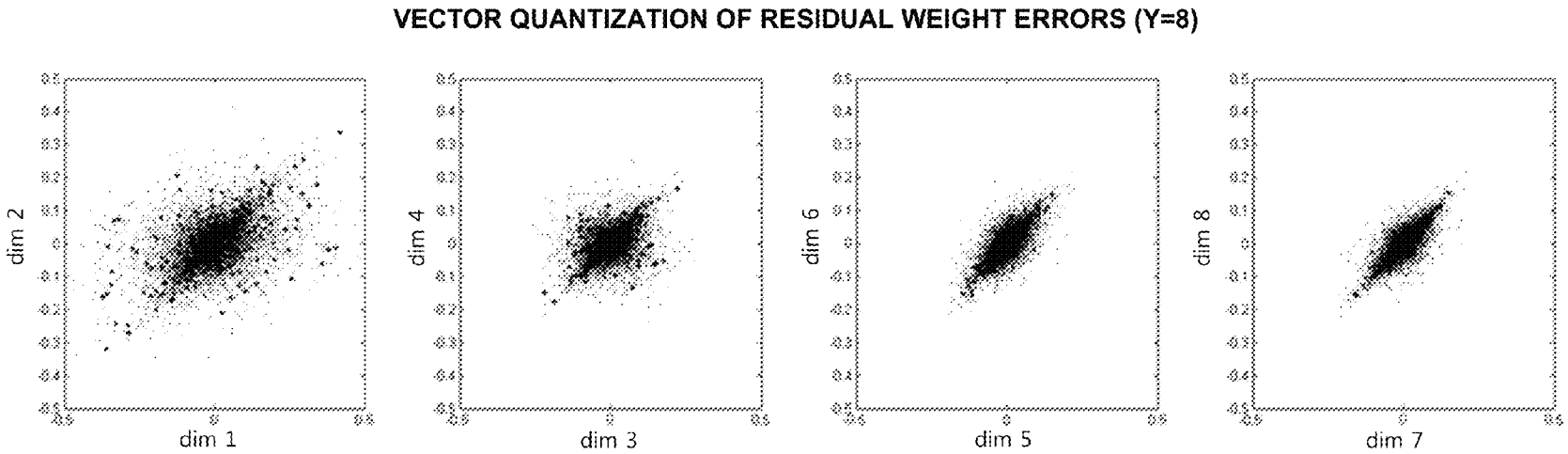
FIG. 17 is a diagram that includes multiple charts illustrating the example distribution in FIG. 16 in more detail illustrating the corresponding quantized residual weight errors (i.e. predictive weight values) used as part of the predictive vector quantization of the residual weight errors in the PVQ unit in accordance with this disclosure.

FIG. 17 is a diagram that includes multiple charts illustrating the example distribution in FIG. 16 along with an example distribution of the corresponding quantized predictive weight values. In the charts of FIG. 17, the lighter grey values denote quantized weight values, while the darker grey values denote the original weight values.

FIGS. 18 and 19 are tables illustrating comparison example performance characteristics of predictive vector quantization techniques in "PVQ only mode" of this disclosure with different methods to obtain the alpha factors. FIG. 18 is a table illustrating example performance characteristics of the predictive vector quantization techniques of this disclosure in a "PVQ only mode." A PVQ mode may denote performing predictive vector quantization based on only using past frame (or sub-frame) predicted vector quantized weight vector from the PVQ unit 540 without the ability to access any of the past vector quantized weight vectors from the NPVQ unit 520. A "VQ only mode" may denote performing vector quantization without previous (from a past frame or sub-frame) vector quantized weight vectors from the NPVQ unit 520 or PVQ unit 540. An SPVQ enabled mode, may denote that switching between VQ only mode and using the techniques described in this disclosure above for the ability of the PVQ unit 540 to access the past vector quantized weight vectors from NPVQ unit 520. In particular, FIG. 18 illustrates performance characteristics of the predictive vector quantization illustrated in FIG. 17 where $\alpha_j=1$ and PVQ only mode. The "bits" column defines the number of bits used to represent each weight value. As the number of bits increases, the signal-to-noise-ration (SNR) as specified in decibels (dB) increasing. The SNR increase may allow the V-vector coding unit 52 to select more bits for a relatively larger target bitrate 41 and less bits for a relatively smaller target bitrate 41.

In the examples described above with respect to FIGS. 14-17, $\alpha_j=1$. However, in other examples, $\alpha_j$ may not equal 1. In some examples, $\alpha_j$ may be selected based on an error metric. For example, $\alpha_j$ may be selected to be a value that minimizes a sum or sum of squared errors (SSE) metric over a range of audio frames.

For example, the following equations may be used to derive an alpha value that minimizes an error metric:

$$\{\alpha_j^*\} = \underset{\{\alpha_j\}}{\arg\min} \sum_{i=1}^{I} \sum_{j=1}^{J} (|\omega_{i,j}| - \alpha_j|\omega_{i-1,j}|)^2 \tag{24}$$

$$\Longleftrightarrow \alpha_j^* = \underset{\alpha_j}{\arg\min} \sum_{i=1}^{I} (|\omega_{i,j}| - \alpha_j|\omega_{i-1,j}|)^2 \tag{25}$$

-continued $$\Longleftrightarrow \frac{\partial}{\partial \alpha_j} \sum_{i=1}^{I} (|\omega_{i,j}| - \alpha_j |\omega_{i-1,j}|)^2 = 0 \tag{26}$$

$$\Longleftrightarrow \alpha_j^* = \frac{\sum_{i=1}^{I} \omega_{i,j}\omega_{i-1,j}}{\sum_{i=1}^{I} \omega_{i-1,j}^2} \tag{27}$$

$$= [0.9852 \quad 0.9889 \quad 0.9913 \quad 0.9924 \quad 0.9912 \quad 0.9898 \quad 0.9886 \quad 0.9870] \tag{28}$$

Equation (27) may be used to find the $\alpha_j$ that minimizes the error metric shown in equation (24) for a given set of weight values over I audio frames. Expression (28) illustrates example values that may be obtained from the sample distribution of weight values shown in FIG. 14.

FIG. 19 illustrates performance characteristics of a PVQ only mode where $\alpha_j$ is defined based on equation (19). In comparing FIGS. 18 and 19 of PVQ only mode configurations, defining $\alpha_j$ based on equation (19) (FIG. 19) may provide better performance than FIG. 18. Again, the "bits" column defines the number of bits used to represent each weight value. As the number of bits increases, the signal-to-noise-ration (SNR) as specified in decibels (dB) increasing. The SNR increase may allow the V-vector coding unit 52 to select more bits for a relatively larger target bitrate 41 and less bits for a relatively smaller target bitrate 41.

FIGS. 20A and 20B are tables illustrating comparison example performance characteristics of "PVQ only mode" and "VQ only mode" in accordance with this disclosure. The tables shown in FIGS. 20A and 20B contain a bits column and a signal-to-noise ratio (SNR) column. In the example of FIGS. 20A and 20B, the "bits" column may be indicative of the number of bits used to represent quantized weight values (e.g., quantized predictive or non-predictive weight values) for each of the input V-vectors.

In the example of FIG. 20A, the SNR values are provided for each of the bit lengths of the weight values assuming that a mode bit is not separately signaled in the selection bits (that is, that the CodebkIdx syntax element does not need to include an additional bit which may represent the mode bit to separately identify the predictive vector quantization mode). Instead, the NbitsQ syntax element representative of the quantization mode may separately indicate predictive vector quantization by specifying, as one example, a previously reserved value of three (or any other reserved value) as described with respect to the alternative syntax table. The number of bits used to represent the quantized weight values for an input V-vector in FIG. 20B may include a mode bit that is indicative of whether the predictive or non-predictive vector quantization was performed to quantize the input V-vector. Given that the bits used to represent the quantized weight values includes the mode bit, an SNR for 1 bit is not specified as two or more bits are required, i.e., one for each weight and one for the mode bit.

The bits in examples of FIGS. 20A and 20B may be indicative of which of a plurality of quantization vectors in a quantization codebook corresponds to the quantized weight values. Thus, the bits column may, in some examples, be dependent on the number of weight values that are selected to represent a V-vector (i.e., Y) or on the size of the vectors in the quantization codebook that is used to perform vector quantization.

The SNR column indicates the SNR associated with quantizing the sample distribution of weight values using the switched-predictive quantization mode at the corresponding bit-rate. As shown in FIGS. 20A and 20B, the SNR column for a bit-rate of one is not applicable (N/A), because a bit-rate of one would allow for a mode bit or a bit indicative of the quantization vectors, but not both. As such, the switched-predictive vector quantization mode adds an additional bit of overhead to the quantization codewords compared to using either of the non-predictive or predictive vector quantization modes alone.

The table below illustrated a comparison example performance characteristics of "PVQ only mode," "VQ only mode" and "SPVQ enabled mode" in accordance with this disclosure. The table shown below contains a bits column, a vector quantization (VQ) column (VQ only mode), a predictive vector quantization (PVQ) column (a PVQ only mode), and a switched-predictive vector quantization (SPVQ) column (SPVQ enabled mode). There may be dedicated NbitsQ syntax element value is used for VQ only mode, a PVQ only mode and an SPVQ only mode (switching) to perform different types of quantization vector quantization modes, the performance (in dB) is capture in the following table:

| bits | VQ | PVQ | SPVQ |
|---|---|---|---|
| 1 | 18.42 | 17.80 | 20.26 |
| 2 | 20.02 | 18.97 | 21.58 |
| 3 | 21.42 | 19.90 | 22.72 |
| 4 | 22.71 | 20.92 | 23.84 |
| 5 | 23.94 | 21.82 | 24.90 |
| 6 | 25.13 | 22.77 | 25.97 |
| 7 | 26.32 | 23.68 | 27.03 |
| 8 | 27.47 | 24.64 | 28.08 |
| 9 | 28.69 | 25.69 | 29.22 |
| 10 | 30.00 | 26.87 | 30.47 |

In this alternative table shows above, SPVQ enabled mode exceeds the VQ only mode (e.g., non-predictive VQ) at every bit length for the quantized weight values.

In the example table, the "bits" column may be indicative of the number of bits used to represent quantized weight values (e.g., quantized predictive or non-predictive weight values) for each of the input V-vectors. The number of bits used to represent the quantized weight values for the SPVQ enabled mode may include a mode bit while the number of bits used to represent the quantized weight values for the other modes may not include a mode bit. The VQ, PVQ, and SPVQ columns indicate SNRs associated with performing vector quantization according to their respective vector quantization modes at the corresponding bit-rates.

The SPVQ enabled mode provides better performance at lower bit representations (which may be used for relatively lower bitrates specified by the target bitrate 41 that allow for 4 or less bits per quantized weight value). The VQ only mode (which denotes performing NPVQ without SPVQ enabled, meaning that switching to PVQ is not allowed) provides better performance at higher bit-rates (which may be used for relatively higher bitrates specified by the target bitrate 41 that allow for 5 or more bits per quantized weight value).

Although the PVQ only mode (which denotes performing PVQ without SPVQ mode enabled, meaning that switching to NPVQ is not allowed) does not provide the best performance at any of the bit allocation levels, using PVQ as part of the SPVQ enabled mode may provide improved performance at lower bit-rates than merely using the VQ mode alone. Moreover, when the mode bit is not used in favor of a dedicated NbitsQ syntax element value for signaling the predictive vector quantization (such as a value of three), the various SNR measures for SPVQ shown in the example table may be shifted upward.

In this respect, the audio encoding device 20 may operate according to the following steps.

Step 1. For a given set of directional vectors, the audio encoding device 20 may calculate the weighting value for each directional vector.

Step 2. The audio encoding device 20 may select the N-maxima weighting values, {w_i}, and the corresponding directional vectors, {o_i}. The audio encoding device 20 may transmit the indices {i} to the decoder. In calculating maxima, the audio encoding device 20 may use the absolute values (by neglecting sign information).

Step 3. The audio encoding device 20 may quantize the N-maxima weighting values, {w_i}, to generate {w^_i}. The audio encoding device 20 may transmit the quantization indices for {w^_i} to the audio decoding device 24.

Step 4. The audio decoding device 24 may synthesize the quantized V-vector as sum_i (w^_i*o_i)

In some examples, the techniques of this disclosure may provide a significant improvement in performance. For example, compared with using scalar quantization followed by Huffman coding, an approximately 85% bit-rate reduction may be obtained. For example, scalar quantization followed by Huffman coding may, in some examples, require a bit-rate of 16.26 kbps (kilobits-per-second) while the techniques of this disclosure may, in some examples, be capable of coding at a bitrate of 2.75 kbsp.

Consider an example where X code vectors from a codebook (and X corresponding weights) are used to code a V-vector. In some examples, the bitstream generation unit 42 may generate the bitstream 21 such that each V-vector is represented by 3 categories of parameters: (1) X number of indices each pointing to a particular vector in a codebook of code vectors (e.g., a codebook of normalized directional vectors); (2) a corresponding (X) number of weights to go with the above indices; and (3) a sign bit for each of the above (X) number of weights. In some cases, the X number of weights may be further quantized using yet another vector quantization (VQ).

The decomposition codebook used for determining the weights in this example may be selected from a set of candidate codebooks. For example, the codebook may be 1 of 8 different codebooks. Each of these codebooks may have different lengths. So, for example, not only may a codebook of size 49 used to determine weights for 6th order HOA content, but the techniques of this disclosure may give the option of using any one of 8 different sized codebooks.

The quantization codebook used for the VQ of the weights may, in some examples, also have the same corresponding number of possible codebooks as the number of possible decomposition codebooks used to determine the weights. Thus, in some examples, there may be a variable number of different codebooks for determining the weights and a variable number of codebooks for quantizing the weights.

In some examples, the number of weights used to estimate a V-vector (i.e., the number of weights selected for quantization) may be variable. For example, a threshold error criterion may be set, and the number (X) of weights selected for quantization may depend on reaching the error threshold where the error threshold is described above.

In some examples, one or more of the above-mentioned concepts may be signaled in a bitstream. Consider an example where the maximum number of weights used to code V-vectors is set to 128 weights, and eight different quantization codebooks are used to quantize the weights. In such an example, the bitstream generation unit 42 may generate the bitstream 21 such that an Access Frame Unit in the bitstream 21 indicates the maximum number of indices that can be used on a frame-by-frame basis. In this example, the maximum number of indices is a number from 0-128, so the above-mentioned data may consume 7 bits in the Access Frame Unit.

In the above-mentioned example, on a frame-by-frame basis, the bitstream generation unit 42 may generate the bitstream 21 to include data indicative of: (1) which one of the 8 different codebooks was used to do the VQ (for every V-vector); and (2) the actual number of indices (X) used to code each V-vector. The data indicative of which one of the 8 different codebooks was used to do the VQ may consume 3 bits in this example. The data indicative of the actual number of indices (X) used to code each V-vector may be given by the maximum number of indices specified in the Access Frame Unit. This may vary from 0 bits to 7 bits in this example.

In some examples, the bitstream generation unit 42 may generate the bitstream 21 to include: (1) indices that indicate which directional vectors are selected and transmitted (according the calculated weighting values); and (2) weighting value(s) for each selected directional vector. In some examples, in this disclosure may provide techniques for the quantization of V-vectors using a decomposition on a codebook of normalized spherical harmonic code vectors, i.e., the volume code vectors are orthonormal.

In some examples, the PVQ unit 540 may include a codebook training stage, which may generate the candidate quantization vectors in the RCB 65B. During the codebook training stage, the equation for generating the predictive weight value shown in the example of FIGS. 8A-8H may be replaced with the following equation:

$$r_{i,j}=|\omega_{i,j}|-\alpha_j|\omega_{i-1,j}|$$

where $r_{i,j}$ corresponds to the predictive weight value for the jth weight value from an ordered subset of weight values for the ith audio frame, where $\omega_{i,j}$ corresponds to the jth weight value from an ordered subset of weight values for the ith audio frame, $\omega_{i-1,j}$ corresponds to the jth weight value from an ordered subset of weight values for the (i−1)th audio frame, $\alpha_j$ corresponds to a weighting factor for the jth weight value from an ordered subset of weight values. In other words, the predictive vector quantization unit 540 may use the equation reproduced above to generate the candidate quantization vectors in the RCB 65B during the training stage.

In further examples, the predictive vector quantization unit 540 may include an encoding stage. In the encoding stage, the audio encoding device 20 and/or the predictive vector quantization unit 540 may use the equation for the predictive weight value 620 that is shown in FIG. 8. For example, in the encoding stage, the audio encoding device 20 and/or the predictive vector quantization unit 540 may quantize the difference $r_{i,j}=|\omega_{i,j}|-\alpha_j|\hat{\omega}_{i-1,j}|$ (i.e., the predictive weight value) into $\hat{e}_{i,j}$ utilizing the RCB 65B. The predictive vector quantization unit 540 may transmit the corresponding index $\hat{r}_{i,j}$ to the decoder.

In further examples, the audio encoding device 20 (e.g., by way of the predictive vector quantization unit 540) and the audio decoding device 24 may implement a decoding stage. In the decoding stage, the audio encoding device 20 and the audio decoding device 24 may reconstruct the quantized predictive weight value, $\hat{e}_{i,j}$, using the transmitted index. The audio encoding device 20 (e.g., again by way of the predictive vector quantization unit 540) and the audio decoding device 24 may reconstruct the quantized version of $|\omega_{i,j}|$ based on the following equation: $|\hat{\omega}_{i,j}|=\hat{r}_{i,j}+\alpha_j|\hat{\omega}_{i-1,j}|$. The audio encoding device 20 and the audio decoding device 24 may use the reconstructed as $|\hat{\omega}_{i,j}|$ as $|\hat{\omega}_{i-1,j}|$ in the next time segment (e.g. frame or sub-frame). Thus, $|\hat{\omega}_{i-1,j}|$ may be the quantized version of $|\hat{\omega}_{i,j}|$ of the previous time segment (e.g. frame or sub-frame).

In these and other instances, the audio encoding device 20 and/or the predictive vector quantization unit 540 are configured to determine a plurality of predictive weight values based on a plurality of weight values that correspond to weights included in one or more weighted sums of code vectors that represent one or more vectors included in a vector-based synthesized version of a plurality of higher order ambisonic (HOA) coefficients. In some examples, the predictive weight values may be alternatively referred to as, for example, residuals, prediction residuals, residual weight values, weight value differences, error values, residual weight errors, or prediction errors.

Any of the foregoing techniques may be performed with respect to any number of different contexts and audio ecosystems. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same or similar 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone (or other type of microphone array such as associated with microphone array 5) which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone array.

Another exemplary audio acquisition context may include a production truck which may be configured to receive a signal from one or more microphones, such as one or more Eigen microphones. The production truck may also include an audio encoder, such as the audio encoding device 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoding device 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to an audio decoding device 24 via either a wired or a wireless connection. In accordance with one or more techniques of this disclosure, a representation of a soundfield based on decoding a bitstream based on vector decomposition framework using Higher Order Ambisonics may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a representation of a soundfield based on decoding a bitstream based on vector decomposition framework using Higher Order Ambisonics may be utilized to render the soundfield on any of the foregoing playback environments. Additionally, the techniques of this disclosure enable a rendered to render a representation of a soundfield based on decoding a bitstream based on vector decomposition framework using Higher Order Ambisonics for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform. For example, the local weight decoder unit 524A-524B of the audio encoding device 20 may perform various aspects of the memory-based vector quantization techniques. As another example, the switched-predictive vector quantization unit 560 of the audio encoding device 20 may also perform various aspects of the switched vector quantization aspects of the techniques described in this disclosure.

In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. For example, the local weight decoder unit 524A-524B of the audio decoding device 24 may perform various aspects of the memory-based vector quantization techniques. As another example, the switched-predictive vector dequantization unit 760 of the audio decoding device 24 may also perform various aspects of the switched vector quantization aspects of the techniques described in this disclosure.

In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device configured to decode a bitstream comprising:

one or more processors configured to:

extract, from the bitstream, a type of quantization mode; and switch, based on the type of quantization mode, between non-predictive vector dequantization to reconstruct a first set of one or more weights used to approximate a multi-directional V-vector in a higher order ambisonics domain, and predictive vector dequantization to reconstruct a second set of one or more weights used to approximate the multi-directional V-vector in the higher order ambisonics domain; and a memory, electrically coupled to the one or more processors, configured to store the reconstructed first set of one or more weights used to approximate the multi-directional V-vector in the higher order ambisonics domain, and the reconstructed second set of one or more weights used to approximate the multi-directional V-vector in the higher order ambisonics domain.

2. The device of claim 1, wherein the one or more processors are further configured to extract a plurality of V-vector indices from the bitstream and retrieve a plurality of volume code vectors based on the plurality of V-vector indices.

3. The device of claim 2, wherein the one or more processors are further configured to reconstruct the multi-directional V-vector in the higher order ambisonics domain based on the plurality of volume code vectors in the higher order ambisonics domain and either the reconstructed first set of one or more weights used to approximate the multi-directional V-vector in the higher order ambisonics domain or the reconstructed second set of one or more weights used to approximate the multi-directional V-vector in the higher order ambisonics domain.

4. The device of claim 3, wherein each volume code vector of the plurality of volume code vectors in the higher order ambisonics domain, are based on a linear combination of spherical harmonic basis functions oriented in one of a plurality of angular directions defined by a set of azimuth and elevation angles.

5. The device of claim 4, wherein the plurality of angular directions are based on a geometry of a microphone array or defined in a table stored in the memory.

6. The device of claim 3, further comprising a loudspeaker configured to output a speaker feed based on the multi-directional V-vector in the higher order ambisonics domain.

7. A method of decoding a bitstream comprising:

extracting, from the bitstream, a type of quantization mode; and switching, based on the type of quantization mode, between non-predictive vector dequantization to reconstruct a first set of one or more weights used to approximate a multi-directional V-vector in a higher order ambisonics domain, and predictive vector dequantization to reconstruct a second set of one or more weights used to approximate the multi-directional V-vector in the higher order ambisonics domain; and retrieving from a buffer unit a previously reconstructed set of one more weights used to approximate the multi-directional V-vector in the higher order ambisonics domain, wherein the previously reconstructed set of one or more weights are based on either a non-predictive vector dequantization or a predictive vector dequantization.

8. The method of claim 7, wherein the non-predictive vector dequantization comprises:

extracting, from the bitstream, a weight index; and vector dequantizing the weight index based on a weight codebook to reconstruct the first set of one or more weights used to approximate the multi-directional V-vector in the higher order ambisonics domain.

9. The method of claim 7, wherein the predictive vector dequantization comprises:

extracting, from the bitstream, a weight index;

vector dequantizing the weight index based on a residual codebook to obtain a set of residual weight errors used to approximate the multi-directional V-vector in the higher order ambisonics domain; and reconstructing the second set of one or more weights based on the set of residual weight errors used to approximate the multi-directional V-vector in the higher order ambisonics domain, and the previously reconstructed set of one or more weights used to approximate the higher order ambisonics domain.

10. An apparatus configured to decode a bitstream comprising:

means for extracting, from the bitstream, a type of quantization mode; and means for switching, based on the type of quantization mode, between non-predictive vector dequantization to reconstruct a first set of one or more weights used to approximate the multi-directional V-vector in a higher order ambisonics domain, and predictive vector dequantization to reconstruct a second set of one or more weights used to approximate the multi-directional V-vector in the higher order ambisonics domain; and means for storing the reconstructed first set of one or more weights used to approximate the multi-directional V-vector in the higher order ambisonics domain, and the reconstructed second set of one or more weights used to approximate the multi-directional V-vector in the higher order ambisonics domain.

11. A device configured to produce a bitstream comprising:

a memory configured to store a first set of one or more weights used to approximate a multi-directional V-vector in a higher order ambisonics domain, and a second set of one or more weights used to approximate the multi-directional V-vector in the higher order ambisonics domain;

one or more processors, electrically coupled to the memory, configured to:

switch between non-predictive vector quantization of the first set of one or more weights used to approximate the multi-directional V-vector in the higher order ambisonics domain, and predictive vector quantization of the second set of one or more weights used to approximate the multi-directional V-vector in the higher order ambisonics domain; and specify, in the bitstream including a representation of the multi directional V-vector in the higher order ambisonics domain, a type of quantization mode indicative of the switch.

12. The device of claim 11, wherein the one or more processors are further configured to reconstruct a multi-directional V-vector based on the plurality of volume code vectors and one or more reconstructed weights.

13. The device of claim 12, wherein each volume code vector of the plurality of volume code vectors is in the higher order ambisonics domain, and is based on a linear combination of spherical harmonic basis functions oriented in one of a plurality of angular directions defined by a set of azimuth and elevation angles.

14. The device of claim 13, wherein the plurality of angular directions are based on a geometry of a microphone array or defined in a table stored in the memory.

15. The device of claim 11, further comprising a microphone array configured to capture an audio signal with microphones positioned at different azimuth and elevation angles.

16. A method of producing a bitstream comprising:

switching between non-predictive vector quantization of a first set of one or more weights used to approximate a multi-directional V-vector in a higher order ambisonics domain, and predictive vector quantization of a second set of one or more weights used to approximate the multi-directional V-vector in the higher order ambisonics domain;

retrieving from a buffer unit, during predictive vector quantization of the second set of one or more weights used to approximate the multi-directional V-vector in the higher order ambisonics domain, a previously reconstructed set of one more weights used to approximate the multi-directional V-vector in the higher order ambisonics domain, wherein the previously reconstructed set of one or more weights are based on either a non-predictive vector dequantization or a predictive vector dequantization; and specifying, in the bitstream a type of quantization mode indicative of the switching.

17. The method of claim 16, wherein the non-predictive vector quantization comprises vector quantizing the first set of one or more weights used to approximate the multi-directional V-vector in the higher order ambisonics domain, based on a weight codebook to determine a weight index.

18. The method of claim 17, wherein the predictive vector quantization comprises:

determining a set of residual weight errors based on the second set of one or more weights and a reconstructed set of one or more weights; and vector quantizing the set of residual weight errors based on a residual codebook to determine the weight index.

19. An apparatus configured to produce a bitstream comprising:

means for switching between non-predictive vector quantization of a first set of one or more weights used to approximate a multi-directional V-vector in a higher order ambisonics domain, and predictive vector quantization of a second set of one or more weights used to approximate the multi-directional V-vector in the higher order ambisonics domain;

means for retrieving from a memory during predictive vector quantization of the second set of one or more weights used to approximate the multi-directional V-vector in the higher order ambisonics domain, a previously reconstructed set of one more weights used to approximate the multi-directional V-vector in the higher order ambisonics domain, wherein the previously reconstructed set of one or more weights are based on either a non-predictive vector dequantization in a local decoder of an encoder or a predictive vector dequantization in the local decoder of the encoder; and means for specifying, in the bitstream a type of quantization mode indicative of the switching.

20. The apparatus of claim 19, further comprising a microphone array configured to capture an audio signal with microphones positioned at different azimuth and elevation angles.

* * * * *